US012123145B2

(12) United States Patent
Bailey et al.

(10) Patent No.: US 12,123,145 B2
(45) **Date of Patent: *Oct. 22, 2024**

(54) SANITARY TISSUE PRODUCTS

(71) Applicant: The Procter & Gamble Company, Cincinnati, OH (US)

(72) Inventors: William Ellis Bailey, Union Township, OH (US); Douglas Jay Barkey, Salem Township, OH (US); Ward William Ostendorf, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/926,875

(22) Filed: Jul. 13, 2020

(65) Prior Publication Data

US 2022/0010495 A1 Jan. 13, 2022
US 2024/0254696 A9 Aug. 1, 2024

Related U.S. Application Data

(63) Continuation of application No. 15/497,237, filed on Apr. 26, 2017.

(60) Provisional application No. 62/327,655, filed on Apr. 26, 2016.

(51) Int. Cl.

| | |
|---|---|
| ***D21H 27/00*** | (2006.01) |
| ***D21F 11/00*** | (2006.01) |
| ***D21H 11/12*** | (2006.01) |
| ***D21H 27/02*** | (2006.01) |

(52) U.S. Cl.
CPC ..... *D21H 27/005* (2013.01); *D21F 11/006* (2013.01); *D21H 11/12* (2013.01); *D21H 27/02* (2013.01)

(58) Field of Classification Search
CPC ..... D21H 27/005; D21H 27/02; D21H 11/12; D21H 27/40; D21H 21/20; D21H 11/04; D21F 11/006; D21F 11/14
See application file for complete search history.

(56) References Cited

U.S. PATENT DOCUMENTS

| | | | | |
|---|---|---|---|---|
| 4,637,859 | A * | 1/1987 | Trokhan | D21H 25/005 162/109 |
| 5,846,380 | A * | 12/1998 | Van Phan | D21F 11/14 162/111 |
| 9,657,444 | B2 | 5/2017 | Burazin et al. | |
| 9,976,260 | B2 | 5/2018 | Margo Moreno et al. | |
| 10,947,674 | B2 | 3/2021 | Burazin et al. | |
| 2004/0221975 | A1 | 11/2004 | Hernandez-Munoa et al. | |
| 2005/0148261 | A1 | 7/2005 | Close et al. | |

(Continued)

FOREIGN PATENT DOCUMENTS

WO WO 2015/095433 A1 6/2015

OTHER PUBLICATIONS

U.S. Appl. No. 15/497,237, filed Apr. 26, 2017, William Ellis Bailey, et al.

(Continued)

*Primary Examiner* — Jacob T Minskey
*Assistant Examiner* — Matthew M Eslami
(74) *Attorney, Agent, or Firm* — James E. Oehlenschlager

(57) ABSTRACT

Sanitary tissue products employing fibrous structures that exhibit novel tear alone or in combination with tensile properties and methods for making same.

15 Claims, 25 Drawing Sheets

(56) References Cited

U.S. PATENT DOCUMENTS

| | | | | |
|---|---|---|---|---|
| 2007/0224419 | A1 | 9/2007 | Sumnicht et al. | |
| 2007/0272381 | A1 | 11/2007 | Elony et al. | |
| 2008/0029235 | A1 | 2/2008 | Edwards et al. | |
| 2010/0212850 | A1 | 8/2010 | Sumnicht et al. | |
| 2011/0265965 | A1* | 11/2011 | Sumnicht ..... | D21C 9/005 162/111 |
| 2012/0107568 | A1 | 5/2012 | Manifold et al. | |
| 2013/0143001 | A1 | 6/2013 | Manifold et al. | |
| 2013/0216789 | A1 | 8/2013 | Kraus et al. | |
| 2015/0176218 | A1 | 6/2015 | Maladen et al. | |
| 2017/0306566 | A1 | 10/2017 | Bailey et al. | |

OTHER PUBLICATIONS

U.S. Appl. No. 16/911,515, filed Jun. 25, 2020, Ward William Ostendorf, et al.

U.S. Appl. No. 16/180,139, filed Nov. 5, 2018, Ward William Ostendorf, et al.

U.S. Appl. No. 16/911,477, filed Jun. 25, 2020, Ward William Ostendorf, et al.

All Office Action U.S. Appl. Nos. 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422; 14/574,422 and 14/574,422.

PCT International Search Report dated Mar. 11, 2015—5 pages.

PCT International Search Report dated Mar. 13, 2015—5 pages.

PCT International Search Report dated Mar. 19, 2015—5 pages.

International Search Report and Written Opinion; Application Ser. No. PCT/US2017/029541; dated Jun. 30, 2017, 8 pages.

* cited by examiner

SANITARY TISSUE PRODUCTS

FIELD OF THE INVENTION

The present invention relates to sanitary tissue products comprising a plurality of pulp fibers such that the sanitary tissue products exhibit novel tear strength properties alone or in combination with tensile strength properties and methods for making same.

BACKGROUND OF THE INVENTION

Tear strength, tensile, and softness of sanitary tissue products, for example toilet tissue (bath tissue) products, such as patterned sanitary tissue products, for example sanitary tissue products made on a patterned molding member, are important characteristics to consumers of such sanitary tissue products.

Prior Art FIGS. 1A and 1B show a patterned molding member 10, such as a through-air-drying belt, comprising a plurality of discrete knuckles 12, which are curved discrete knuckles formed by line segments of resin 14 that are arranged in a non-random, repeating pattern, in groups and oriented at an angle $\alpha$ of 45° with respect to the cross-machine direction (CD). In this case, the discrete knuckles 12 are arranged in a woven pattern, for example a herringbone pattern. The discrete knuckles 12 are dispersed within a continuous pillow network 16, which constitutes a deflection conduit into which portions of a sanitary tissue product, such as a fibrous structure ply, being made on the patterned molding member 10 of FIGS. 1A and 1B deflect.

Prior Art FIG. 2 is a MikroCAD image of a resulting sanitary tissue product 18 being made on the patterned molding member 10. The sanitary tissue product 18 comprises a continuous pillow region 20 imparted by the continuous pillow network 16 of the patterned molding member 10 of FIGS. 1A and 1B. The sanitary tissue product 18 further comprises discrete knuckle regions 22 imparted by the discrete knuckles 12 of the patterned molding member 10 of FIGS. 1A and 1B. The continuous pillow region 20 and discrete knuckle regions 22 may exhibit different densities, for example, one or more of the discrete knuckle regions 22 may exhibit a density that is greater than the density of the continuous pillow region 20.

The resulting sanitary tissue product 18 from the patterned molding member 10 of FIGS. 1A and 1B exhibited less than desirable tear and/or tensile properties.

One problem with the known sanitary tissue products is that the known sanitary tissue products, for example toilet tissue (bath tissue) products, exhibit less than desirable tear and/or tensile properties, for example a GM Tear Value as measured according to the Tear Test Method and a GM Tensile Value as measured according to the Dry Tensile Test Method that falls below a line having the following equation: $y=0.0122x+18.05$ graphed on a plot of GM Tear Value (y-axis) to GM Tensile Value (x-axis) and/or falls below a line having the following equation: $y=0.0328x+12.794$ graphed on a plot of GM Tear Value (y-axis) to GM Tensile Value (x-axis) and/or falls below a line having the following equation: $y=0.0473x+9.179$ graphed on a plot of GM Tear Value (y-axis) to GM Tensile Value (x-axis) and/or falls below a line having the following equation: $y=0.0654x+4.6601$ graphed on a plot of GM Tear Value (y-axis) to GM Tensile Value (x-axis) and/or a GM Tear Value of less than 24.5 g and/or exhibit a GM Tensile Value of greater than 380 g/in and a GM Tear Value of less than 22.7 g and/or a CD Tear Value as measured according to the Tear Strength Test Method and a CD Tensile Value as measured according to the Dry Tensile Test Method such that falls below a line having the following equation: $y=0.0188x+16.845$ graphed on a plot of CD Tear Value (y-axis) to CD Tensile Value (x-axis) and/or falls below a line having the following equation: $y=0.0864x+4.5339$ graphed on a plot of CD Tear Value (y-axis) to CD Tensile Value (x-axis) and/or exhibit a CD Tear Value of greater than 26.9 g and/or exhibit a CD Tear Value of less than 26.9 g and/or exhibit a CD Tear Value of less than 23.0 g and/or exhibits a CD Tensile Value of greater than 650 g/in and a CD Tear Value of less than 23.0 g and/or exhibit a CD Tensile Value of greater than 650 g/in and a CD Tear Value of less than 26.9 g and/or exhibit a MD Tear Value as measured according to the Tear Strength Test Method and a MD Tensile Value as measured according to the Dry Tensile Test Method such that the sanitary tissue product falls below a line having the following equation: $y=0.0338x+10.235$ graphed on a plot of MD Tear Value (y-axis) to MD Tensile Value (x-axis) and/or falls below a line having the following equation: $y=0.0716x-0.6674$ graphed on a plot of MD Tear Value (y-axis) to MD Tensile Value (x-axis) and/or falls below a line having the following equation: $y=0.0716x-0.6674$ graphed on a plot of MD Tear Value (y-axis) to MD Tensile Value (x-axis).

Tear Strength, such as GM Tear, CD Tear, and/or MD Tear, is an indication of how well a sanitary tissue product or fibrous structure resists tearing after an initial deformation has been imparted to the sanitary tissue product or fibrous structure. Higher tear strength values exhibited by a sanitary tissue product or fibrous structure tend to be more resilient in a manufacturing setting and also when used by a consumer. Increasing tensile strength is one way to increase tear strength. However, increasing tensile strength is known to decrease softness performance by increasing the stiffness of the sanitary tissue product or fibrous structure. Therefore, it is desirable to have a sanitary tissue product with as high of a tear strength value as possible at as low of a tensile strength value as possible.

In addition, cushiness and flexibility, both characteristics associated with cloths, are attributes that consumers desire in their sanitary tissue products, for example bath tissue products. A technical measure of cushiness is compressibility of the sanitary tissue product which is measured by the Stack Compressibility and Resilient Bulk Test Method. A technical measure of flexibility is plate stiffness of the sanitary tissue product which is measured by the Plate Stiffness Test Method. Current sanitary tissue products fall short of consumers' expectations for cushiness and flexibility.

Accordingly, one problem faced by sanitary tissue product manufacturers is how to improve (i.e., increase) tear properties while at the same time maintaining or improving the compressibility and plate stiffness properties of sanitary tissue products, for example bath tissue products, to make such sanitary tissue products stronger, especially with respect to tear strength, but cushy and flexible sanitary tissue product to better meet consumers' expectations for more clothlike, luxurious, and plush sanitary tissue products.

Accordingly, there exists a need for sanitary tissue products, for example bath tissue products, that exhibit improved tear and/or tensile properties to provide consumers with sanitary tissue products that fulfill their desires and expectations for more comfortable and/or luxurious sanitary tissue products, and methods for making such sanitary tissue products.

SUMMARY OF THE INVENTION

The present invention fulfills the need described above by providing sanitary tissue products, for example bath tissue products, that exhibit increased tear properties alone or with loser tensile properties than known sanitary tissue products, for example bath tissue products, and methods for making such sanitary tissue products.

One solution to the problem set forth above is achieved by making the sanitary tissue products or at least one fibrous structure ply employed in the sanitary tissue products on patterned molding members that impart three-dimensional (3D) patterns to the sanitary tissue products and/or fibrous structure plies made thereon, wherein the patterned molding members are designed such that the resulting sanitary tissue products, for example bath tissue products, made using the patterned molding members and/or the process conditions used during the making process, for example vacuum settings during the sanitary tissue product making process, overcome the problem(s) identified above with respect to tear and/or tensile properties.

One solution to the problem(s) identified above is to make sanitary tissue products, such as patterned sanitary tissue products, for example where at least one fibrous structure ply has been formed on a patterned molding member that imparts a three-dimensional (3D) pattern to the fibrous structure ply and/or sanitary tissue product employing such fibrous structure ply. The sanitary tissue product, for example toilet tissue (bath tissue) products, designed and/or manufactured to exhibit tear and/or tensile properties that are consumer desirable, for example a GM Tear Value as measured according to the Tear Test Method and a GM Tensile Value as measured according to the Dry Tensile Test Method that falls above a line having the following equation: $y=0.0122x+18.05$ graphed on a plot of GM Tear Value (y-axis) to GM Tensile Value (x-axis) and/or falls above a line having the following equation: $y=0.0328x+12.794$ graphed on a plot of GM Tear Value (y-axis) to GM Tensile Value (x-axis) and/or falls above a line having the following equation: $y=0.0473x+9.179$ graphed on a plot of GM Tear Value (y-axis) to GM Tensile Value (x-axis) and/or falls above a line having the following equation: $y=0.0654x+4.6601$ graphed on a plot of GM Tear Value (y-axis) to GM Tensile Value (x-axis) and/or a GM Tear Value of greater than 24.5 g and/or exhibit a GM Tensile Value of less than 380 g/in and a GM Tear Value of greater than 22.7 g and/or a CD Tear Value as measured according to the Tear Strength Test Method and a CD Tensile Value as measured according to the Dry Tensile Test Method such that falls above a line having the following equation: $y=0.0188x+16.845$ graphed on a plot of CD Tear Value (y-axis) to CD Tensile Value (x-axis) and/or falls above a line having the following equation: $y=0.0864x+4.5339$ graphed on a plot of CD Tear Value (y-axis) to CD Tensile Value (x-axis) and/or exhibit a CD Tear Value of greater than 26.9 g and/or exhibit a CD Tear Value of greater than 26.9 g and/or exhibit a CD Tear Value of greater than 23.0 g and/or exhibits a CD Tensile Value of less than 650 g/in and a CD Tear Value of greater than 23.0 g and/or exhibit a CD Tensile Value of less than 650 g/in and a CD Tear Value of greater than 26.9 g and/or exhibit a MD Tear Value as measured according to the Tear Strength Test Method and a MD Tensile Value as measured according to the Dry Tensile Test Method such that the sanitary tissue product falls above a line having the following equation: $y=0.0338x+10.235$ graphed on a plot of MD Tear Value (y-axis) to MD Tensile Value (x-axis) and/or falls above a line having the following equation: $y=0.0716x-0.6674$ graphed on a plot of MD Tear Value (y-axis) to MD Tensile Value (x-axis) and/or falls above a line having the following equation: $y=0.0716x-0.6674$ graphed on a plot of MD Tear Value (y-axis) to MD Tensile Value (x-axis).

Non-limiting examples of such patterned molding members include patterned felts, patterned forming wires, patterned rolls, patterned fabrics, and patterned belts utilized in conventional wet-pressed papermaking processes, air-laid papermaking processes, and/or wet-laid papermaking processes that produce 3D patterned sanitary tissue products and/or 3D patterned fibrous structure plies employed in sanitary tissue products. Other non-limiting examples of such patterned molding members include through-air-drying fabrics and through-air-drying belts utilized in through-air-drying papermaking processes that produce through-air-dried sanitary tissue products, for example 3D patterned through-air dried sanitary tissue products, and/or through-air-dried fibrous structure plies, for example 3D patterned through-air-dried fibrous structure plies, employed in sanitary tissue products. Non-limiting examples of such patterned molding members include patterned felts, patterned forming wires, patterned rolls, patterned fabrics, and patterned belts utilized in conventional wet-pressed papermaking processes, air-laid papermaking processes, and/or wet-laid papermaking processes that produce 3D patterned sanitary tissue products and/or 3D patterned fibrous structure plies employed in sanitary tissue products. Other non-limiting examples of such patterned molding members include through-air-drying fabrics and through-air-drying belts utilized in through-air-drying papermaking processes that produce through-air-dried sanitary tissue products, for example 3D patterned through-air dried sanitary tissue products, and/or through-air-dried fibrous structure plies, for example 3D patterned through-air-dried fibrous structure plies, employed in sanitary tissue products.

It has been unexpectedly found that the following variables increase tear strength values while minimizing tensile strength values: 1) type of knuckle in a patterned molding member (discrete, semi-continuous, or continuous), 2) placement of the softwood pulp fibers (strength providing fibers), such as Northern Softwood Kraft pulp fibers, in a layered structure, and 3) the angle of knuckles relative to the cross machine direction (CD).

It has further been found that discrete knuckle and semi-continuous knuckle fibrous structures (sanitary tissue products) improve tear strength performance compared to continuous knuckle fibrous structures (sanitary tissue products). Not to be bound by theory, it is believed that the reason for the improved tear strength of discrete knuckle and semi-continuous knuckle structures compared to continuous knuckle structures is that there is a continuous or semi-continuous pillow (lower density and higher stretch than the knuckles) available to absorb the energy imparted to the fibrous structure (sanitary tissue product) upon tearing. When the fibrous structure (sanitary tissue product) is being torn, this allows the strain on the structure to move through the pillow and put less stress on the knuckles. Continuous knuckle fibrous structures (sanitary tissue products) will not move the strain through a lower density pillow as effectively, because the pillows are discrete. This imparts more stress on the knuckles at a lower tear strength, ultimately leading to failure at lower tear strength values than desirable to consumers. It has further been found that placement of the softwood pulp fibers (strength providing fibers), such as Northern Softwood Kraft, in a layered structure also can increase tear strength. Specifically, moving Northern Softwood Kraft out of the fabric layer and into the center and/or wire layer improves tear strength performance compared layered structures with Northern Softwood Kraft on the fabric layer. Not to be bound by theory, it is believed that by moving the Northern Softwood Kraft out of the fabric layer the Northern Softwood Kraft does not undergo as much manipulation during the wet transfer transformation. As a result, the Northern Softwood Kraft is able to reinforce the fibrous structure (sanitary tissue product) better, which leads to higher tear strength relative to tensile strength. Another benefit of moving the Northern Softwood Kraft to the center and/or wire layer is that this has led to moving hardwood fibers, such as *Eucalyptus* fibers, to the fabric layer. When this structure is then converted fabric side out (FSO) with the fiber orientation described above (*Eucalyptus* fibers in the fabric layer, Northern Softwood Kraft in the center and/or wire layer), it leads to an unexpectedly soft product with low Emtec TS7 values, low Slipstick values. This softness advantage is seen most pronounced in discrete knuckle, followed by semi-continuous knuckle, and then continuous knuckle designs.

It has also been found that placement of the angle of the knuckles relative to the cross direction can also increase tear strength. Specifically, it has been found that moving discrete and semi-continuous knuckles to angles greater than 60° relative to CD improves tear strength relative to tensile strength. Aligning the knuckles more in the MD aligns the high density regions of the structure of the fibrous structure (sanitary tissue product) in the same direction as the typical failure mode. According to TAPPI T-496 section 1.1, highly directional paper samples where the initial cuts are formed in the CD, will often turn and fail in the MD. Not to be bound by theory, aligning the discrete or semi-continuous knuckles more in the MD allows the strain related to tear strength to proceed in the direction where the fibrous structure (sanitary tissue product) naturally wants to go. This minimizes the stress on the discrete or semi-continuous knuckles at the same tear strength, which ultimately leads to higher tear strength. The alignment of the knuckles at greater than 60° relative to the CD helps both MD and CD Tear Strength (and by relationship, Geometric Mean (GM) Tear Strength), because both the MD and CD fibrous structure (sanitary tissue product) samples fail in the MD.

In one example of the present invention, a creped sanitary tissue product comprising a plurality of pulp fibers, wherein the creped sanitary tissue product is void of permanent wet strength, wherein the creped sanitary tissue product exhibits a GM Tear Value as measured according to the Tear Strength Test Method and a GM Tensile Value as measured according to the Dry Tensile Test Method such that the creped sanitary tissue product falls above a line having the following equation: $y=0.0122x+18.05$ graphed on a plot of GM Tear Value (y-axis) to GM Tensile Value (x-axis) as shown in FIG. 3A, is provided.

In another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test), creped sanitary tissue product comprising a plurality of pulp fibers, wherein the dispersible, creped sanitary tissue product exhibits a GM Tear Value as measured according to the Tear Strength Test Method and a GM Tensile Value as measured according to the Dry Tensile Test Method such that the dispersible, creped sanitary tissue product falls above a line having the following equation: $y=0.0122x+18.05$ graphed on a plot of GM Tear Value (y-axis) to GM Tensile Value (x-axis) as shown in FIG. 3A, is provided.

In another example of the present invention, a creped, multi-ply sanitary tissue product comprising a plurality of pulp fibers, wherein the creped, multi-ply sanitary tissue product exhibits a GM Tensile Value of less than 700 g/in and wherein the creped, multi-ply sanitary tissue product exhibits a GM Tear Value as measured according to the Tear Test Method and a GM Tensile Value as measured according to the Dry Tensile Test Method such that the creped, multi-ply sanitary tissue product falls above a line having the following equation: $y=0.0122x+18.05$ graphed on a plot of GM Tear Value (y-axis) to GM Tensile Value (x-axis) as shown in FIG. 3A, is provided.

In another example of the present invention, a sanitary tissue product comprising a plurality of pulp fibers, wherein the sanitary tissue product is void of permanent wet strength, wherein the sanitary tissue product exhibits a GM Tear Value as measured according to the Tear Strength Test Method and a GM Tensile Value as measured according to the Dry Tensile Test Method such that the sanitary tissue product falls above a line having the following equation: $y=0.0328x+12.794$ graphed on a plot of GM Tear Value (y-axis) to GM Tensile Value (x-axis) as shown in FIG. 3A, is provided.

In yet another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a GM Tear Value as measured according to the Tear Strength Test Method and a GM Tensile Value as measured according to the Dry Tensile Test Method such that the dispersible sanitary tissue product falls above a line having the following equation: $y=0.0328x+12.794$ graphed on a plot of GM Tear Value (y-axis) to GM Tensile Value (x-axis) as shown in FIG. 3A, is provided.

In yet another example of the present invention, a multi-ply sanitary tissue product comprising a plurality of pulp fibers, wherein the multi-ply sanitary tissue product exhibits a GM Tensile Value of less than 700 g/in and wherein the multi-ply sanitary tissue product exhibits a GM Tear Value as measured according to the Tear Test Method and a GM Tensile Value as measured according to the Dry Tensile Test Method such that the multi-ply sanitary tissue product falls above a line having the following equation: $y=0.0328x+12.794$ graphed on a plot of GM Tear Value (y-axis) to GM Tensile Value (x-axis) as shown in FIG. 3A, is provided.

In yet another example of the present invention, a sanitary tissue product comprising a plurality of pulp fibers, wherein the sanitary tissue product is void of permanent wet strength, wherein the sanitary tissue product exhibits a GM Tear Value as measured according to the Tear Strength Test Method and a GM Tensile Value as measured according to the Dry Tensile Test Method such that the sanitary tissue product falls above a line having the following equation: $y=0.0473x+9.179$ graphed on a plot of GM Tear Value (y-axis) to GM Tensile Value (x-axis) as shown in FIG. 3B, is provided.

In yet another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a GM Tear Value as measured according to the Tear Strength Test Method and a GM Tensile Value as measured according to the Dry Tensile Test Method such that the dispersible sanitary tissue product falls above a line having the following equation: y=0.0473x+9.179 graphed on a plot of GM Tear Value (y-axis) to GM Tensile Value (x-axis) as shown in FIG. 3B, is provided.

In another example of the present invention, a multi-ply sanitary tissue product comprising a plurality of pulp fibers, wherein the multi-ply sanitary tissue product exhibits a GM Tensile Value of less than 700 g/in and wherein the sanitary tissue product exhibits a GM Tear Value as measured according to the Tear Strength Test Method and a GM Tensile Value as measured according to the Dry Tensile Test Method such that the sanitary tissue product falls above a line having the following equation: y=0.0473x+9.179 graphed on a plot of GM Tear Value (y-axis) to GM Tensile Value (x-axis) as shown in FIG. 3B, is provided.

In another example of the present invention, a sanitary tissue product comprising a plurality of pulp fibers, wherein the sanitary tissue product is void of permanent wet strength, wherein the sanitary tissue product exhibits a GM Tear Value as measured according to the Tear Strength Test Method and a GM Tensile Value as measured according to the Dry Tensile Test Method such that the sanitary tissue product falls above a line having the following equation: y=0.0654x+4.6601 graphed on a plot of GM Tear Value (y-axis) to GM Tensile Value (x-axis) as shown in FIG. 3B, is provided.

In still another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a GM Tear Value as measured according to the Tear Strength Test Method and a GM Tensile Value as measured according to the Dry Tensile Test Method such that the dispersible sanitary tissue product falls above a line having the following equation: y=0.0654x+4.6601 graphed on a plot of GM Tear Value (y-axis) to GM Tensile Value (x-axis) as shown in FIG. 3B, is provided.

In still another example of the present invention, a multi-ply sanitary tissue product comprising a plurality of pulp fibers, wherein the multi-ply sanitary tissue product exhibits a GM Tear Value as measured according to the Tear Test Method and a GM Tensile Value as measured according to the Dry Tensile Test Method such that the multi-ply sanitary tissue product falls above a line having the following equation: y=0.0654x+4.6601 graphed on a plot of GM Tear Value (y-axis) to GM Tensile Value (x-axis) as shown in FIG. 3B, is provided.

In yet another example of the present invention, a creped sanitary tissue product comprising a plurality of pulp fibers, wherein the creped sanitary tissue product is void of permanent wet strength, wherein the sanitary tissue product exhibits a GM Tear Value of greater than 24.5 g as measured according to the Tear Value Test Method as shown in FIGS. 3A and 3B, is provided.

In another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test), creped sanitary tissue product comprising a plurality of pulp fibers, wherein the dispersible, creped sanitary tissue product exhibits a GM Tear Value of greater than 24.5 g as measured according to the Tear Value Test Method as shown in FIGS. 3A and 3B, is provided.

In another example of the present invention, a sanitary tissue product comprising a plurality of pulp fibers, wherein the sanitary tissue product is void of permanent wet strength, wherein the sanitary tissue product exhibits a GM Tensile Value of less than 380 g/in as measured according to the Dry Tensile Test Method and a GM Tear Value of greater than 22.7 g as measured according to the Tear Value Test Method as shown in FIGS. 3A and 3B, is provided.

In even another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a GM Tensile Value of less than 380 g/in as measured according to the Dry Tensile Test Method and a GM Tear Value of greater than 22.7 g as measured according to the Tear Value Test Method as shown in FIGS. 3A and 3B, is provided.

In even another example of the present invention, a multi-ply sanitary tissue product comprising a plurality of pulp fibers, wherein the multi-ply sanitary tissue product exhibits a GM Tensile Value of less than 380 g/in as measured according to the Dry Tensile Test Method and a GM Tear Value of greater than 22.7 g as measured according to the Tear Value Test Method as shown in FIGS. 3A and 3B, is provided.

In even another example of the present invention, a creped sanitary tissue product comprising a plurality of pulp fibers, wherein the creped sanitary tissue product is void of permanent wet strength, wherein the creped sanitary tissue product exhibits a CD Tear Value as measured according to the Tear Strength Test Method and a CD Tensile Value as measured according to the Dry Tensile Test Method such that the creped sanitary tissue product falls above a line having the following equation: y=0.0188x+16.845 graphed on a plot of CD Tear Value (y-axis) to CD Tensile Value (x-axis) as shown in FIG. 4A, is provided.

In still another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test), creped sanitary tissue product comprising a plurality of pulp fibers, wherein the dispersible, creped sanitary tissue product exhibits a CD Tear Value as measured according to the Tear Strength Test Method and a CD Tensile Value as measured according to the Dry Tensile Test Method such that the dispersible, creped sanitary tissue product falls above a line having the following equation: y=0.0188x+16.845 graphed on a plot of CD Tear Value (y-axis) to CD Tensile Value (x-axis) as shown in FIG. 4A, is provided.

In still another example of the present invention, a creped sanitary tissue product comprising a plurality of pulp fibers, wherein the creped sanitary tissue product exhibits a CD Tensile Value of less than 650 g/in, wherein the creped sanitary tissue product exhibits a CD Tear Value as measured according to the Tear Strength Test Method and a CD Tensile Value as measured according to the Dry Tensile Test Method such that the creped sanitary tissue product falls above a line having the following equation: y=0.0188x+16.845 graphed on a plot of CD Tear Value (y-axis) to CD Tensile Value (x-axis) as shown in FIG. 4A, is provided.

In even yet another example of the present invention, a creped, multi-ply sanitary tissue product comprising a plurality of pulp fibers, wherein the creped, multi-ply sanitary tissue product exhibits a CD Tensile Value of less than 650 g/in, wherein the creped, multi-ply sanitary tissue product exhibits a CD Tear Value as measured according to the Tear Strength Test Method and a CD Tensile Value as measured according to the Dry Tensile Test Method such that the creped, multi-ply sanitary tissue product falls above a line having the following equation: y=0.0188x+16.845 graphed on a plot of CD Tear Value (y-axis) to CD Tensile Value (x-axis) as shown in FIG. 4A, is provided.

In even another example of the present invention, a sanitary tissue product comprising a plurality of pulp fibers, wherein the sanitary tissue product is void of permanent wet strength, wherein the sanitary tissue product exhibits a CD Tear Value as measured according to the Tear Strength Test Method and a CD Tensile Value as measured according to the Dry Tensile Test Method such that the sanitary tissue product falls above a line having the following equation: y=0.0864x+4.5339 graphed on a plot of CD Tear Value (y-axis) to CD Tensile Value (x-axis) as shown in FIGS. 4A and 4B, is provided.

In even another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a CD Tear Value as measured according to the Tear Strength Test Method and a CD Tensile Value as measured according to the Dry Tensile Test Method such that the dispersible sanitary tissue product falls above a line having the following equation: y=0.0864x+4.5339 graphed on a plot of CD Tear Value (y-axis) to CD Tensile Value (x-axis) as shown in FIGS. 4A and 4B, is provided.

In another example of the present invention, a multi-ply sanitary tissue product comprising a plurality of pulp fibers, wherein the multi-ply sanitary tissue product exhibits a CD Tear Value as measured according to the Tear Strength Test Method and a CD Tensile Value as measured according to the Dry Tensile Test Method such that the dispersible sanitary tissue product falls above a line having the following equation: y=0.0864x+4.5339 graphed on a plot of CD Tear Value (y-axis) to CD Tensile Value (x-axis) as shown in FIGS. 4A and 4B, is provided.

In still yet another example of the present invention, a sanitary tissue product comprising a plurality of pulp fibers, wherein the sanitary tissue product is void of permanent wet strength, wherein the sanitary tissue product exhibits a CD Tear Value of greater than 26.9 g as measured according to the Tear Test Method as shown in FIGS. 4A and 4B, is provided.

In still yet another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a CD Tear Value of greater than 26.9 g as measured according to the Tear Test Method as shown in FIGS. 4A and 4B, is provided.

In even still yet another example of the present invention, a creped sanitary tissue product comprising a plurality of pulp fibers, wherein the creped sanitary tissue product is void of permanent wet strength, wherein the creped sanitary tissue product exhibits a CD Tear Value of greater than 23.0 g as measured according to the Tear Test Method as shown in FIGS. 4A and 4B, is provided.

In even still yet another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a CD Tear Value of greater than 23.0 g as measured according to the Tear Test Method as shown in FIGS. 4A and 4B, is provided.

In yet another example of the present invention, a creped sanitary tissue product comprising a plurality of pulp fibers, wherein the creped sanitary tissue product exhibits a CD Tensile Value of less than 650 g/M as measured according to the Dry Tensile Test Method, wherein the creped sanitary tissue product exhibits a CD Tear Value of greater than 23.0 g as measured according to the Tear Test Method as shown in FIGS. 4A and 4B, is provided.

In even another example of the present invention, a multi-ply sanitary tissue product comprising a plurality of pulp fibers, wherein the multi-ply sanitary tissue product exhibits a CD Tensile Value of less than 650 g/M, wherein the multi-ply sanitary tissue product exhibits a CD Tear Value of greater than 26.9 g as measured according to the Tear Test Method as shown in FIGS. 4A and 4B, is provided.

In still another example of the present invention, a sanitary tissue product comprising a plurality of pulp fibers, wherein the sanitary tissue product is void of permanent wet strength, wherein the sanitary tissue product exhibits a MD Tear Value as measured according to the Tear Strength Test Method and a MD Tensile Value as measured according to the Dry Tensile Test Method such that the sanitary tissue product falls above a line having the following equation: y=0.0338x+10.235 graphed on a plot of MD Tear Value (y-axis) to MD Tensile Value (x-axis) as shown in FIG. 5A, is provided.

In still yet another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a MD Tear Value as measured according to the Tear Strength Test Method and a MD Tensile Value as measured according to the Dry Tensile Test Method such that the dispersible sanitary tissue product falls above a line having the following equation: y=0.0338x+10.235 graphed on a plot of MD Tear Value (y-axis) to MD Tensile Value (x-axis) as shown in FIG. 5A, is provided.

In even still yet another example of the present invention, a multi-ply sanitary tissue product comprising a plurality of pulp fibers, wherein the multi-ply sanitary tissue product exhibits a MD Tensile Value of less than 700 g/in and wherein the multi-ply sanitary tissue product exhibits a MD Tear Value as measured according to the Tear Test Method and a MD Tensile Value as measured according to the Dry Tensile Test Method such that the multi-ply sanitary tissue product falls above a line having the following equation: y=0.0338x+10.235 graphed on a plot of MD Tear Value (y-axis) to MD Tensile Value (x-axis) as shown in FIG. 5A, is provided.

In even yet another example of the present invention, a sanitary tissue product comprising a plurality of pulp fibers, wherein the sanitary tissue product is void of permanent wet strength, wherein the sanitary tissue product exhibits a MD Tear Value as measured according to the Tear Strength Test Method and a MD Tensile Value as measured according to the Dry Tensile Test Method such that the sanitary tissue product falls above a line having the following equation: y=0.0716x−0.6674 graphed on a plot of MD Tear Value (y-axis) to MD Tensile Value (x-axis) as shown in FIG. 5B, is provided.

In still yet another example of the present invention, a dispersible (in one example as used herein "dispersible" means a sanitary tissue product and/or fibrous structure that is capable of decaying in a relatively short amount of time so that it does not clog sewage systems and/or septic tanks and/or means aerobic biodisintegratable as measured according to EDANA FG505 Aerobic Biodisintegration Test) sanitary tissue product comprising a plurality of pulp fibers, wherein the dispersible sanitary tissue product exhibits a MD Tear Value as measured according to the Tear Strength Test Method and a MD Tensile Value as measured according to the Dry Tensile Test Method such that the dispersible sanitary tissue product falls above a line having the following equation: y=0.0716x−0.6674 graphed on a plot of MD Tear Value (y-axis) to MD Tensile Value (x-axis) as shown in FIG. 5B, is provided.

In even still yet another example of the present invention, a multi-ply sanitary tissue product comprising a plurality of pulp fibers, wherein the multi-ply sanitary tissue product exhibits a MD Tear Value as measured according to the Tear Test Method and a MD Tensile Value as measured according to the Dry Tensile Test Method such that the multi-ply sanitary tissue product falls above a line having the following equation: y=0.0716x−0.6674 graphed on a plot of MD Tear Value (y-axis) to MD Tensile Value (x-axis) as shown in FIG. 5B, is provided.

In still yet another example of the present invention, a method for making a single- or multi-ply sanitary tissue product according to the present invention, wherein the method comprises the steps of:

a. contacting a patterned molding member with a fibrous structure comprising a plurality of pulp fibers such that a 3D patterned fibrous structure ply is formed; and
b. making a single- or multi-ply sanitary tissue product according to the present invention comprising the 3D patterned fibrous structure ply, is provided.

Accordingly, the present invention provides sanitary tissue products, for example toilet tissue (bath tissue) products, that exhibit more consumer desirable tear and/or tensile properties, and methods for making same.

DETAILED DESCRIPTION OF THE INVENTION

Definitions

Figure 1A:
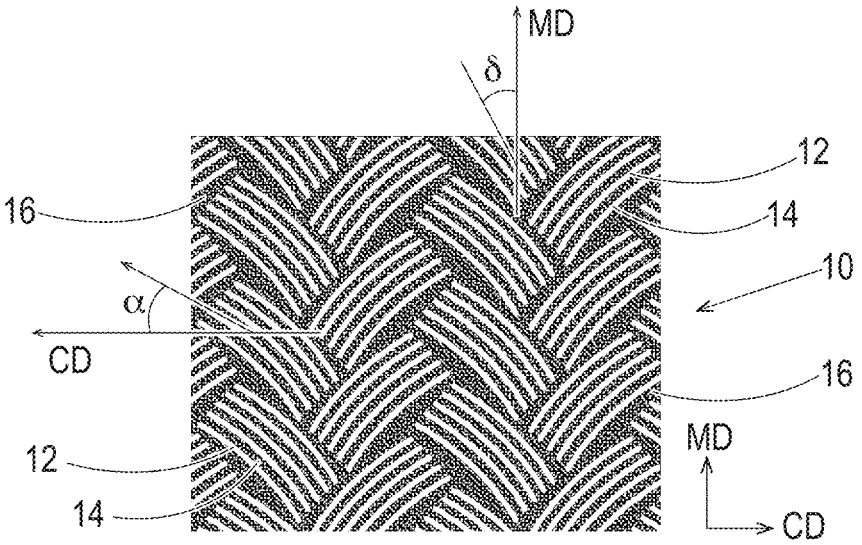
Fig. 1A PRIOR ART
FIG. 1A is a schematic representation of an example of a prior art molding member.

"Sanitary tissue product" as used herein means a soft, low density (i.e. <about 0.15 g/cm$^3$) article comprising one or more fibrous structure plies according to the present invention, wherein the sanitary tissue product is useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

The sanitary tissue products and/or fibrous structures of the present invention may exhibit a basis weight of greater than 15 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue products and/or fibrous structures of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a sum of MD and CD dry tensile strength of greater than about 59 g/cm (150 g/in) and/or from about 78 g/cm to about 394 g/cm and/or from about 98 g/cm to about 335 g/cm. In addition, the sanitary tissue product of the present invention may exhibit a sum of MD and CD dry tensile strength of greater than about 196 g/cm and/or from about 196 g/cm to about 394 g/cm and/or from about 216 g/cm to about 335 g/cm and/or from about 236 g/cm to about 315 g/cm. In one example, the sanitary tissue product exhibits a sum of MD and CD dry tensile strength of less than about 394 g/cm and/or less than about 335 g/cm.

In another example, the sanitary tissue products of the present invention may exhibit a sum of MD and CD dry tensile strength of greater than about 196 g/cm and/or greater than about 236 g/cm and/or greater than about 276 g/cm and/or greater than about 315 g/cm and/or greater than about 354 g/cm and/or greater than about 394 g/cm and/or from about 315 g/cm to about 1968 g/cm and/or from about 354 g/cm to about 1181 g/cm and/or from about 354 g/cm to about 984 g/cm and/or from about 394 g/cm to about 787 g/cm.

The sanitary tissue products of the present invention may exhibit an initial sum of MD and CD wet tensile strength of less than about 78 g/cm and/or less than about 59 g/cm and/or less than about 39 g/cm and/or less than about 29 g/cm.

The sanitary tissue products of the present invention may exhibit an initial sum of MD and CD wet tensile strength of greater than about 118 g/cm and/or greater than about 157 g/cm and/or greater than about 196 g/cm and/or greater than about 236 g/cm and/or greater than about 276 g/cm and/or greater than about 315 g/cm and/or greater than about 354 g/cm and/or greater than about 394 g/cm and/or from about 118 g/cm to about 1968 g/cm and/or from about 157 g/cm to about 1181 g/cm and/or from about 196 g/cm to about 984 g/cm and/or from about 196 g/cm to about 787 g/cm and/or from about 196 g/cm to about 591 g/cm.

The sanitary tissue products of the present invention may exhibit a density (based on measuring caliper at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

In another example, the sanitary tissue products may be in the form of discrete sheets that are stacked within and dispensed from a container, such as a box.

The fibrous structures and/or sanitary tissue products of the present invention may comprise additives such as surface softening agents, for example silicones, quaternary ammonium compounds, aminosilicones, lotions, and mixtures thereof, temporary wet strength agents, permanent wet strength agents, bulk softening agents, wetting agents, latexes, especially surface-pattern-applied latexes, dry strength agents such as carboxymethylcellulose and starch, and other types of additives suitable for inclusion in and/or on sanitary tissue products.

"Fibrous structure" as used herein means a structure that comprises a plurality of pulp fibers. In one example, the fibrous structure may comprise a plurality of wood pulp fibers. In another example, the fibrous structure may comprise a plurality of non-wood pulp fibers, for example plant fibers, synthetic staple fibers, and mixtures thereof. In still another example, in addition to pulp fibers, the fibrous structure may comprise a plurality of filaments, such as polymeric filaments, for example thermoplastic filaments such as polyolefin filaments (i.e., polypropylene filaments) and/or hydroxyl polymer filaments, for example polyvinyl alcohol filaments and/or polysaccharide filaments such as starch filaments. In one example, a fibrous structure according to the present invention means an orderly arrangement of fibers alone and with filaments within a structure in order to perform a function. Non-limiting examples of fibrous structures of the present invention include paper.

Non-limiting examples of processes for making fibrous structures include known wet-laid papermaking processes, for example conventional wet-pressed papermaking processes and through-air-dried papermaking processes, and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire, fabric, or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, often referred to as a parent roll, and may subsequently be converted into a finished product, e.g. a single- or multi-ply sanitary tissue product.

The fibrous structures of the present invention may be homogeneous or may be layered. If layered, the fibrous structures may comprise at least two and/or at least three and/or at least four and/or at least five layers of fiber and/or filament compositions.

In one example, the fibrous structure of the present invention consists essentially of fibers, for example pulp fibers, such as cellulosic pulp fibers and more particularly wood pulp fibers.

In another example, the fibrous structure of the present invention comprises fibers and is void of filaments.

In still another example, the fibrous structures of the present invention comprises filaments and fibers, such as a co-formed fibrous structure.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include pulp fibers, such as wood pulp fibers, and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified fibrous structure. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: *eucalyptus* fibers, acacia fibers, and mixtures thereof. The northern hardwood pulp fibers may be selected from the group consisting of: cedar fibers, maple fibers, and mixtures thereof.

In addition to the various wood pulp fibers, other cellulosic fibers such as cotton linters, rayon, lyocell, trichomes, seed hairs, and bagasse can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Basis Weight" as used herein is the weight per unit area of a sample reported in lbs/3000 $ft^2$ or $g/m^2$ (gsm) and is measured according to the Basis Weight Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Embossed" as used herein with respect to a fibrous structure and/or sanitary tissue product means that a fibrous structure and/or sanitary tissue product has been subjected to a process which converts a smooth surfaced fibrous structure and/or sanitary tissue product to a decorative surface by replicating a design on one or more emboss rolls, which form a nip through which the fibrous structure and/or sanitary tissue product passes. Embossed does not include creping, microcreping, printing or other processes that may also impart a texture and/or decorative pattern to a fibrous structure and/or sanitary tissue product.

"Differential density", as used herein, means a fibrous structure and/or sanitary tissue product that comprises one or more regions of relatively low fiber density, which are referred to as pillow regions, and one or more regions of relatively high fiber density, which are referred to as knuckle regions.

"Densified", as used herein means a portion of a fibrous structure and/or sanitary tissue product that is characterized by regions of relatively high fiber density (knuckle regions).

"Non-densified", as used herein, means a portion of a fibrous structure and/or sanitary tissue product that exhibits a lesser density (one or more regions of relatively lower fiber density) (pillow regions) than another portion (for example a knuckle region) of the fibrous structure and/or sanitary tissue product.

"Non-rolled" as used herein with respect to a fibrous structure and/or sanitary tissue product of the present invention means that the fibrous structure and/or sanitary tissue product is an individual sheet (for example not connected to adjacent sheets by perforation lines. However, two or more individual sheets may be interleaved with one another) that is not convolutedly wound about a core or itself. For example, a non-rolled product comprises a facial tissue.

"Stack Compressibility and Resilient Bulk Test Method" as used herein means the Stack Compressibility and Resilient Bulk Test Method described herein.

"Slip Stick Coefficient of Friction Test Method" as used herein means the Slip Stick Coefficient of Friction Test Method described herein.

"Plate Stiffness Test Method" as used herein means the Plate Stiffness Test Method described herein.

"Creped" as used herein means creped off of a Yankee dryer or other similar roll and/or fabric creped and/or belt creped. Rush transfer of a fibrous structure alone does not result in a "creped" fibrous structure or "creped" sanitary tissue product for purposes of the present invention.

Sanitary Tissue Product

The sanitary tissue products of the present invention may be single-ply or multi-ply sanitary tissue products. In other words, the sanitary tissue products of the present invention may comprise one or more fibrous structures. The fibrous structures and/or sanitary tissue products of the present invention are made from a plurality of pulp fibers, for example wood pulp fibers and/or other cellulosic pulp fibers, for example trichomes. In addition to the pulp fibers, the fibrous structures and/or sanitary tissue products of the present invention may comprise synthetic fibers and/or filaments.

As shown in FIGS. 3A through 5B and Table 1 below, which contains data values represented in FIGS. 3A through 5B, the sanitary tissue products of the present invention exhibit GM, CD, and/or MD Tear values as measured according to the Tear Test Method described herein alone or in combination with GM, CD, and/or MD Tensile values as measured according to the Dry Tensile Test Method described herein that are novel over known sanitary tissue products.

TABLE 1

| Sanitary Tissue Product | # of plies | Knuckle (Discrete, Cont., Semi-Cont.) | Angle of Knuckles (relative to CD) | FSO vs WSO converting |
|---|---|---|---|---|
| Charmin Ultra Strong | 2 | Semi-C | 85 | WSO |
| Bounty (pre February 2016) - Permanent wet strength/non-dispersible | 2 | D | N/A | FSO |
| Bounty (Post February 2016) Permanent wet strength/non-dispersible | 2 | D | N/A | FSO |
| Bounty Basic Permanent wet strength/non-dispersible | 1 | D | N/A | FSO |
| Viva Paper Towels (CWP, double recreped with Latex) Permanent wet strength/Non-dispersible | 1 | — | — | — |

TABLE 1-continued

| | | | | |
|---|---|---|---|---|
| Quilted Northern Ultra Plush | 3 | — | — | — |
| Kirkland Signature | 2 | — | — | — |
| White Cloud Ultra Strong and Soft | 2 | — | — | — |
| Kroger Ultra Strong | 2 | — | — | — |
| Kroger Ultra Soft | 2 | — | — | — |
| Quilted Northern Ultra Soft and Strong (Fabric Crepe one side, conventional on the other side) | 2 | — | — | — |
| Cottonelle Ultra Comfort Care Uncreped | 2 | — | — | — |
| Viva Vantage Permanent wet strength/Non-dispersible | 1 | — | — | — |
| Kirkland Paper Towels Permanent wet strength/Non-dispersible | 2 | — | — | — |
| Scott - USD 585,651 Permanent wet strength/Non-dispersible, Uncreped | 1 | — | — | — |
| Scott Permanent wet strength/Non-dispersible, Uncreped | 1 | — | — | — |
| Great Value Circle Emboss Permanent wet strength/Non-dispersible | 2 | — | — | — |
| Brawny 2012 Permanent wet strength/Non-dispersible | 2 | — | — | — |
| Prior Art | 2 | Semi-C | 85 | WSO |
| Prior Art | 2 | Cont | variable (average = 45) | FSO |
| Prior Art | 2 | Cont | N/A | WSO |
| Prior Art | 2 | Semi-C | 85.0 | WSO |
| Prior Art | 2 | Cont | N/A | WSO |
| Prior Art | 2 | Cont | N/A | FSO |
| Prior Art | 2 | Cont | N/A | FSO |
| Prior Art | 2 | Semi-C | 85.0 | WSO |
| Prior Art | 2 | Semi-C | 85.0 | WSO |
| Prior Art | 2 | Cont | N/A | FSO |
| Prior Art | 2 | Semi-C | 85.0 | WSO |
| Prior Art | 2 | Semi-C | 85 | WSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |

TABLE 1-continued

| | | | | |
|---|---|---|---|---|
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |

TABLE 1-continued

| | | | | |
|---|---|---|---|---|
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |

TABLE 1-continued

| | | | | |
|---|---|---|---|---|
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |

TABLE 1-continued

| | | | | |
|---|---|---|---|---|
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Prior Art[1] | 2 | D | Variable due to curved knuckles (average = 45) | FSO |
| Inventive | 2 | D | 75 | FSO |
| Inventive-Example 3 | 2 | D | 60 | FSO |
| Inventive | 2 | D | 60 | FSO |
| Inventive | 2 | D | 75 | FSO |
| Inventive | 2 | D | 75 | FSO |
| Inventive | 2 | D | 75 | FSO |
| Inventive | 2 | D | 75 | FSO |
| Inventive | 2 | D | 75 | FSO |
| Inventive | 2 | D | 75 | FSO |
| Inventive | 2 | Semi-C | 75 | FSO |
| Inventive | 2 | Semi-C | 75 | FSO |
| Inventive | 2 | Semi-C | 75 | FSO |
| Inventive | 2 | Semi-C | 85 | FSO |
| Inventive | 2 | D | 75 | FSO |
| Inventive-Example 1 | 2 | D | 75 | FSO |
| Inventive | 2 | D | 75 | FSO |
| Inventive | 2 | D | 75 | FSO |
| Inventive | 2 | Semi-C | 85 | FSO |
| Inventive | 2 | Semi-C | 85 | FSO |
| Inventive | 2 | Semi-C | 85 | FSO |
| Inventive | 2 | Semi-C | 85 | FSO |
| Inventive | 2 | Semi-C | 85 | FSO |
| Inventive | 2 | Semi-C | 85 | FSO |
| Inventive | 2 | Semi-C | 85 | FSO |
| Inventive-Example 2 | 2 | Semi-C | 85 | FSO |
| Inventive | 2 | Semi-C | 85 | FSO |
| Inventive | 2 | Semi-C | 85 | FSO |
| Inventive | 2 | Semi-C | 85 | FSO |
| Inventive | 2 | D | 75 | WSO |
| Comparative Example 4 | 2 | D | 45 | FSO |
| Comparative Example 1 | 2 | Semi-C | 85 | WSO |
| Comparative | 2 | Semi-C | 85 | WSO |
| Comparative Example 2 | 2 | Cont | variable (average = 45) | FSO |

TABLE 1-continued

| List from Table 1 - Additional Properties | | | | | | |
|---|---|---|---|---|---|---|
| Sanitary Tissue Product | GM Tear (g) | GM Tensile (g/in) | CD Tear (g) | CD Tensile (g/in) | MD Tear (g) | MD Tensile (g/in) |
| Charmin Ultra Strong | 19.5 | 346 | 20.0 | 249 | 19.0 | 480 |
| Bounty (pre February 2016) | 57.0 | 1045 | 60.2 | 905 | 53.9 | 1208 |
| Bounty (Post February 2016) | 61.5 | 1118 | 66.3 | 910 | 57.0 | 1374 |
| Bounty Basic | 43.3 | 960 | 43.9 | 757 | 42.6 | 1218 |
| Viva Paper Towels (CWP, double recreped with Latex) | 67.5 | 421 | 69.1 | 354 | 65.8 | 500 |
| Quilted Northern Ultra Plush | 13.4 | 235 | 11.6 | 141 | 15.5 | 392 |
| Kirkland Signature | 8.4 | 280 | 7.6 | 171 | 9.3 | 459 |
| White Cloud Ultra Strong and Soft | 21.3 | 477 | 20.6 | 367 | 22.0 | 620 |
| Kroger Ultra Strong | 19.2 | 373 | 20.6 | 272 | 17.9 | 511 |
| Kroger Ultra Soft | 18.3 | 366 | 20.0 | 263 | 16.8 | 510 |
| Quilted Northern Ultra Soft and Strong (Fabric Crepe one side, conventional on the other side) | 15.1 | 201 | 15.0 | 151 | 15.3 | 268 |
| Cottonelle Ultra Comfort Care | 25.0 | 381 | 26.5 | 258 | 23.6 | 565 |
| Viva Vantage | 57.8 | 1014 | 55.4 | 1064 | 60.4 | 967 |
| Kirkland Paper Towels | 53.6 | 1052 | 54.7 | 1023 | 52.6 | 1082 |
| Scott - USD 585,651 Permanent wet strength/ Non-dispersible, Uncreped | 38.0 | 652 | 40.3 | 633 | 35.7 | 671 |
| Scott Permanent wet strength/ Non-dispersible, Uncreped | 28.6 | 562 | 29.2 | 538 | 28.0 | 587 |
| Great Value Circle Emboss | 52.5 | 776 | 56.3 | 657 | 49.0 | 918 |
| Brawny 2012 | 50.7 | 710 | 52.0 | 716 | 49.5 | 704 |
| Prior Art | 20.8 | 253 | 20.2 | 191 | 21.3 | 335 |
| Prior Art | 18.5 | 224 | 18.9 | 185 | 18.2 | 270 |
| Prior Art | 12.5 | 223 | 12.0 | 153 | 13.1 | 325 |
| Prior Art | 17.0 | 257 | 18.1 | 187 | 15.9 | 354 |
| Prior Art | 14.3 | 224 | 15.2 | 147 | 13.6 | 342 |
| Prior Art | 15.8 | 281 | 13.4 | 202 | 18.7 | 392 |
| Prior Art | 16.6 | 269 | 15.3 | 197 | 18.1 | 366 |
| Prior Art | 21.1 | 347 | 19.4 | 312 | 22.9 | 385 |
| Prior Art | 18.3 | 257 | 17.2 | 184 | 19.4 | 358 |
| Prior Art | 15.3 | 246 | 16.6 | 177 | 14.2 | 342 |
| Prior Art | 17.0 | 294 | 18.4 | 278 | 15.7 | 311 |
| Prior Art | 19.0 | 261 | 18.2 | 195 | 19.9 | 351 |
| Prior Art[1] | 16.6 | 271 | 14.0 | 191 | 19.7 | 386 |
| Prior Art[1] | 18.7 | 232 | 19.0 | 172 | 18.3 | 312 |
| Prior Art[1] | 18.5 | 238 | 18.9 | 177 | 18.1 | 321 |
| Prior Art[1] | 18.5 | 273 | 16.8 | 200 | 20.5 | 373 |
| Prior Art[1] | 17.1 | 265 | 16.2 | 187 | 18.0 | 376 |
| Prior Art[1] | 13.5 | 241 | 12.5 | 171 | 14.5 | 340 |
| Prior Art[1] | 16.6 | 310 | 14.3 | 212 | 19.3 | 454 |
| Prior Art[1] | 15.8 | 306 | 14.0 | 199 | 17.9 | 469 |
| Prior Art[1] | 13.0 | 271 | 11.1 | 192 | 15.4 | 384 |
| Prior Art[1] | 17.4 | 328 | 15.8 | 233 | 19.1 | 461 |
| Prior Art[1] | 12.3 | 253 | 10.5 | 172 | 14.5 | 374 |
| Prior Art[1] | 16.1 | 286 | 15.1 | 206 | 17.3 | 399 |
| Prior Art[1] | 16.9 | 319 | 14.8 | 219 | 19.2 | 466 |
| Prior Art[1] | 16.3 | 263 | 14.5 | 180 | 18.3 | 384 |
| Prior Art[1] | 18.4 | 289 | 16.5 | 196 | 20.5 | 425 |
| Prior Art[1] | 16.6 | 278 | 13.3 | 186 | 20.8 | 417 |
| Prior Art[1] | 16.2 | 269 | 13.2 | 184 | 19.8 | 393 |
| Prior Art[1] | 20.5 | 273 | 19.6 | 204 | 21.5 | 366 |
| Prior Art[1] | 18.5 | 286 | 15.5 | 190 | 22.1 | 431 |
| Prior Art[1] | 17.5 | 269 | 15.0 | 194 | 20.4 | 373 |
| Prior Art[1] | 15.9 | 254 | 13.4 | 185 | 18.9 | 349 |
| Prior Art[1] | 14.4 | 243 | 12.6 | 163 | 16.4 | 361 |
| Prior Art[1] | 15.3 | 242 | 13.2 | 166 | 17.7 | 352 |
| Prior Art[1] | 17.1 | 276 | 14.0 | 184 | 20.8 | 414 |
| Prior Art[1] | 16.6 | 287 | 15.1 | 195 | 18.3 | 423 |
| Prior Art[1] | 17.8 | 287 | 15.0 | 196 | 21.2 | 419 |
| Prior Art[1] | 16.9 | 274 | 15.2 | 190 | 18.8 | 395 |
| Prior Art[1] | 16.9 | 259 | 15.7 | 190 | 18.2 | 354 |
| Prior Art[1] | 15.7 | 227 | 14.1 | 159 | 17.4 | 325 |
| Prior Art[1] | 16.7 | 228 | 15.7 | 165 | 17.9 | 316 |
| Prior Art[1] | 16.9 | 260 | 16.2 | 192 | 17.7 | 352 |
| Prior Art[1] | 18.9 | 311 | 15.4 | 228 | 23.3 | 425 |
| Prior Art[1] | 19.6 | 307 | 17.6 | 218 | 21.8 | 432 |
| Prior Art[1] | 15.1 | 284 | 10.9 | 203 | 20.9 | 398 |
| Prior Art[1] | 18.0 | 296 | 16.0 | 199 | 20.3 | 441 |
| Prior Art[1] | 14.9 | 267 | 12.9 | 181 | 17.3 | 392 |
| Prior Art[1] | 15.4 | 239 | 13.8 | 157 | 17.2 | 363 |

TABLE 1-continued

| | | | | | | |
|---|---|---|---|---|---|---|
| Prior Art[1] | 21.0 | 332 | 18.6 | 232 | 23.7 | 475 |
| Prior Art[1] | 16.9 | 318 | 14.1 | 220 | 20.2 | 460 |
| Prior Art[1] | 0.0 | | | | | |
| Prior Art[1] | 17.0 | 324 | 14.7 | 220 | 19.6 | 477 |
| Prior Art[1] | 17.0 | 320 | 15.3 | 221 | 18.9 | 463 |
| Prior Art[1] | 19.4 | 344 | 16.6 | 239 | 22.6 | 496 |
| Prior Art[1] | 16.3 | 287 | 13.7 | 200 | 19.5 | 411 |
| Prior Art[1] | 17.2 | 304 | 15.6 | 216 | 18.9 | 427 |
| Prior Art[1] | 16.6 | 313 | 14.3 | 212 | 19.2 | 460 |
| Prior Art[1] | 19.4 | 334 | 17.9 | 232 | 21.0 | 480 |
| Prior Art[1] | 18.2 | 308 | 17.7 | 201 | 18.8 | 472 |
| Prior Art[1] | 21.6 | 359 | 17.3 | 241 | 26.8 | 534 |
| Prior Art[1] | 20.9 | 345 | 17.6 | 238 | 24.8 | 500 |
| Prior Art[1] | 16.3 | 237 | 15.0 | 171 | 17.7 | 329 |
| Prior Art[1] | 18.3 | 261 | 15.9 | 183 | 21.0 | 373 |
| Prior Art[1] | 19.7 | 293 | 16.3 | 209 | 24.0 | 410 |
| Prior Art[1] | 21.5 | 307 | 20.3 | 210 | 22.9 | 448 |
| Prior Art[1] | 17.7 | 303 | 16.7 | 226 | 18.6 | 408 |
| Prior Art[1] | 13.2 | 254 | 11.5 | 174 | 15.2 | 370 |
| Prior Art[1] | 13.8 | 291 | 11.5 | 205 | 16.6 | 411 |
| Prior Art[1] | 12.5 | 260 | 11.2 | 180 | 13.9 | 375 |
| Prior Art[1] | 13.2 | 262 | 12.1 | 182 | 14.4 | 376 |
| Prior Art[1] | 15.8 | 304 | 14.0 | 224 | 17.9 | 413 |
| Prior Art[1] | 18.0 | 345 | 16.4 | 251 | 19.7 | 473 |
| Prior Art[1] | 16.3 | 321 | 14.8 | 295 | 18.0 | 350 |
| Prior Art[1] | 19.0 | 324 | 18.0 | 250 | 20.0 | 420 |
| Prior Art[1] | 21.0 | 414 | 19.8 | 300 | 22.2 | 572 |
| Prior Art[1] | 20.5 | 431 | 18.5 | 319 | 22.7 | 582 |
| Prior Art[1] | 20.7 | 417 | 17.4 | 301 | 24.6 | 578 |
| Prior Art[1] | 20.7 | 407 | 18.2 | 306 | 23.6 | 543 |
| Prior Art[1] | 18.0 | 332 | 16.4 | 249 | 19.7 | 441 |
| Prior Art[1] | 17.1 | 335 | 15.7 | 244 | 18.6 | 458 |
| Prior Art[1] | 19.1 | 325 | 19.1 | 245 | 19.2 | 431 |
| Prior Art[1] | 19.6 | 337 | 20.1 | 253 | 19.2 | 449 |
| Prior Art[1] | 23.2 | 489 | 22.1 | 360 | 24.2 | 664 |
| Prior Art[1] | 23.7 | 516 | 22.4 | 371 | 25.0 | 718 |
| Prior Art[1] | 23.0 | 503 | 21.1 | 357 | 25.1 | 709 |
| Prior Art[1] | 24.3 | 533 | 22.8 | 391 | 26.0 | 726 |
| Prior Art[1] | 16.6 | 266 | 14.9 | 189 | 18.5 | 375 |
| Prior Art[1] | 18.5 | 238 | 18.9 | 177 | 18.1 | 321 |
| Prior Art[1] | 16.4 | 259 | 15.4 | 183 | 17.4 | 366 |
| Prior Art[1] | 17.9 | 242 | 17.3 | 176 | 18.5 | 332 |
| Prior Art[1] | 17.0 | 238 | 15.4 | 172 | 18.8 | 329 |
| Prior Art[1] | 18.6 | 239 | 18.0 | 176 | 19.3 | 326 |
| Prior Art[1] | 18.7 | 232 | 19.0 | 172 | 18.3 | 312 |
| Prior Art[1] | 18.5 | 249 | 17.7 | 182 | 19.3 | 341 |
| Prior Art[1] | 18.5 | 260 | 18.1 | 186 | 18.9 | 364 |
| Prior Art[1] | 16.6 | 230 | 15.3 | 162 | 18.0 | 326 |
| Prior Art[1] | 17.1 | 272 | 16.0 | 194 | 18.3 | 382 |
| Prior Art[1] | 16.3 | 245 | 16.1 | 165 | 16.5 | 364 |
| Prior Art[1] | 18.1 | 256 | 17.4 | 183 | 18.9 | 358 |
| Prior Art[1] | 15.7 | 251 | 13.3 | 167 | 18.6 | 378 |
| Prior Art[1] | 15.9 | 290 | 13.5 | 201 | 18.8 | 419 |
| Prior Art[1] | 19.1 | 312 | 15.7 | 217 | 23.2 | 447 |
| Prior Art[1] | 18.3 | 274 | 16.9 | 194 | 19.9 | 385 |
| Prior Art[1] | 16.8 | 287 | 14.7 | 203 | 19.2 | 407 |
| Prior Art[1] | 14.4 | 241 | 12.8 | 167 | 16.3 | 348 |
| Prior Art[1] | 17.0 | 265 | 14.8 | 182 | 19.5 | 387 |
| Prior Art[1] | 17.0 | 274 | 15.8 | 194 | 18.2 | 387 |
| Prior Art[1] | 18.0 | 259 | 18.6 | 185 | 17.5 | 364 |
| Prior Art[1] | 22.2 | 344 | 21.1 | 238 | 23.3 | 497 |
| Prior Art[1] | 19.1 | 330 | 17.2 | 227 | 21.2 | 479 |
| Prior Art[1] | 19.8 | 314 | 17.5 | 215 | 22.3 | 460 |
| Prior Art[1] | 16.6 | 291 | 14.3 | 204 | 19.2 | 417 |
| Prior Art[1] | 19.3 | 309 | 18.0 | 214 | 20.7 | 445 |
| Prior Art[1] | 18.8 | 337 | 16.4 | 230 | 21.5 | 494 |
| Prior Art[1] | 19.6 | 318 | 15.8 | 219 | 24.3 | 462 |
| Prior Art[1] | 18.9 | 304 | 17.5 | 219 | 20.5 | 421 |
| Prior Art[1] | 15.8 | 274 | 15.0 | 192 | 16.7 | 390 |
| Prior Art[1] | 15.2 | 246 | 14.3 | 172 | 16.1 | 352 |
| Prior Art[1] | 18.8 | 294 | 17.5 | 211 | 20.2 | 410 |
| Inventive | 24.3 | 284 | 25.2 | 245 | 23.5 | 330 |
| Inventive-Example 3 | 25.4 | 298 | 26.2 | 261 | 24.5 | 341 |
| Inventive | 23.1 | 279 | 24.0 | 251 | 22.3 | 310 |
| Inventive | 23.1 | 291 | 24.0 | 246 | 22.3 | 344 |
| Inventive | 24.1 | 302 | 26.0 | 255 | 22.4 | 358 |
| Inventive | 24.3 | 309 | 24.2 | 236 | 24.3 | 405 |
| Inventive | 23.1 | 286 | 23.6 | 207 | 22.5 | 395 |
| Inventive | 22.8 | 269 | 23.4 | 229 | 22.3 | 317 |
| Inventive | 23.4 | 254 | 25.8 | 209 | 21.3 | 309 |

TABLE 1-continued

| | | | | | | |
|---|---|---|---|---|---|---|
| Inventive | 22.3 | 278 | 24.2 | 225 | 20.6 | 345 |
| Inventive | 25.0 | 284 | 28.6 | 208 | 21.9 | 389 |
| Inventive | 23.0 | 285 | 24.1 | 261 | 21.9 | 310 |
| Inventive | 22.6 | 281 | 24.1 | 236 | 21.2 | 335 |
| Inventive | 21.4 | 249 | 22.9 | 201 | 20.0 | 309 |
| Inventive-Example 1 | 22.9 | 259 | 24.8 | 212 | 21.1 | 316 |
| Inventive | 24.3 | 280 | 27.1 | 232 | 21.8 | 338 |
| Inventive | 21.1 | 250 | 21.1 | 204 | 21.1 | 305 |
| Inventive | 23.8 | 255 | 24.8 | 222 | 22.9 | 293 |
| Inventive | 24.3 | 265 | 23.3 | 238 | 25.3 | 295 |
| Inventive | 23.9 | 259 | 24.1 | 230 | 23.6 | 291 |
| Inventive | 22.2 | 255 | 20.4 | 220 | 24.1 | 295 |
| Inventive | 23.7 | 258 | 22.6 | 218 | 24.9 | 307 |
| Inventive | 23.2 | 270 | 22.7 | 227 | 23.8 | 322 |
| Inventive | 23.1 | 279 | 20.6 | 202 | 25.9 | 385 |
| Inventive-Example 2 | 24.7 | 266 | 25.6 | 225 | 23.9 | 315 |
| Inventive | 20.7 | 221 | 20.8 | 169 | 20.6 | 288 |
| Inventive | 22.7 | 253 | 22.4 | 220 | 22.9 | 291 |
| Inventive | 23.2 | 249 | 25.2 | 221 | 21.4 | 280 |
| Inventive | 19.9 | 241 | 19.5 | 206 | 20.4 | 281 |
| Comparative Example 4 | 20.6 | 281 | 19.4 | 202 | 21.9 | 392 |
| Comparative Example 1 | 20.8 | 253 | 20.2 | 191 | 21.3 | 335 |
| Comparative | 19.0 | 261 | 18.2 | 195 | 19.9 | 351 |
| Comparative Example 2 | 18.5 | 224 | 18.9 | 185 | 18.2 | 270 |

| Sanitary Tissue Product | Slipstick COF * 10 k | Plate Stiffness (N * mm) | Compressibility 10-1250 (-m) 5 sht | Resilient Bulk (cc/g) |
|---|---|---|---|---|
| Charmin Ultra Strong | — | — | — | — |
| Bounty (pre February 2016) | — | — | — | — |
| Bounty (Post February 2016) | — | — | — | — |
| Bounty Basic | — | — | — | — |
| Viva Paper Towels (CWP, double recreped with Latex) | — | — | — | — |
| Quilted Northern Ultra Plush | — | — | — | — |
| Kirkland Signature | — | — | — | — |
| White Cloud Ultra Strong and Soft | — | — | — | — |
| Kroger Ultra Strong | — | — | — | — |
| Kroger Ultra Soft | — | — | — | — |
| Quilted Northern Ultra Soft and Strong (Fabric Crepe one side, conventional on the other side) | — | — | — | — |
| Cottonelle Ultra Comfort Care | — | — | — | — |
| Viva Vantage | — | — | — | — |
| Kirkland Paper Towels | — | — | — | — |
| Scott - USD 585,651 Permanent wet strength/Non-dispersible, Uncreped | — | — | — | — |
| Scott Permanent wet strength/Non-dispersible, Uncreped | — | — | — | — |
| Great Value Circle Emboss | — | — | — | — |
| Brawny 2012 | — | — | — | — |
| Prior Art | 317 | 4.1 | 38.2 | 67.8 |
| Prior Art | 510 | 2.2 | 42.7 | 67.1 |
| Prior Art | 282 | 4.9 | 37.1 | 71.2 |
| Prior Art | 341 | 4.8 | 28.7 | 69.2 |
| Prior Art | 276 | 3.5 | 26.4 | 63.4 |
| Prior Art | 507 | 2.6 | 38.9 | 67.7 |
| Prior Art | 556 | 3.0 | 39.2 | 66.7 |
| Prior Art | 359 | 3.5 | 35.7 | 69.7 |
| Prior Art | 426 | 4.3 | 32.6 | 69.8 |
| Prior Art | 542 | 2.5 | 39.7 | 66.6 |
| Prior Art | 388 | 4.1 | 32.5 | 67.5 |
| Prior Art | 278 | 3.1 | 22.4 | 53.2 |
| Prior Art[1] | 386 | 2.0 | 36.5 | 57.6 |
| Prior Art[1] | 415 | 2.4 | 40.8 | 66.3 |
| Prior Art[1] | 455 | 2.4 | 41.7 | 68.4 |
| Prior Art[1] | 400 | 2.5 | 38.4 | 62.4 |
| Prior Art[1] | 400 | 2.3 | 31.9 | 61.6 |
| Prior Art[1] | 397 | 2.1 | 37.8 | 59.5 |
| Prior Art[1] | 428 | 2.4 | 39.6 | 58.6 |
| Prior Art[1] | 413 | 2.1 | 36.2 | 59.8 |
| Prior Art[1] | 370 | 2.1 | 36.2 | 58.3 |
| Prior Art[1] | 423 | 2.3 | 37.2 | 59.0 |
| Prior Art[1] | 424 | 2.2 | 37.9 | 65.0 |
| Prior Art[1] | 414 | 2.4 | 37.2 | 63.5 |
| Prior Art[1] | 391 | 2.6 | 38.2 | 64.9 |
| Prior Art[1] | 360 | 2.3 | 39.6 | 56.4 |

TABLE 1-continued

| | | | | |
|---|---|---|---|---|
| Prior Art[1] | 371 | 2.5 | 41.1 | 56.1 |
| Prior Art[1] | 341 | 2.6 | 39.1 | 53.9 |
| Prior Art[1] | 367 | 2.1 | 37.9 | 60.7 |
| Prior Art[1] | 382 | 2.4 | 39.4 | 59.1 |
| Prior Art[1] | 391 | 2.4 | 37.6 | 55.7 |
| Prior Art[1] | 357 | 2.7 | 39.3 | 58.0 |
| Prior Art[1] | 316 | 2.2 | 39.3 | 56.6 |
| Prior Art[1] | 365 | 2.4 | 37.0 | 58.8 |
| Prior Art[1] | 346 | 2.2 | 39.1 | 56.4 |
| Prior Art[1] | 387 | 2.5 | 38.9 | 58.7 |
| Prior Art[1] | 320 | 2.6 | 38.2 | 57.2 |
| Prior Art[1] | 356 | 2.6 | 39.0 | 58.2 |
| Prior Art[1] | 369 | 2.7 | 39.0 | 57.5 |
| Prior Art[1] | 335 | 2.2 | 36.6 | 58.8 |
| Prior Art[1] | 317 | 2.6 | 38.7 | 57.0 |
| Prior Art[1] | 308 | 1.6 | 33.2 | 57.2 |
| Prior Art[1] | 341 | 1.8 | 36.4 | 56.9 |
| Prior Art[1] | 385 | 2.0 | 31.1 | 59.1 |
| Prior Art[1] | 337 | 1.9 | 31.4 | 58.4 |
| Prior Art[1] | 379 | 2.1 | 31.5 | 57.7 |
| Prior Art[1] | 367 | 1.9 | 31.3 | 59.2 |
| Prior Art[1] | 336 | 2.0 | 30.6 | 57.2 |
| Prior Art[1] | 330 | 2.2 | 35.1 | 57.4 |
| Prior Art[1] | 400 | 2.0 | 31.2 | 58.6 |
| Prior Art[1] | 368 | 1.9 | 32.0 | 57.7 |
| Prior Art[1] | 398 | 2.5 | 37.6 | 57.2 |
| Prior Art[1] | 406 | 2.0 | 30.6 | 59.3 |
| Prior Art[1] | 378 | 2.0 | 29.0 | 57.6 |
| Prior Art[1] | 405 | 2.2 | 28.2 | 57.4 |
| Prior Art[1] | 355 | 1.9 | 30.5 | 57.6 |
| Prior Art[1] | 391 | 1.9 | 29.5 | 57.3 |
| Prior Art[1] | 348 | 2.1 | 29.2 | 56.1 |
| Prior Art[1] | 399 | 2.0 | 29.7 | 57.7 |
| Prior Art[1] | 378 | 2.1 | 33.9 | 56.7 |
| Prior Art[1] | 446 | 2.1 | 28.4 | 57.7 |
| Prior Art[1] | 410 | 2.0 | 30.0 | 57.5 |
| Prior Art[1] | 381 | 1.8 | 31.3 | 57.8 |
| Prior Art[1] | 385 | 1.8 | 31.4 | 57.2 |
| Prior Art[1] | 425 | 2.0 | 32.3 | 57.9 |
| Prior Art[1] | 377 | 2.7 | 34.2 | 57.2 |
| Prior Art[1] | 401 | 2.5 | 35.1 | 59.9 |
| Prior Art[1] | 392 | 4.0 | 37.2 | 59.0 |
| Prior Art[1] | 439 | 3.2 | 36.8 | 61.4 |
| Prior Art[1] | 414 | 2.1 | 36.0 | 57.8 |
| Prior Art[1] | 415 | 1.9 | 37.1 | 59.0 |
| Prior Art[1] | 436 | 3.9 | 34.4 | 57.4 |
| Prior Art[1] | 444 | 4.0 | 34.1 | 57.1 |
| Prior Art[1] | 447 | 2.5 | 36.0 | 57.2 |
| Prior Art[1] | 506 | 2.4 | 39.1 | 57.4 |
| Prior Art[1] | 487 | 3.9 | 35.6 | 58.3 |
| Prior Art[1] | 476 | 4.5 | 32.8 | 57.9 |
| Prior Art[1] | 514 | 2.6 | 37.5 | 57.9 |
| Prior Art[1] | 556 | 2.6 | 39.1 | 58.9 |
| Prior Art[1] | 430 | 4.0 | 33.5 | 56.3 |
| Prior Art[1] | 427 | 4.1 | 32.3 | 57.2 |
| Prior Art[1] | 483 | 2.5 | 37.9 | 56.9 |
| Prior Art[1] | 487 | 2.4 | 38.7 | 58.6 |
| Prior Art[1] | 462 | 4.2 | 32.3 | 57.5 |
| Prior Art[1] | 478 | 4.5 | 35.4 | 58.2 |
| Prior Art[1] | 511 | 2.7 | 36.5 | 58.1 |
| Prior Art[1] | 594 | 2.8 | 40.5 | 58.7 |
| Prior Art[1] | 419 | 2.6 | 36.9 | 66.1 |
| Prior Art[1] | 455 | 2.4 | 41.7 | 68.4 |
| Prior Art[1] | 406 | 2.7 | 35.1 | 64.4 |
| Prior Art[1] | 421 | 2.3 | 36.7 | 65.3 |
| Prior Art[1] | 425 | 2.4 | 38.4 | 65.5 |
| Prior Art[1] | 438 | 2.4 | 41.2 | 66.5 |
| Prior Art[1] | 415 | 2.4 | 40.8 | 66.3 |
| Prior Art[1] | 428 | 2.5 | 36.8 | 65.1 |
| Prior Art[1] | 392 | 2.6 | 29.2 | 56.1 |
| Prior Art[1] | 401 | 2.1 | 32.3 | 58.4 |
| Prior Art[1] | 407 | 2.7 | 35.6 | 65.7 |
| Prior Art[1] | 390 | 2.6 | 28.8 | 56.0 |
| Prior Art[1] | 427 | 2.3 | 32.9 | 60.3 |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |

TABLE 1-continued

| | | | | |
|---|---|---|---|---|
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | — | — | — | — |
| Prior Art[1] | 438 | 2.6 | 36.3 | 62.3 |
| Inventive | 416 | 2.0 | 34.6 | 57.4 |
| Inventive-Example 3 | 401 | 2.2 | 36.5 | 62.8 |
| Inventive | 399 | 2.3 | 36.2 | 63.9 |
| Inventive | 418 | 2.3 | 37.7 | 60.3 |
| Inventive | 435 | 2.3 | 36.2 | 60.8 |
| Inventive | 459 | 2.2 | 35.4 | 61.1 |
| Inventive | 448 | 2.5 | 40.3 | 62.3 |
| Inventive | 398 | 2.5 | 40.5 | 59.8 |
| Inventive | 429 | 2.1 | 38.2 | 60.4 |
| Inventive | 481 | 2.2 | 36.6 | 61.7 |
| Inventive | 446 | 2.1 | 35.6 | 62.8 |
| Inventive | 421 | 2.2 | 38.0 | 63.5 |
| Inventive | 452 | 1.9 | 32.3 | 56.7 |
| Inventive | 387 | 2.7 | 41.0 | 66.2 |
| Inventive-Example 1 | 416 | 2.6 | 40.6 | 66.5 |
| Inventive | 457 | 2.6 | 42.2 | 67.8 |
| Inventive | 370 | 2.5 | 36.3 | 68.6 |
| Inventive | 380 | 2.2 | 35.8 | 56.1 |
| Inventive | 407 | 2.9 | 38.2 | 65.8 |
| Inventive | 383 | 2.5 | 39.1 | 67.2 |
| Inventive | 362 | 2.8 | 41.2 | 64.5 |
| Inventive | 405 | 2.8 | 41.1 | 64.6 |
| Inventive | 451 | 2.6 | 45.0 | 70.4 |
| Inventive | 377 | 2.7 | 43.5 | 66.6 |
| Inventive-Example 2 | 381 | 2.6 | 40.4 | 67.7 |
| Inventive | 421 | 2.5 | 44.3 | 76.5 |
| Inventive | 383 | 1.9 | 29.3 | 57.3 |
| Inventive | 356 | 2.3 | 31.4 | 55.4 |
| Inventive | 325 | 4.8 | 35.7 | 64.2 |
| Comparative Example 4 | 409 | 2.4 | 40.6 | 61.4 |
| Comparative Example 1 | 317 | 4.1 | 38.2 | 67.8 |
| Comparative | 278 | 3.1 | 22.4 | 53.2 |
| Comparative Example 2 | 510 | 2.2 | 42.7 | 67.1 |

Figure 1B:
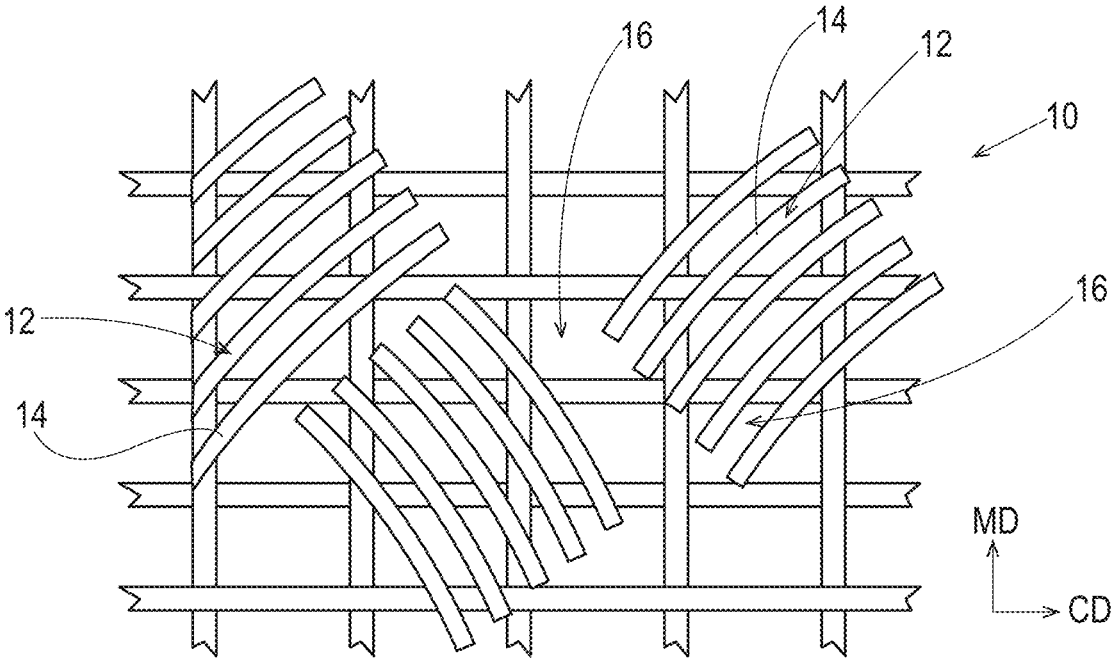
Fig. 1B PRIOR ART
FIG. 1B is a further schematic representation of a portion of the prior art molding member of FIG. 1A.
Figure 2:
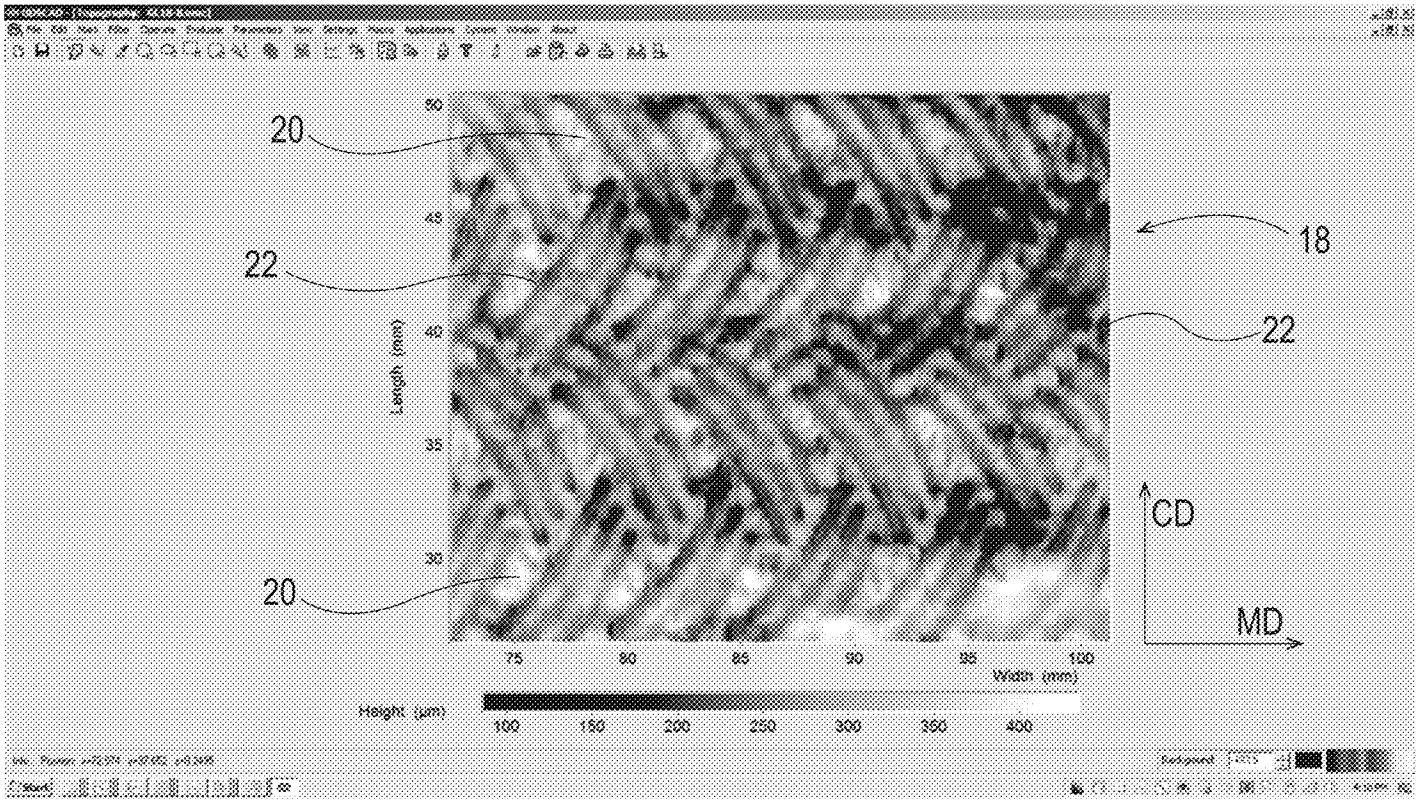
FIG. 2 is a MikroCAD image of a sanitary tissue product made using the prior art molding member of FIG. 1A.
Figure 3A:
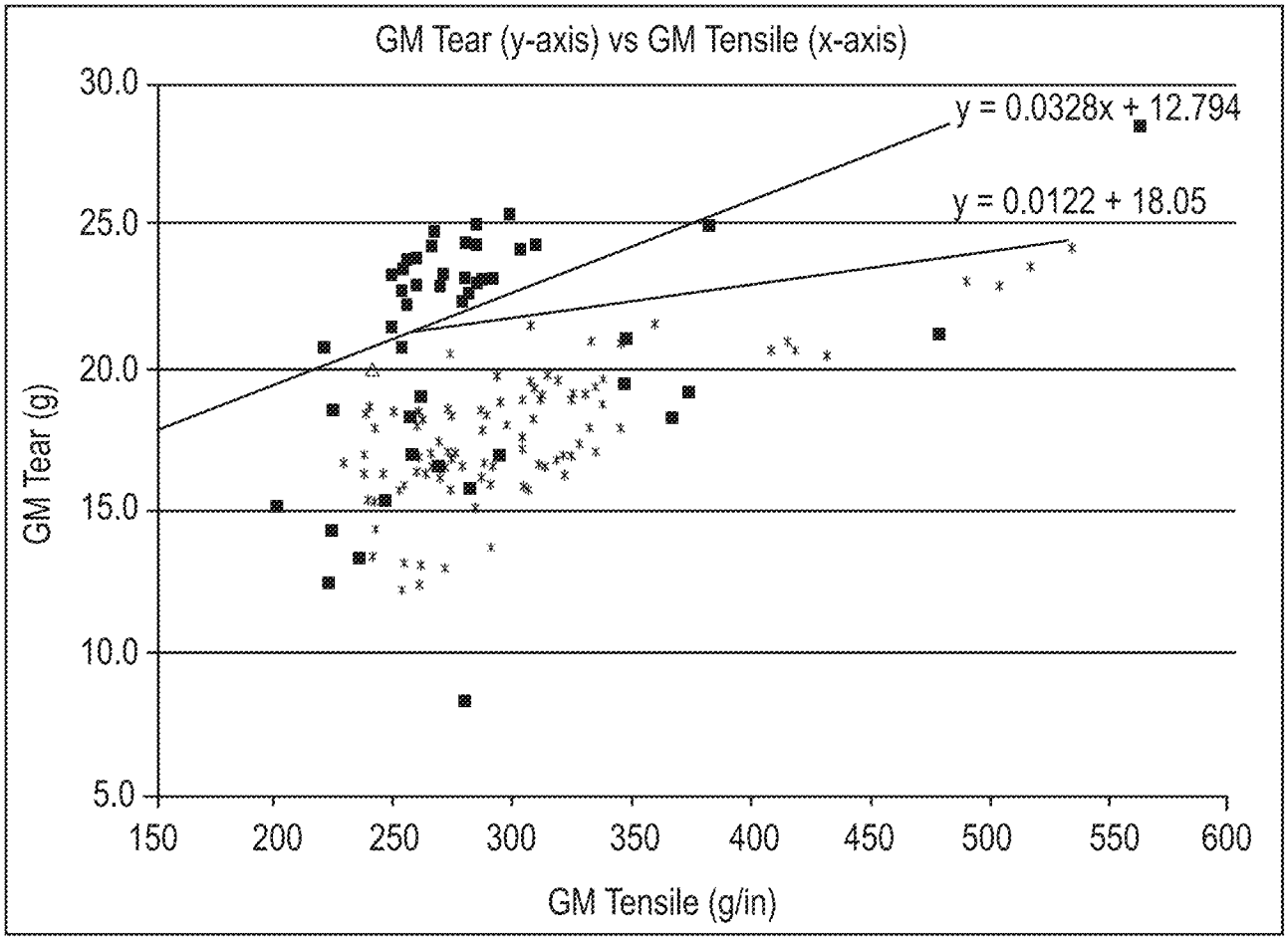
FIG. 3A is a plot of GM Tear (y-axis) (up to 30.0 g) to GM Tensile (x-axis) (up to 600 g/in) for sanitary tissue products of the present invention and commercially available sanitary tissue products, both single-ply and multi-ply sanitary tissue products, illustrating the high level of GM Tear and the low level of GM Tensile exhibited by the sanitary tissue products, for example bath tissue products, of the present invention.
Figure 3B:
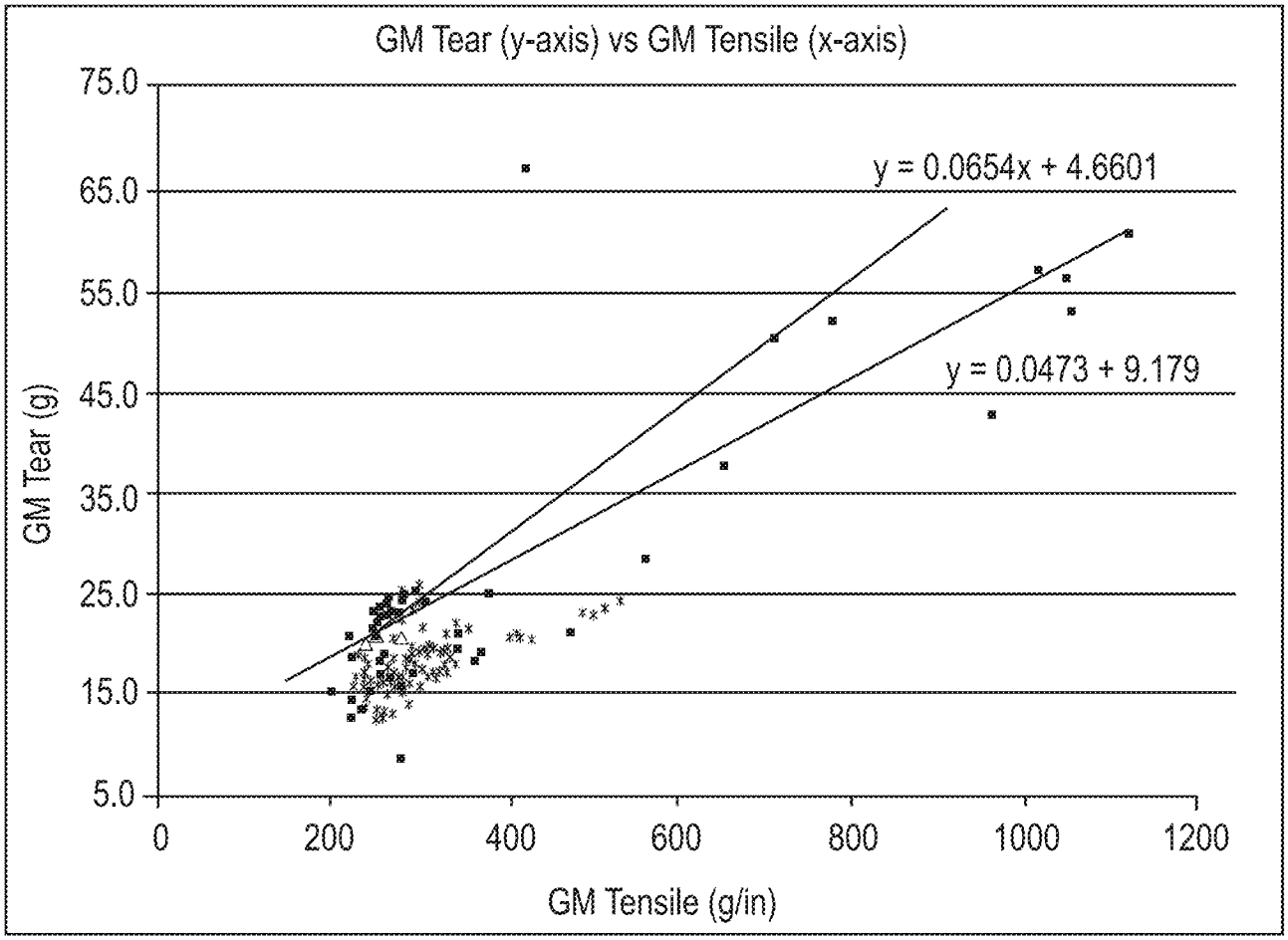
FIG. 3B is a plot of GM Tear (y-axis) (up to 75.0 g) to GM Tensile (x-axis) (up to 1200 g/in) for sanitary tissue products of the present invention and commercially available sanitary tissue products, both single-ply and multi-ply sanitary tissue products, illustrating the high level of GM Tear and the low level of GM Tensile exhibited by the sanitary tissue products, for example bath tissue products, of the present invention.
Figure 4A:
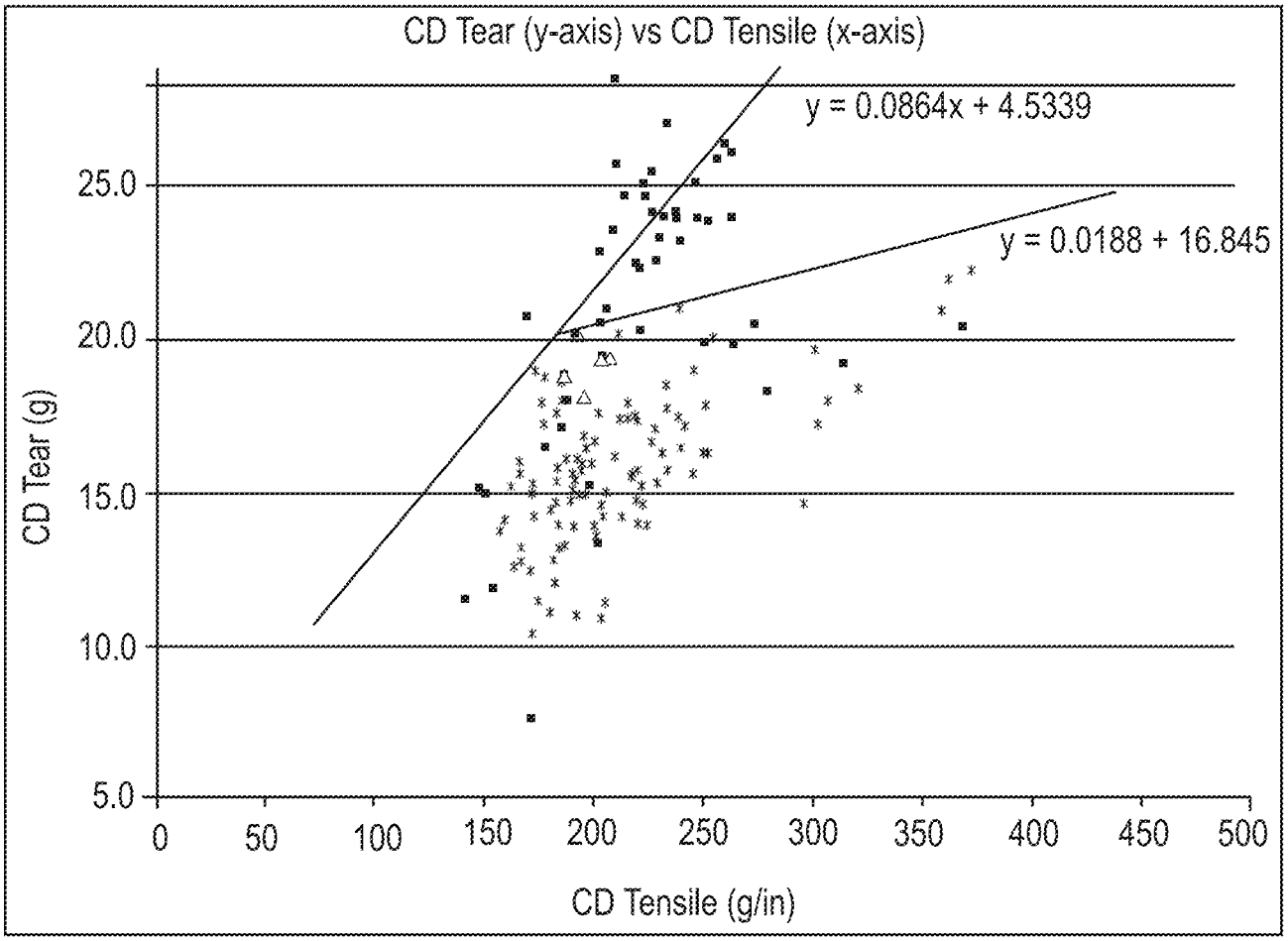
FIG. 4A is a plot of CD Tear (y-axis) (up to about 30.0 g) to CD Tensile (x-axis) (up to 500 g/in) for sanitary tissue products of the present invention and commercially available sanitary tissue products, both single-ply and multi-ply sanitary tissue products, illustrating the high level of CD Tear and the low level of CD Tensile exhibited by the sanitary tissue products, for example bath tissue products, of the present invention.
Figure 4B:
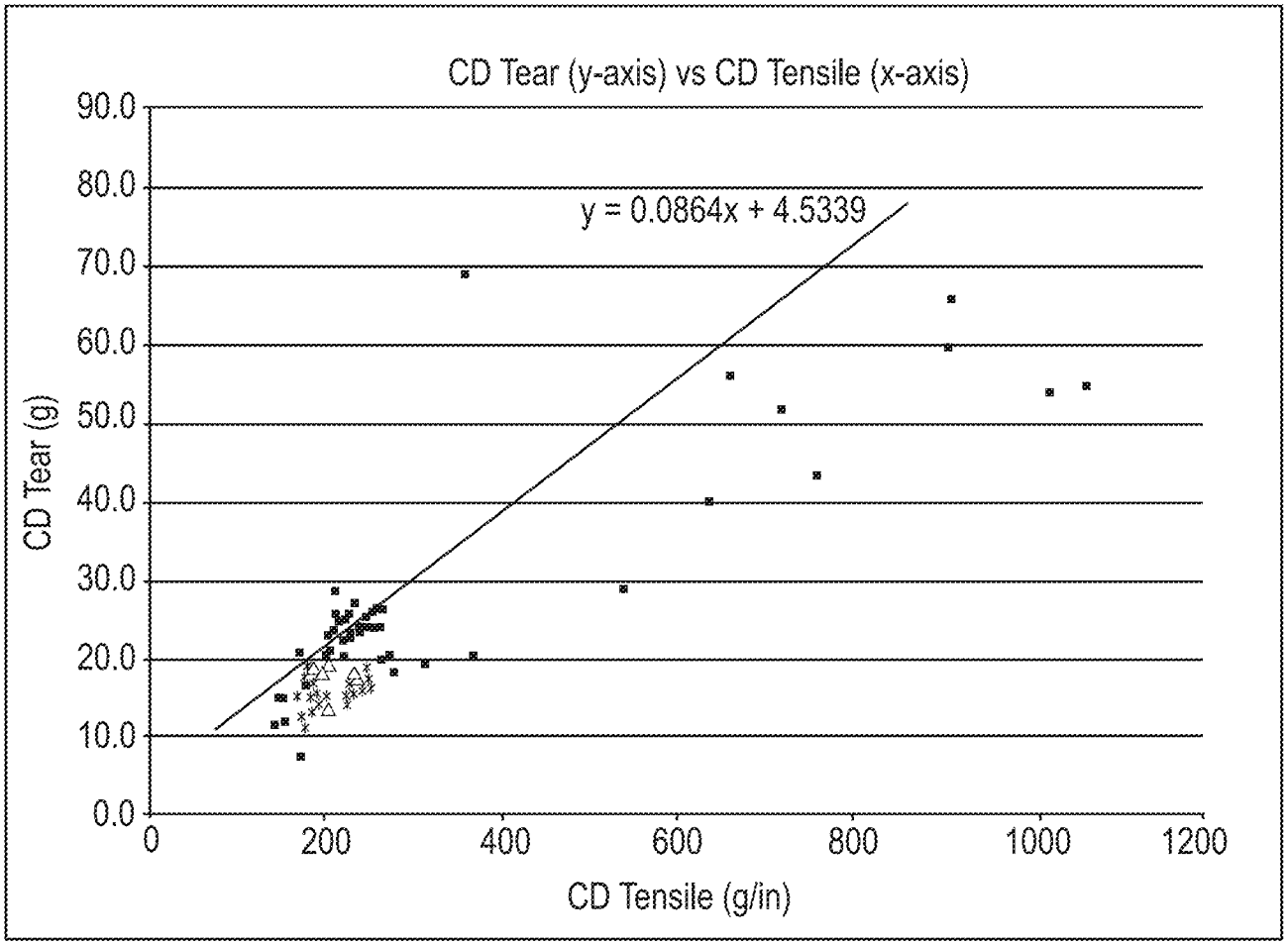
FIG. 4B is a plot of CD Tear (y-axis) (up to 90.0 g) to CD Tensile (x-axis) (up to 1200 g/in) for sanitary tissue products of the present invention and commercially available sanitary tissue products, both single-ply and multi-ply sanitary tissue products, illustrating the high level of CD Tear and the low level of CD Tensile exhibited by the sanitary tissue products, for example bath tissue products, of the present invention.
Figure 5A:
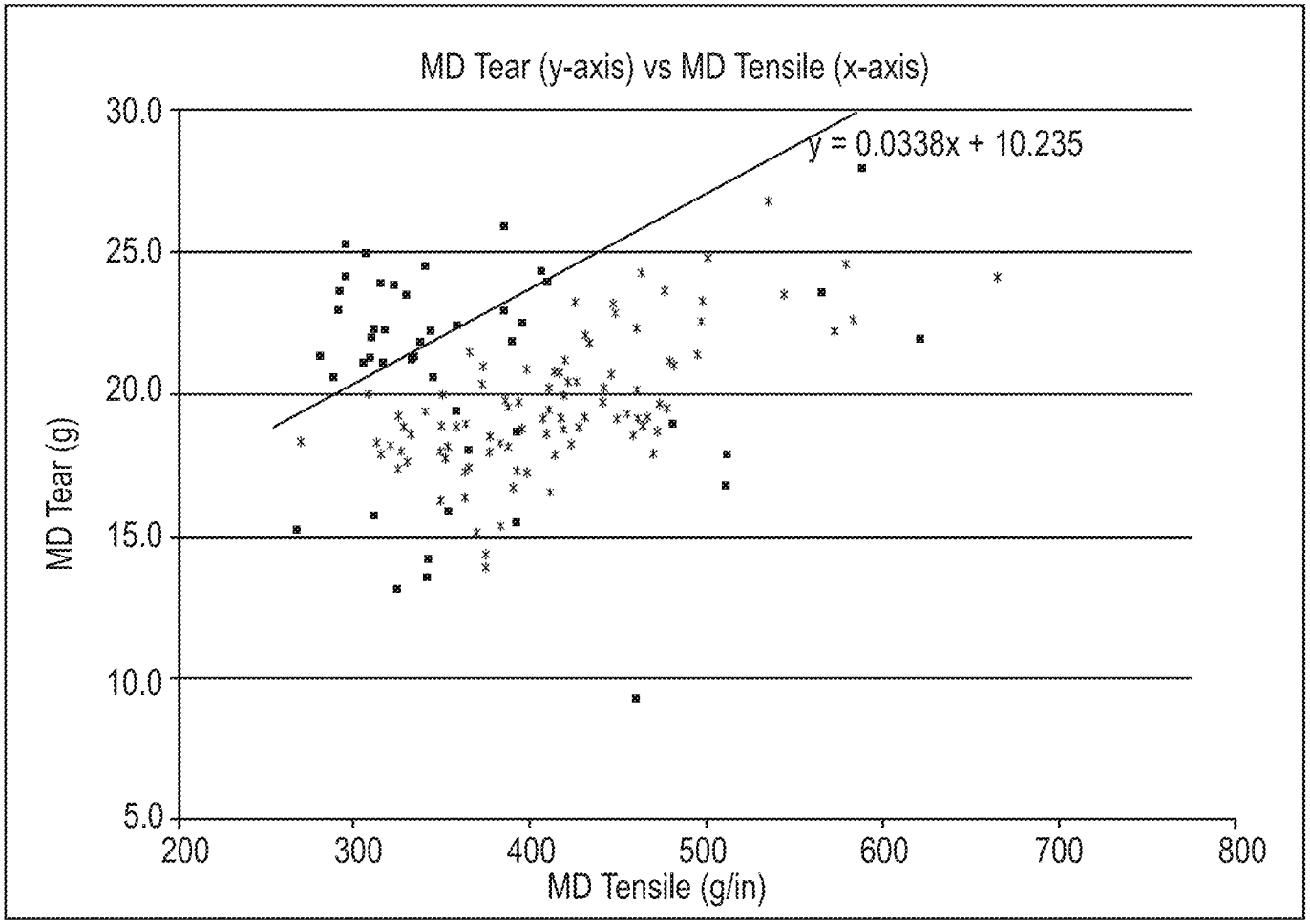
FIG. 5A is a plot of MD Tear (y-axis) (up to 30.0 g) to MD Tensile (x-axis) (up to 800 g/in) for sanitary tissue products of the present invention and commercially available sanitary tissue products, both single-ply and multi-ply sanitary tissue products, illustrating the high level of MD Tear and the low level of MD Tensile exhibited by the sanitary tissue products, for example bath tissue products, of the present invention.
Figure 5B:
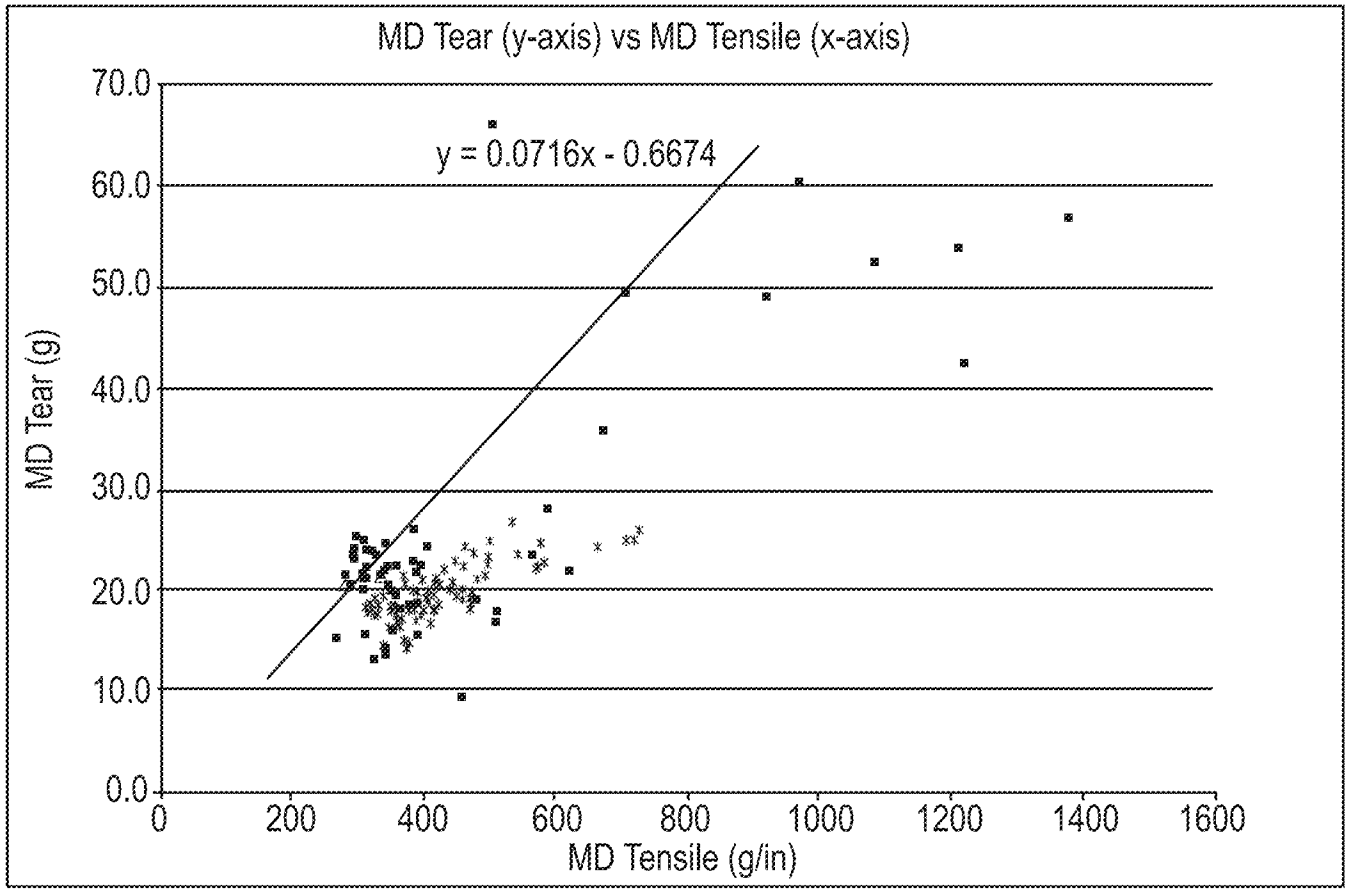
FIG. 5B is a plot of MD Tear (y-axis) (up to 70.0 g) to MD Tensile (x-axis) (up to 1600 g/in) for sanitary tissue products of the present invention and commercially available sanitary tissue products, both single-ply and multi-ply sanitary tissue products, illustrating the high level of MD Tear and the low level of MD Tensile exhibited by the sanitary tissue products, for example bath tissue products, of the present invention.

*No indication of Permanent wet strength and non-dispersible means that the sanitary tissue product is void of permanent wet strength and is dispersible.
*Cont = Continuous Knuckle, Semi-C = Semi-continuous Knuckle, D = Discrete Knuckle
*FSO = fabric side out (the side that is in contact with the molding member during the sanitary tissue product and/of fibrous structure making process is the consumer contacting side during use)
*WSO = wire side out (the side opposite the side that is in contact with the molding member during the sanitary tissue product and/or fibrous structure making process is the consumer contacting side during use)
[1]Prior art sanitary tissue product shown in Prior Art FIG. 2 made on a prior art molding member as shown in FIGS. 1A and 1B (Comparative Example 3 is representative example)

In one example of the present invention, the sanitary tissue product of the present invention exhibits a GM Tear Value of greater than 17.7 g and/or greater than 19.0 g and/or greater than 20.0 g and/or greater than 20.6 g and/or greater than 22.0 g and/or greater than 22.7 g and/or greater than 23.0 g and/or greater than 24.0 g and/or greater than 24.5 g and/or greater than 25.0 g as measured according to the Tear Test Method described herein In one example of the present invention, in addition to the GM Tear Value, the sanitary tissue product of the present invention exhibits a GM Tensile of less than 1200 g/in and/or less than 1000 g/in and/or less than 800 g/in and/or less than 700 g/in and/or less than 650 g/in and/or less than 600 g/in and/or less than 500 g/in and/or less than 400 g/in and/or less than 310 g/in and/or greater than 50 g/in and/or greater than 100 g/in and/or greater than 200 g/in as measured according to the Dry Tensile Test Method described herein.

In another example of the present invention, the sanitary tissue product of the present invention exhibits a CD Tear Value of greater than 8.0 g and/or greater than 10.0 g and/or greater than 15.0 g and/or greater than 20.0 g and/or greater than 21.5 g and/or greater than 23.0 g and/or greater than 24.5 g as measured according to the Tear Test Method described herein.

In another example of the present invention, in addition to the CD Tear Value, the sanitary tissue product of the present invention exhibits a CD Tensile Value of less than 1200 g/in and/or less than 1000 g/in and/or less than 800 g/in and/or less than 650 g/in and/or less than 500 g/in and/or less than 400 g/in and/or less than 300 g/in and/or greater than 50 g/in and/or greater than 100 g/in and/or greater than 150 g/in as measured according to the Dry Tensile Test Method described herein.

In another example of the present invention, the sanitary tissue product of the present invention exhibits an MD Tear Value of greater than 5.0 g and/or greater than 10.0 g and/or greater than 12.0 g and/or greater than 15.0 g and/or greater than 17.0 g and/or greater than 20.0 g and/or greater than 21.0 g as measured according to the Tear Test Method described herein.

In another example of the present invention, in addition to the MD Tear Value, the sanitary tissue product of the present invention exhibits an MD Tensile Value of less than 1600 g/in and/or less than 1200 g/in and/or less than 1000 g/in and/or less than 800 g/in and/or less than 600 g/in and/or less than 500 g/in and/or less than 400 g/in and/or less than 300 g/in and/or greater than 50 g/in and/or greater than 100 g/in and/or greater than 150 as measured according to the Dry Tensile Test Method described herein.

In one example of the present invention, in addition to any of the other properties described herein, the sanitary tissue product of the present invention may exhibit a Compressibility of greater than 32.0 and/or greater than 35.0 and/or greater than 37.0 and/or greater than 39.0 and/or greater than 40.0 and/or greater than 41.1 mils/(log(g/in$^2$)) as measured according to the Stack Compressibility and Resilient Bulk Test Method.

In one example of the present invention, in addition to any of the other properties described herein, the sanitary tissue product of the present invention may exhibit a Plate Stiffness of less than 5.2 and/or less than 4.0 and/or less than 3.5 and/or less than 3.0 and/or less than 2.5 and/or less than 2.3 and/or less than 2.1 and/or less than 2.0 N*mm as measured according to the Plate Stiffness Test Method described herein.

In another example of the present invention, in addition to any of the other properties described herein, the sanitary tissue product of the present invention may exhibit a Slip Stick Coefficient of Friction of less than 700 and/or less than 600 and/or less than 500 and/or less than 450 and/or less than 400 (COF*10000) as measured according to the Slip Stick Coefficient of Friction Test Method described herein.

In another example of the present invention, in addition to any of the other properties described herein, the sanitary tissue product of the present invention may exhibit a Resilient Bulk of greater than 55 and/or greater than 57 and/or greater than 60 and/or greater than 64 and/or greater than 66 and/or greater than 70 and/or greater than 75 cc/g as measured according to the Stack Compressibility and Resilient Bulk Test Method described herein.

The fibrous structures and/or sanitary tissue products of the present invention may be creped or uncreped. The fibrous structures and/or sanitary tissue products of the present invention may be fabric creped and/or belt creped.

The fibrous structures and/or sanitary tissue products of the present invention may be wet-laid or air-laid.

The fibrous structures and/or sanitary tissue products of the present invention may be embossed.

The fibrous structures and/or sanitary tissue products of the present invention may comprise a surface softening agent or be void of a surface softening agent. In one example, the sanitary tissue product is a non-lotioned sanitary tissue product, such as a sanitary tissue product comprising a non-lotioned fibrous structure ply, for example a non-lotioned through-air-dried fibrous structure ply, for example a non-lotioned creped through-air-dried fibrous structure ply and/or a non-lotioned uncreped through-air-dried fibrous structure ply. In yet another example, the sanitary tissue product may comprise a non-lotioned fabric creped fibrous structure ply and/or a non-lotioned belt creped fibrous structure ply.

The fibrous structures and/or sanitary tissue products of the present invention may comprise trichome fibers and/or may be void of trichome fibers.

The fibrous structures and/or sanitary tissue products of the present invention may exhibit the compressibility values alone or in combination with the plate stiffness values with or without the aid of surface softening agents. In other words, the sanitary tissue products of the present invention may exhibit the compressibility values described above alone or in combination with the plate stiffness values when surface softening agents are not present on and/or in the sanitary tissue products, in other words the sanitary tissue product is void of surface softening agents. This does not mean that the sanitary tissue products themselves cannot include surface softening agents. It simply means that when the sanitary tissue product is made without adding the surface softening agents, the sanitary tissue product exhibits the compressibility and plate stiffness values of the present invention. Addition of a surface softening agent to such a sanitary tissue product within the scope of the present invention (without the need of a surface softening agent or other chemistry) may enhance the sanitary tissue product's compressibility and/or plate stiffness to an extent. However, sanitary tissue products that need the inclusion of surface softening agents on and/or in them to be within the scope of the present invention, in other words to achieve the compressibility and plate stiffness values of the present invention, are outside the scope of the present invention.

Patterned Molding Members

The sanitary tissue products of the present invention and/or fibrous structure plies employed in the sanitary tissue products of the present invention are formed on patterned molding members that result in the sanitary tissue products of the present invention. In one example, the pattern molding member comprises a non-random repeating pattern. In another example, the pattern molding member comprises a resinous pattern.

A "reinforcing element" may be a desirable (but not necessary) element in some examples of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

Figure 6A:
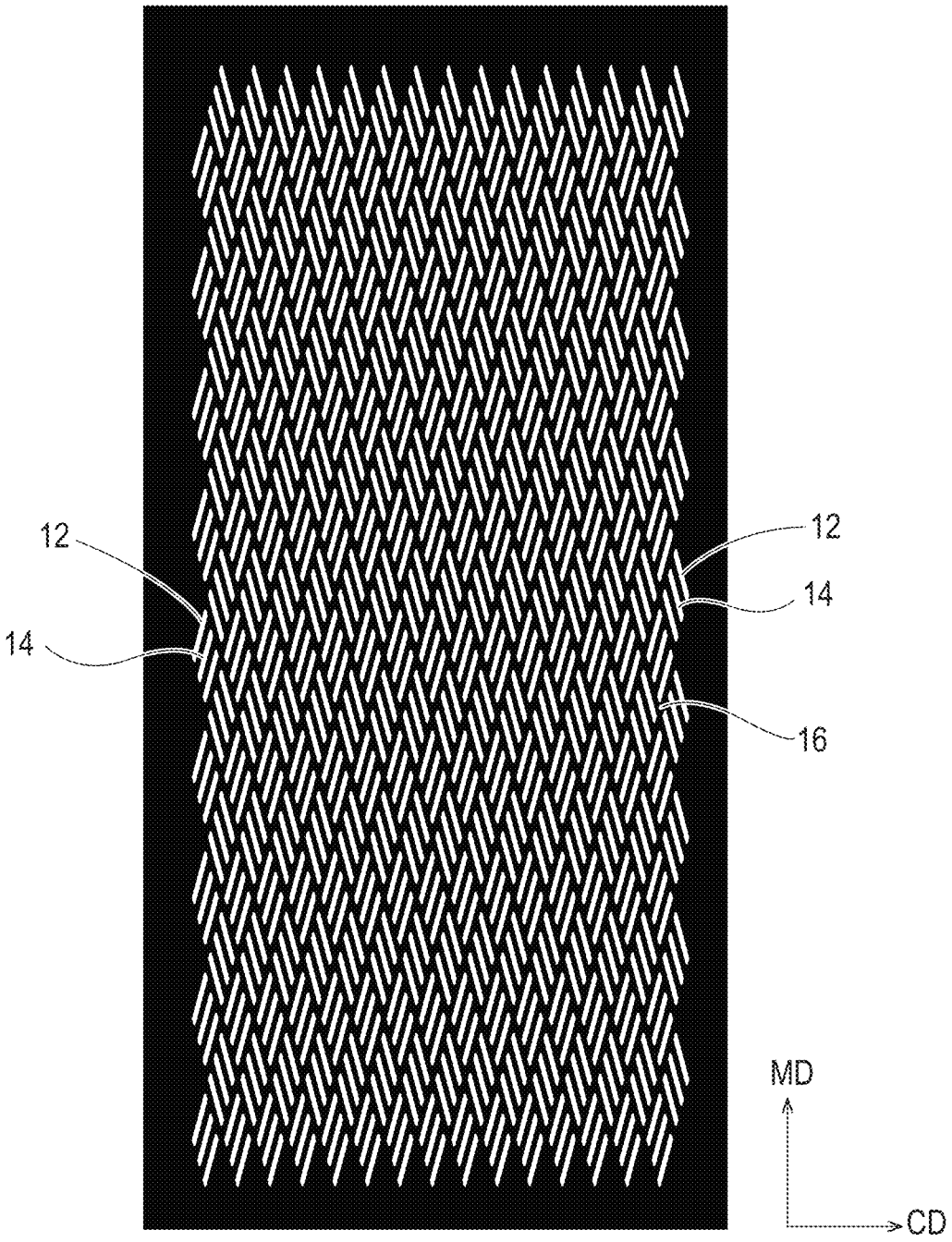
FIG. 6A is a schematic representation of an example of a molding member according to the present invention.
Figure 6B:
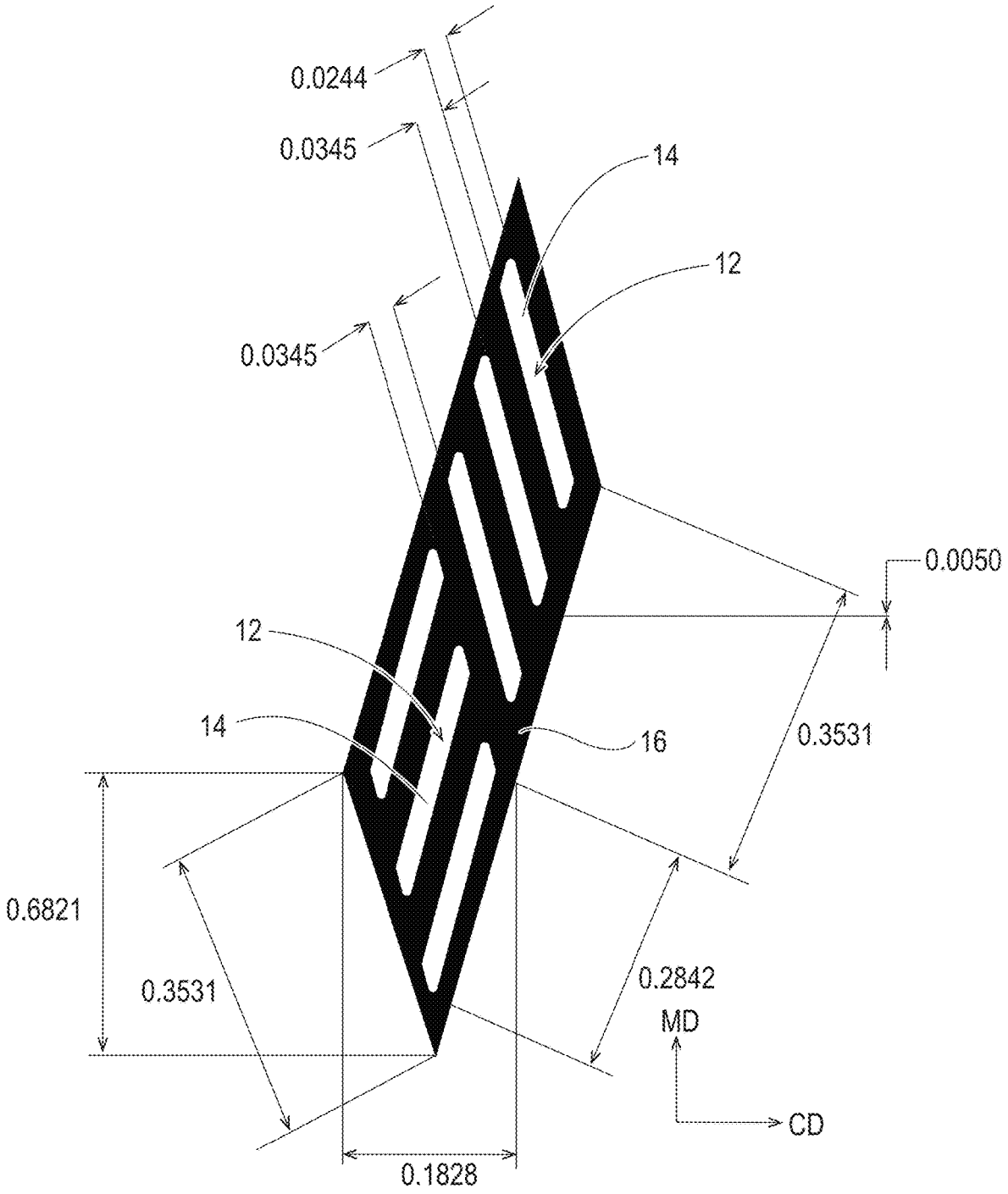
FIG. 6B is a further schematic representation of a portion of the molding member of FIG. 6A.
Figure 6C:
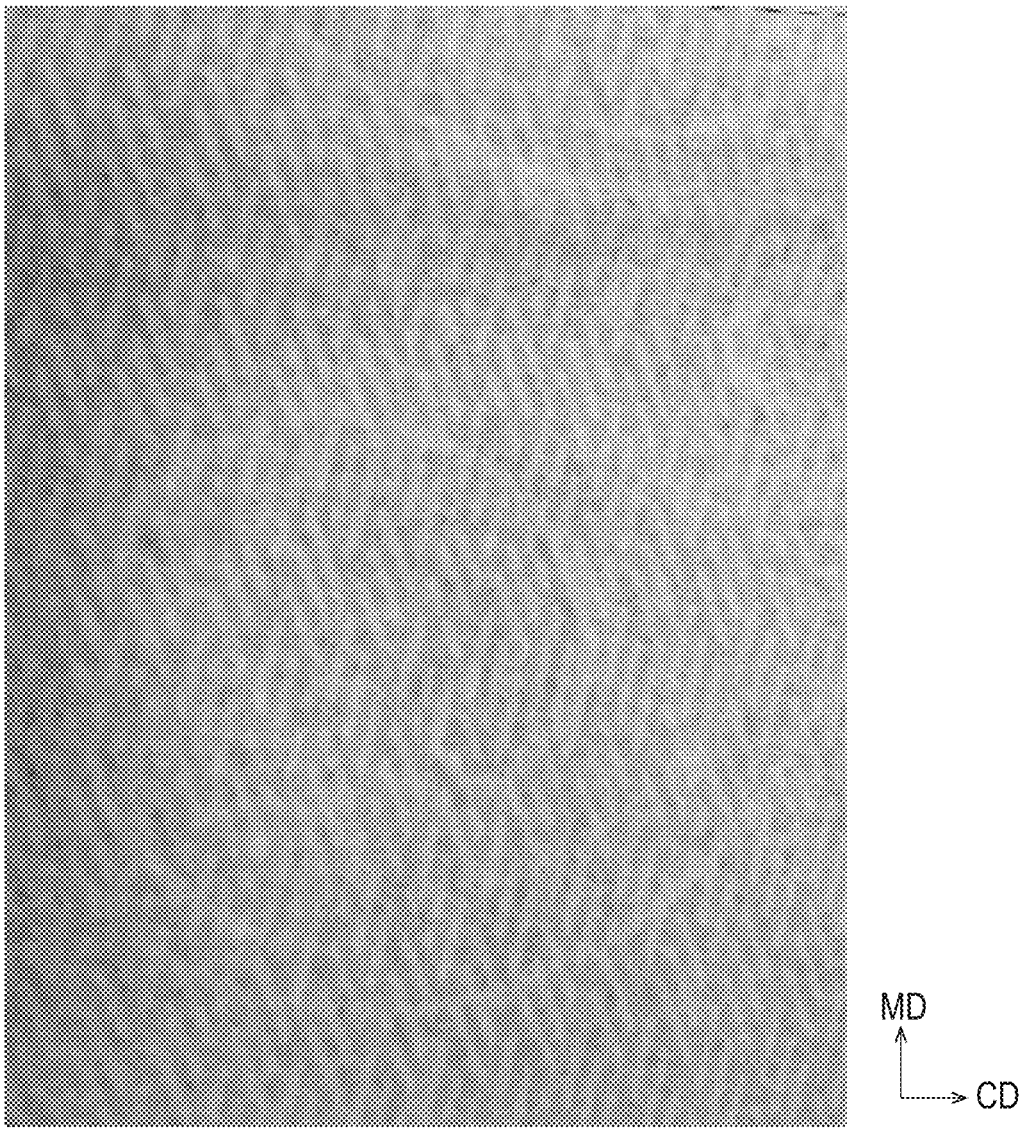
FIG. 6C is a photograph of a sanitary tissue product made using the molding member of FIG. 6A.
Figure 6D:
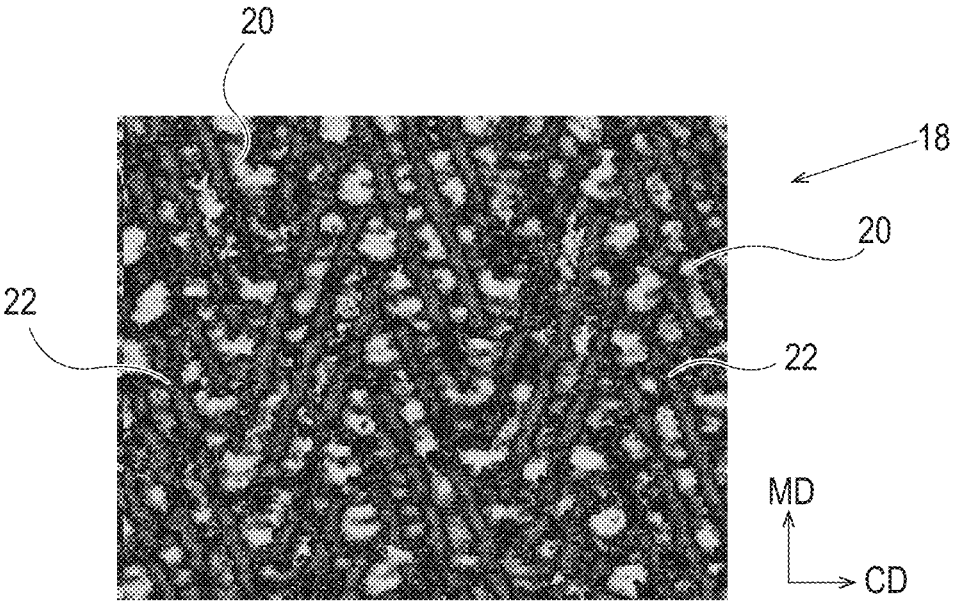
FIG. 6D is a MikroCAD image of a sanitary tissue product made using the molding member of FIG. 6A.

As shown in FIGS. 6A and 6B, a non-limiting example of a patterned molding member 10 suitable for use in the present invention comprises a through-air-drying belt. The patterned molding member 10 comprises a plurality of discrete knuckles 12 formed by line segments of resin 14 arranged in a non-random, repeating pattern, such as a woven pattern, for example a herringbone pattern. In this example, the line segments are straight and are arranged at an angle of greater than 45° and/or 50° or greater and/or 55° or greater and/or 60° or greater and/or 65° or greater and/or 70° or greater and/or 75° or greater and/or 80° or greater and/or 85° or greater and/or less than 90° and/or less than 87° with respect to the CD of the sanitary tissue product and/or fibrous structure ply of the sanitary tissue product. In this particular example, the line segments are oriented at an angle of about 60° with respect to the CD of the sanitary tissue product and/or fibrous structure ply of the sanitary tissue product. The discrete knuckles 12 are dispersed within a continuous pillow network 16, which constitute a deflection conduit into which portions of a fibrous structure ply being made on the patterned molding member 10 of FIGS. 6A and 6B deflect. FIG. 6D is a MikroCAD image of a resulting sanitary tissue product 18 being made on the patterned molding member 10. The sanitary tissue product 18 comprises a continuous pillow region 20 imparted by the continuous pillow network 16 of the patterned molding member 10 of FIGS. 6A and 6B. The sanitary tissue product 18 further comprises discrete knuckle regions 22 imparted by the discrete knuckles 12 of the patterned molding member 10 of FIGS. 6A and 6B. The continuous pillow region 20 and discrete knuckle regions 22 may exhibit different densities, for example, one or more of the discrete knuckle regions 22 may exhibit a density that is greater than the density of the continuous pillow region 20.

Figure 7A:
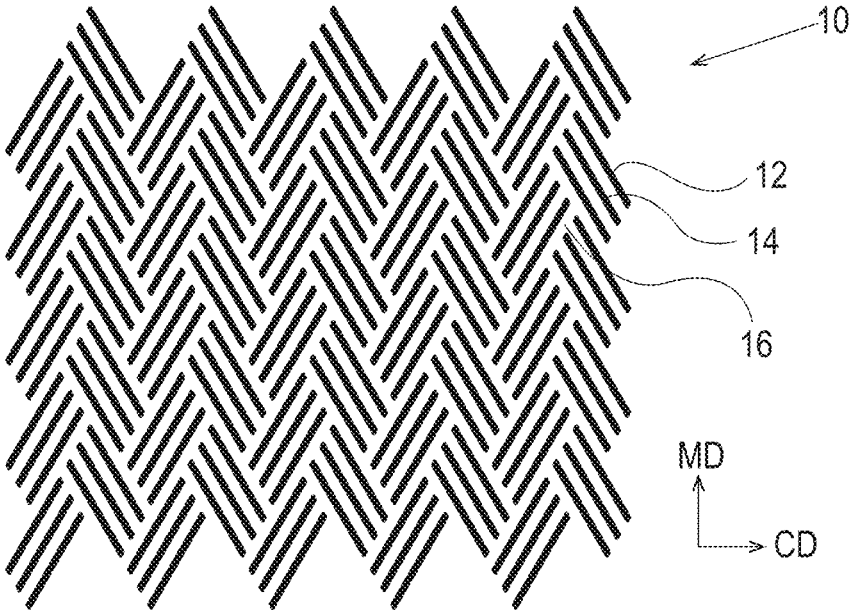
FIG. 7A is a schematic representation of another example of a molding member according to the present invention.
Figure 7B:
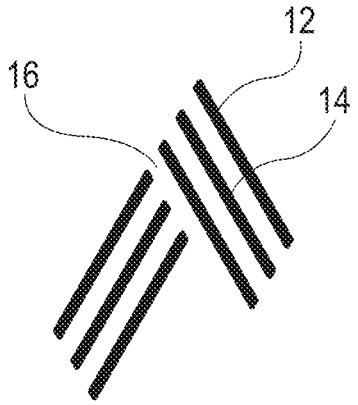
FIG. 7B is a further schematic representation of a portion of the molding member of FIG. 7A.
Figure 7C:
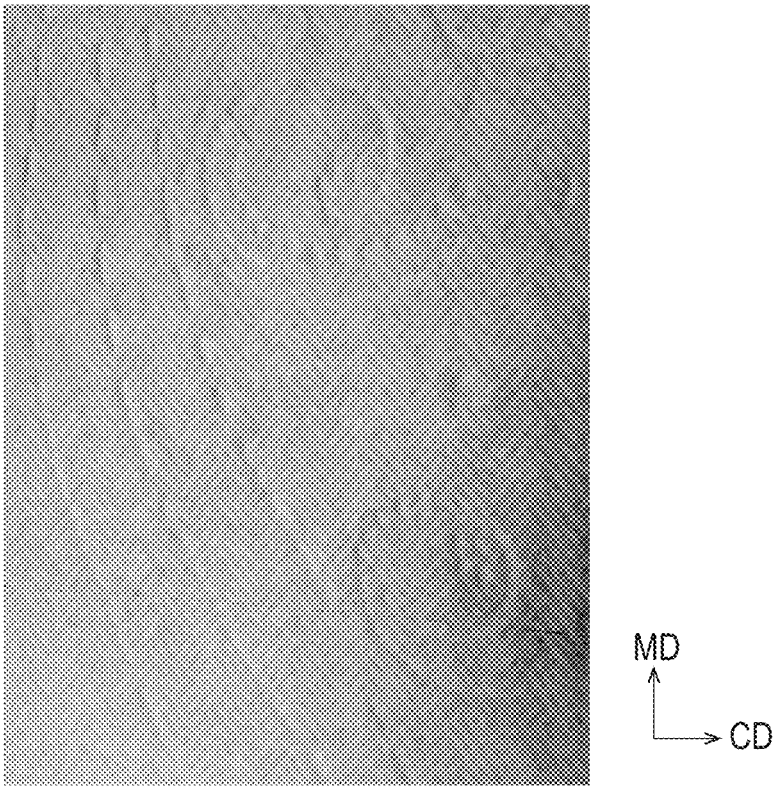
FIG. 7C is a photograph of a sanitary tissue product made using the molding member of FIG. 7A.
Figure 7D:
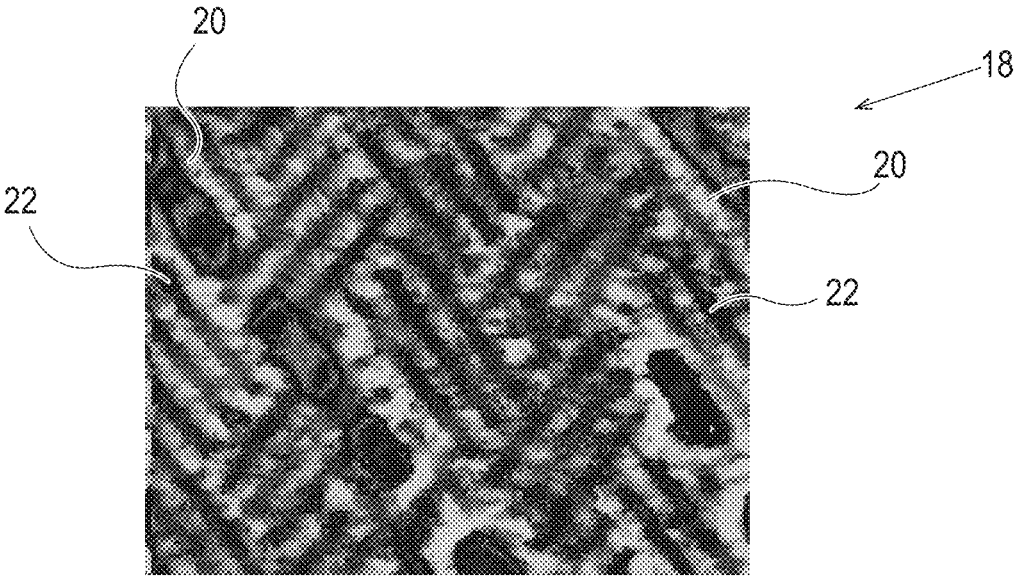
FIG. 7D is a MikroCAD image of a sanitary tissue product made using the molding member of FIG. 7A.

As shown in FIGS. 7A and 7B, a non-limiting example of a patterned molding member 10 suitable for use in the present invention comprises a through-air-drying belt. The patterned molding member 10 comprises a plurality of discrete knuckles 12 formed by line segments of resin 14 arranged in a non-random, repeating pattern, such as a woven pattern, for example a herringbone pattern. In this example, the line segments are straight and are arranged at an angle of greater than 45° and/or 50° or greater and/or 55° or greater and/or 60° or greater and/or 65° or greater and/or 70° or greater and/or 75° or greater and/or 80° or greater and/or 85° or greater and/or less than 90° and/or less than 87° with respect to the CD of the sanitary tissue product and/or fibrous structure ply of the sanitary tissue product. In this particular example, the line segments are oriented at an angle of about 60° with respect to the CD of the sanitary tissue product and/or fibrous structure ply of the sanitary tissue product. The discrete knuckles 12 are dispersed within a continuous pillow network 16, which constitute a deflection conduit into which portions of a fibrous structure ply being made on the patterned molding member 10 of FIGS. 7A and 7B deflect. FIG. 7D is a MikroCAD image of a resulting sanitary tissue product 18 being made on the patterned molding member 10. The sanitary tissue product 18 comprises a continuous pillow region 20 imparted by the continuous pillow network 16 of the patterned molding member 10 of FIGS. 7A and 7B. The sanitary tissue product 18 further comprises discrete knuckle regions 22 imparted by the discrete knuckles 12 of the patterned molding member 10 of FIGS. 2A and 2B. The continuous pillow region 20 and discrete knuckle regions 22 may exhibit different densities, for example, one or more of the discrete knuckle regions 22 may exhibit a density that is greater than the density of the continuous pillow region 20.

Figure 8A:
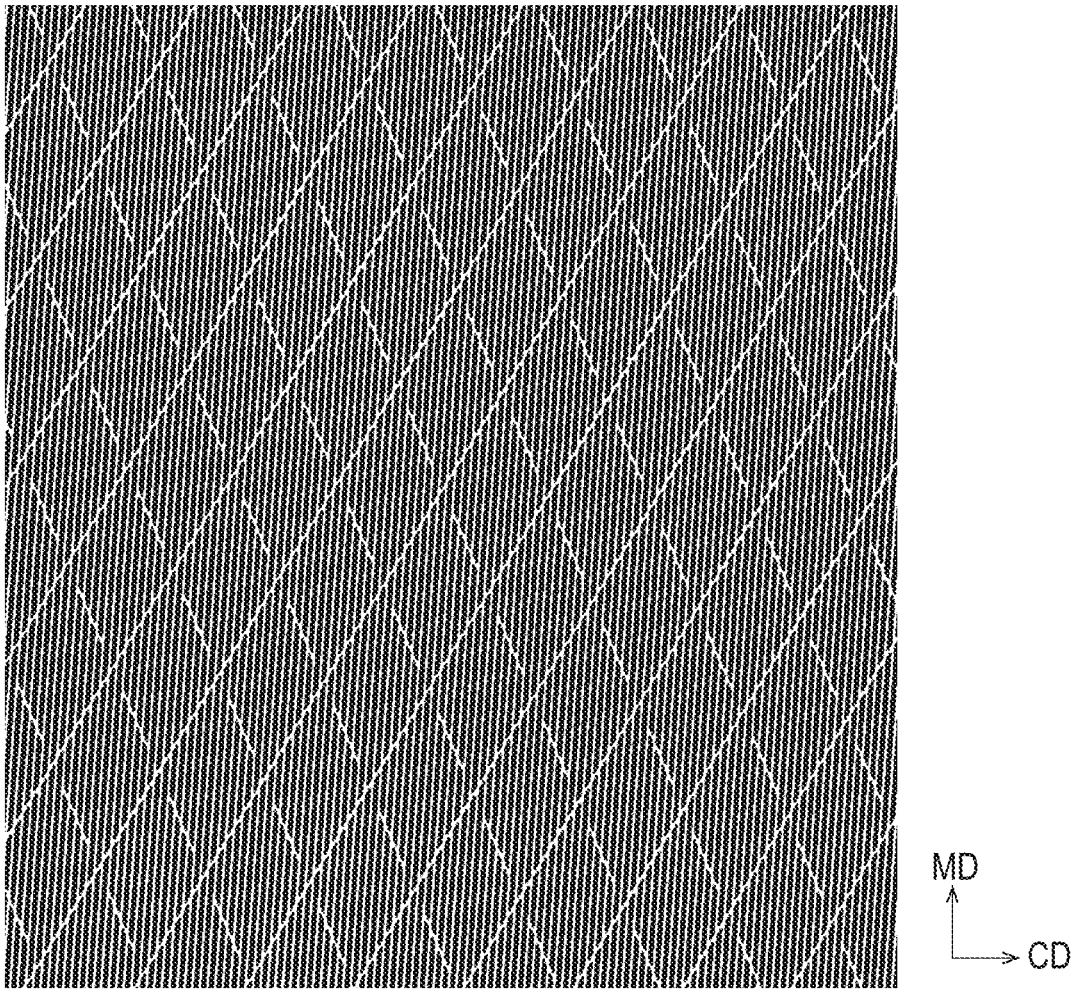
FIG. 8A is a schematic representation of another example of a molding member according to the present invention.
Figure 8B:
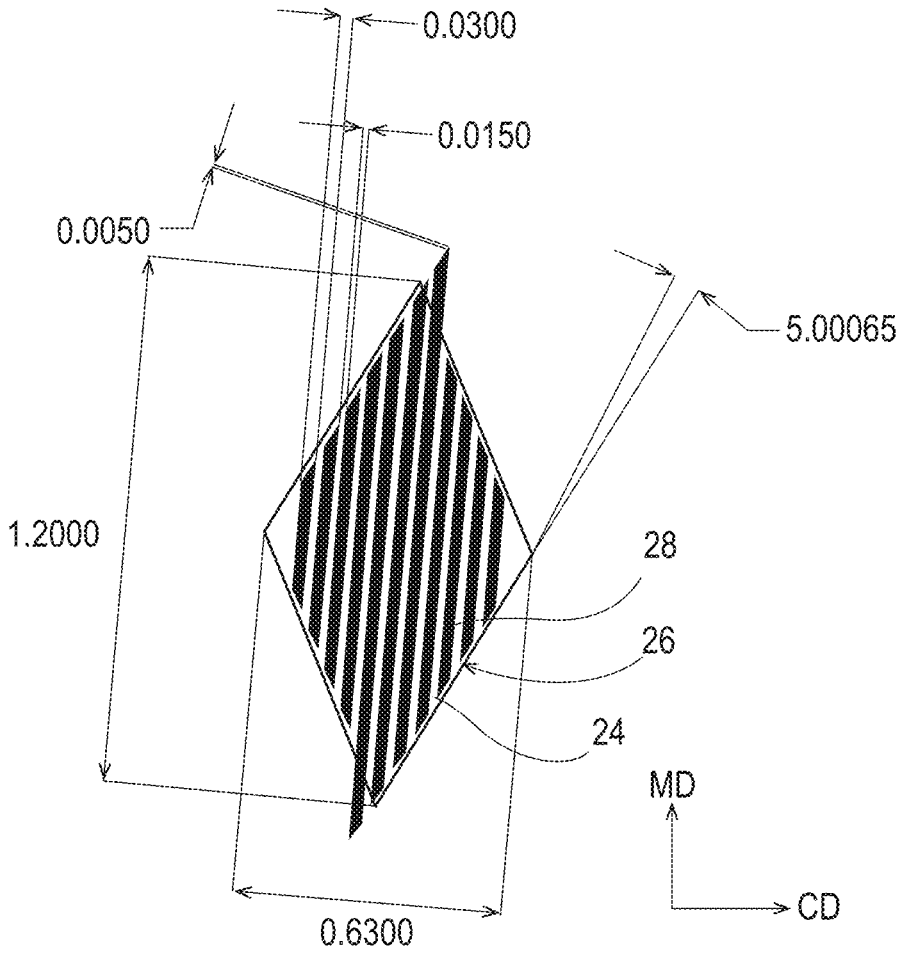
FIG. 8B is a further schematic representation of a portion of the molding member of FIG. 8A.
Figure 8C:
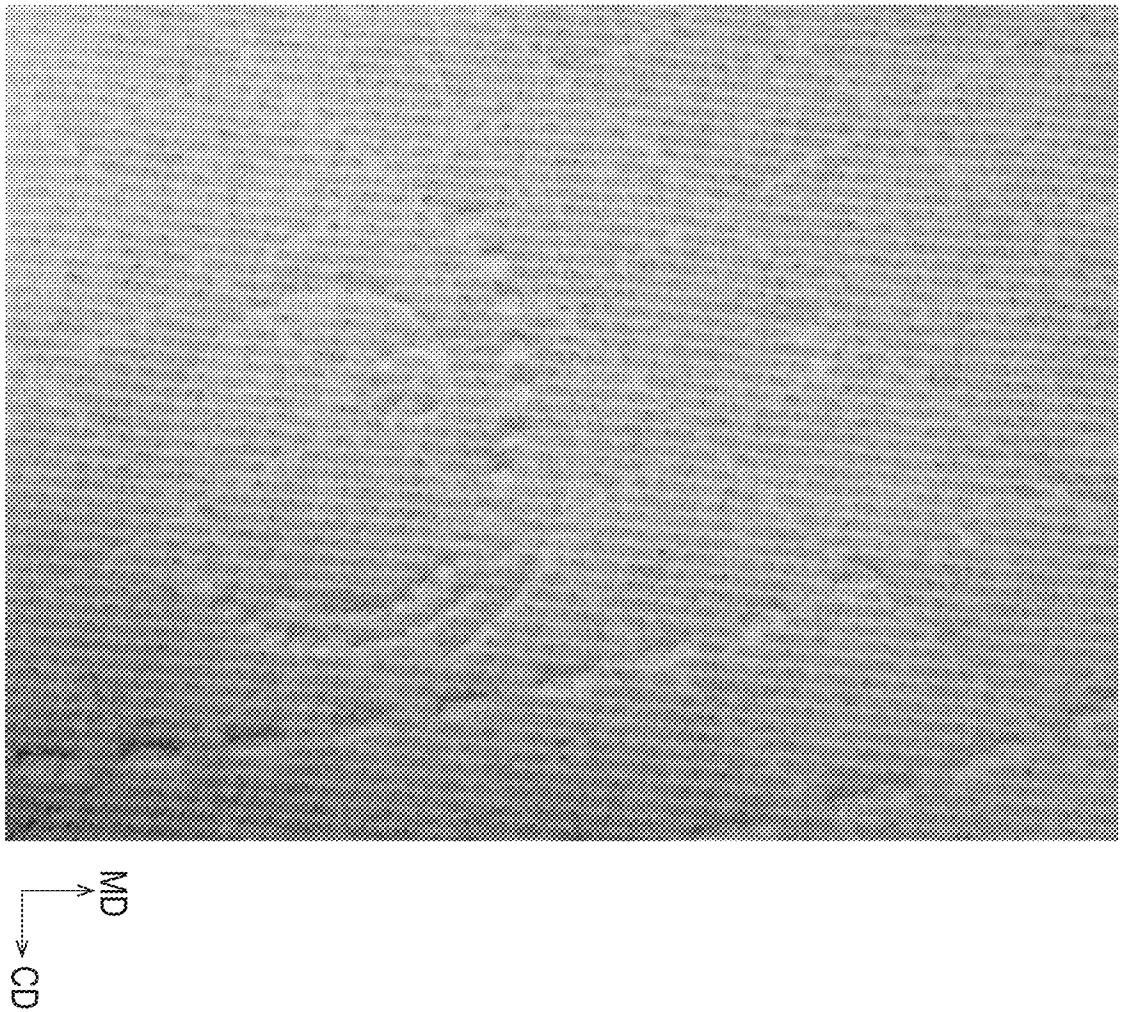
FIG. 8C is a photograph of a sanitary tissue product made using the molding member of FIG. 8A.
Figure 8D:
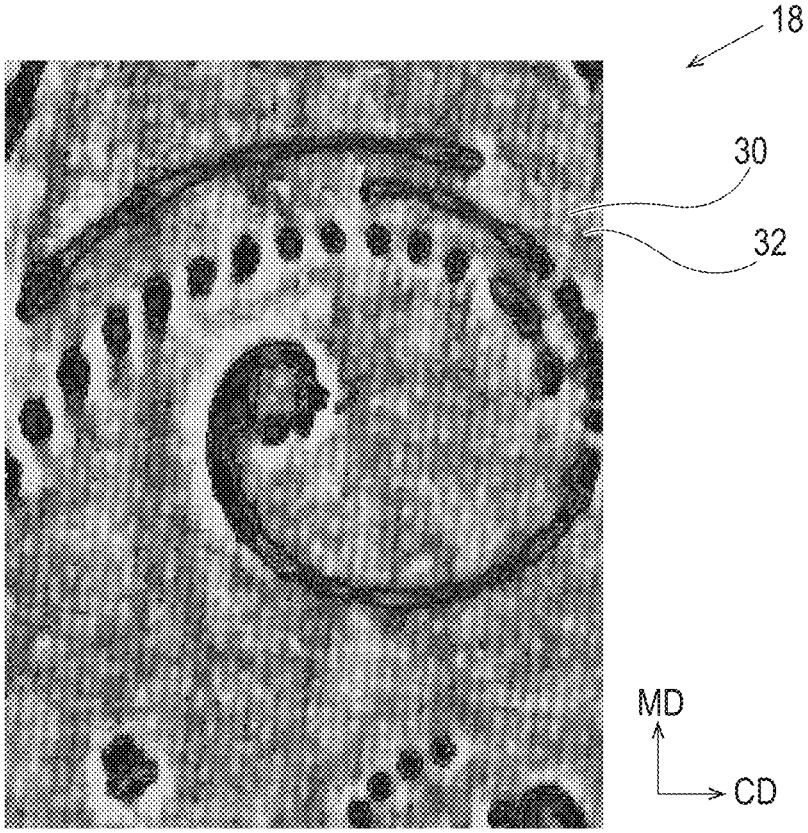
FIG. 8D is a MikroCAD image of a sanitary tissue product made using the molding member of FIG. 8A.

As shown in FIGS. 8A and 8B, a non-limiting example of another patterned molding member 10 suitable for use in the present invention comprises a through-air-drying belt. The patterned molding member 10 comprises a plurality of semi-continuous knuckles 24 formed by semi-continuous line segments of resin 26 arranged in a non-random, repeating pattern, for example a substantially cross-machine direction repeating pattern of semi-continuous lines supported on a support fabric comprising filaments 27. In this case, the semi-continuous lines are straight and are oriented at an angle of greater than 45° and/or 50° or greater and/or 55° or greater and/or 60° or greater and/or 65° or greater and/or 70° or greater and/or 75° or greater and/or 80° or greater and/or 85° or greater and/or less than 90° and/or less than 87° with respect to the CD of the sanitary tissue product and/or fibrous structure ply of the sanitary tissue product. In this particular example, the line segments are oriented at an angle of about 15° with respect to the CD of the sanitary tissue product and/or fibrous structure ply of the sanitary tissue product. The semi-continuous knuckles 24 are spaced from adjacent semi-continuous knuckles 24 by semi-continuous pillows 28, which constitute deflection conduits into which portions of a fibrous structure ply being made on the through-air-drying belt 10 of FIGS. 8A and 8B deflect. As shown in FIGS. 8C and 8D, a resulting sanitary tissue product 18 being made on the patterned molding member 10 of FIGS. 8A and 8B comprises semi-continuous pillow regions 30 imparted by the semi-continuous pillows 28 of the patterned molding member 10 of FIGS. 8A and 8B. The sanitary tissue product 18 further comprises semi-continuous knuckle regions 32 imparted by the semi-continuous knuckles 24 of the patterned molding member 10 of FIGS. 8A and 8B. The semi-continuous pillow regions 30 and semi-continuous knuckle regions 32 may exhibit different densities, for example, one or more of the semi-continuous knuckle regions 32 may exhibit a density that is greater than the density of one or more of the semi-continuous pillow regions 30. It has surprisingly been found that when the sanitary tissue product 18 made on the patterned molding member 10 as shown in FIGS. 8A and 8B is converted fabric side out (FSO), the sanitary tissue product 18 exhibits novel tear and tensile properties compared to such a sanitary tissue product converted wire side out (WSO).

Without wishing to be bound by theory, foreshortening (dry & wet crepe, fabric crepe, rush transfer, etc) is an integral part of fibrous structure and/or sanitary tissue paper making, helping to produce the desired balance of strength, stretch, softness, absorbency, etc. Fibrous structure support, transport and molding members used in the papermaking process, such as rolls, wires, felts, fabrics, belts, etc. have been variously engineered to interact with foreshortening to further control the fibrous structure and/or sanitary tissue product properties. In the past, it has been thought that it is advantageous to avoid highly CD dominant knuckle designs that result in MD oscillations of foreshortening forces. However, it has unexpectedly been found that the patterned molding member of FIGS. 8A and 8B provides a patterned molding member having CD dominant semi-continuous knuckles that to enable better control of the fibrous structure's molding and stretch while overcoming the negatives of the past.

Non-Limiting Examples of Making Sanitary Tissue Products

The sanitary tissue products of the present invention may be made by any suitable papermaking process so long as a molding member of the present invention is used to making the sanitary tissue product or at least one fibrous structure ply of the sanitary tissue product and that the sanitary tissue product exhibits a compressibility and plate stiffness values of the present invention. The method may be a sanitary tissue product making process that uses a cylindrical dryer such as a Yankee (a Yankee-process) or it may be a Yankeeless process as is used to make substantially uniform density and/or uncreped fibrous structures and/or sanitary tissue products. Alternatively, the fibrous structures and/or sanitary tissue products may be made by an air-laid process and/or meltblown and/or spunbond processes and any combinations thereof so long as the fibrous structures and/or sanitary tissue products of the present invention are made thereby.

Figure 9:
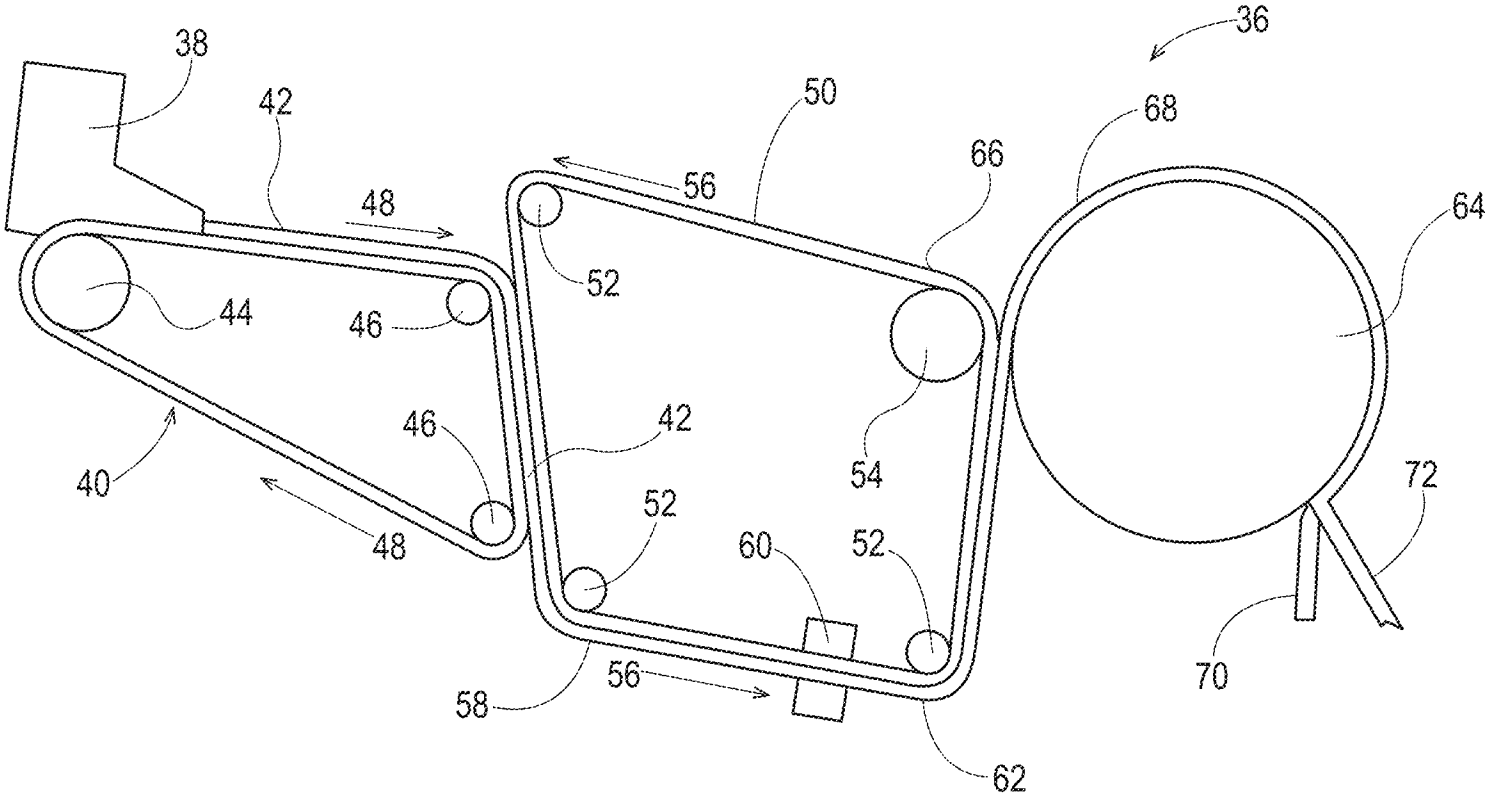
FIG. 9 is a schematic representation of an example of a through-air-drying papermaking process for making a sanitary tissue product according to the present invention.

As shown in FIG. 9, one example of a process and equipment, represented as 36 for making a sanitary tissue product according to the present invention comprises supplying an aqueous dispersion of fibers (a fibrous furnish or fiber slurry) to a headbox 38 which can be of any convenient design. From headbox 38 the aqueous dispersion of fibers is delivered to a first foraminous member 40 which is typically a Fourdrinier wire, to produce an embryonic fibrous structure 42.

The first foraminous member 40 may be supported by a breast roll 44 and a plurality of return rolls 46 of which only two are shown. The first foraminous member 40 can be propelled in the direction indicated by directional arrow 48 by a drive means, not shown. Optional auxiliary units and/or devices commonly associated fibrous structure making machines and with the first foraminous member 40, but not shown, include forming boards, hydrofoils, vacuum boxes, tension rolls, support rolls, wire cleaning showers, and the like.

After the aqueous dispersion of fibers is deposited onto the first foraminous member 40, embryonic fibrous structure 42 is formed, typically by the removal of a portion of the aqueous dispersing medium by techniques well known to those skilled in the art. Vacuum boxes, forming boards, hydrofoils, and the like are useful in effecting water removal. The embryonic fibrous structure 42 may travel with the first foraminous member 40 about return roll 46 and is brought into contact with a patterned molding member 10, such as a 3D patterned through-air-drying belt. While in contact with the patterned molding member 10, the embryonic fibrous structure 42 will be deflected, rearranged, and/or further dewatered.

The patterned molding member 10 may be in the form of an endless belt. In this simplified representation, the patterned molding member 10 passes around and about patterned molding member return rolls 52 and impression nip roll 54 and may travel in the direction indicated by directional arrow 56. Associated with patterned molding member 10, but not shown, may be various support rolls, other return rolls, cleaning means, drive means, and the like well known to those skilled in the art that may be commonly used in fibrous structure making machines.

After the embryonic fibrous structure 42 has been associated with the patterned molding member 10, fibers within the embryonic fibrous structure 42 are deflected into pillows and/or pillow network ("deflection conduits") present in the patterned molding member 10. In one example of this process step, there is essentially no water removal from the embryonic fibrous structure 42 through the deflection conduits after the embryonic fibrous structure 42 has been associated with the patterned molding member 10 but prior to the deflecting of the fibers into the deflection conduits. Further water removal from the embryonic fibrous structure 42 can occur during and/or after the time the fibers are being deflected into the deflection conduits. Water removal from the embryonic fibrous structure 42 may continue until the consistency of the embryonic fibrous structure 42 associated with patterned molding member 10 is increased to from about 25% to about 35%. Once this consistency of the embryonic fibrous structure 42 is achieved, then the embryonic fibrous structure 42 can be referred to as an intermediate fibrous structure 58. During the process of forming the embryonic fibrous structure 42, sufficient water may be removed, such as by a noncompressive process, from the embryonic fibrous structure 42 before it becomes associated with the patterned molding member 10 so that the consistency of the embryonic fibrous structure 42 may be from about 10% to about 30%.

While applicants decline to be bound by any particular theory of operation, it appears that the deflection of the fibers in the embryonic fibrous structure and water removal from the embryonic fibrous structure begin essentially simultaneously. Embodiments can, however, be envisioned wherein deflection and water removal are sequential operations. Under the influence of the applied differential fluid pressure, for example, the fibers may be deflected into the deflection conduit with an attendant rearrangement of the fibers. Water removal may occur with a continued rearrangement of fibers. Deflection of the fibers, and of the embryonic fibrous structure, may cause an apparent increase in surface area of the embryonic fibrous structure. Further, the rearrangement of fibers may appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the deflection conduit while the opposite ends are restrained in the region of the ridges. Shorter fibers, on the other hand, can actually be transported from the region of the ridges into the deflection conduit (The fibers in the deflection conduits will also be rearranged relative to one another). Naturally, it is possible for both modes of rearrangement to occur simultaneously.

As noted, water removal occurs both during and after deflection; this water removal may result in a decrease in fiber mobility in the embryonic fibrous structure. This decrease in fiber mobility may tend to fix and/or freeze the fibers in place after they have been deflected and rearranged. Of course, the drying of the fibrous structure in a later step in the process of this invention serves to more firmly fix and/or freeze the fibers in position.

Any convenient means conventionally known in the papermaking art can be used to dry the intermediate fibrous structure 58. Examples of such suitable drying process include subjecting the intermediate fibrous structure 58 to conventional and/or flow-through dryers and/or Yankee dryers.

In one example of a drying process, the intermediate fibrous structure 58 in association with the patterned molding member 10 passes around the patterned molding member return roll 52 and travels in the direction indicated by directional arrow 56. The intermediate fibrous structure 58 may first pass through an optional predryer 60. This predryer 60 can be a conventional flow-through dryer (hot air dryer) well known to those skilled in the art. Optionally, the predryer 60 can be a so-called capillary dewatering apparatus. In such an apparatus, the intermediate fibrous structure 58 passes over a sector of a cylinder having preferential-capillary-size pores through its cylindrical-shaped porous cover. Optionally, the predryer 60 can be a combination capillary dewatering apparatus and flow-through dryer. The quantity of water removed in the predryer 60 may be controlled so that a predried fibrous structure 62 exiting the predryer 60 has a consistency of from about 30% to about 98%. The predried fibrous structure 62, which may still be associated with patterned molding member 10, may pass around another patterned molding member return roll 52 and as it travels to an impression nip roll 54. As the predried fibrous structure 62 passes through the nip formed between impression nip roll 54 and a surface of a Yankee dryer 64, the pattern formed by the top surface 66 of patterned molding member 10 is impressed into the predried fibrous structure 62 to form a 3D patterned fibrous structure 68. The imprinted fibrous structure 68 can then be adhered to the surface of the Yankee dryer 64 where it can be dried to a consistency of at least about 95%.

The 3D patterned fibrous structure 68 can then be foreshortened by creping the 3D patterned fibrous structure 68 with a creping blade 70 to remove the 3D patterned fibrous structure 68 from the surface of the Yankee dryer 64 resulting in the production of a 3D patterned creped fibrous structure 72 in accordance with the present invention. As used herein, foreshortening refers to the reduction in length of a dry (having a consistency of at least about 90% and/or at least about 95%) fibrous structure which occurs when energy is applied to the dry fibrous structure in such a way that the length of the fibrous structure is reduced and the fibers in the fibrous structure are rearranged with an accompanying disruption of fiber-fiber bonds. Foreshortening can be accomplished in any of several well-known ways. One common method of foreshortening is creping. The 3D patterned creped fibrous structure 72 may be subjected to post processing steps such as calendaring, tuft generating operations, and/or embossing and/or converting.

Figure 10:
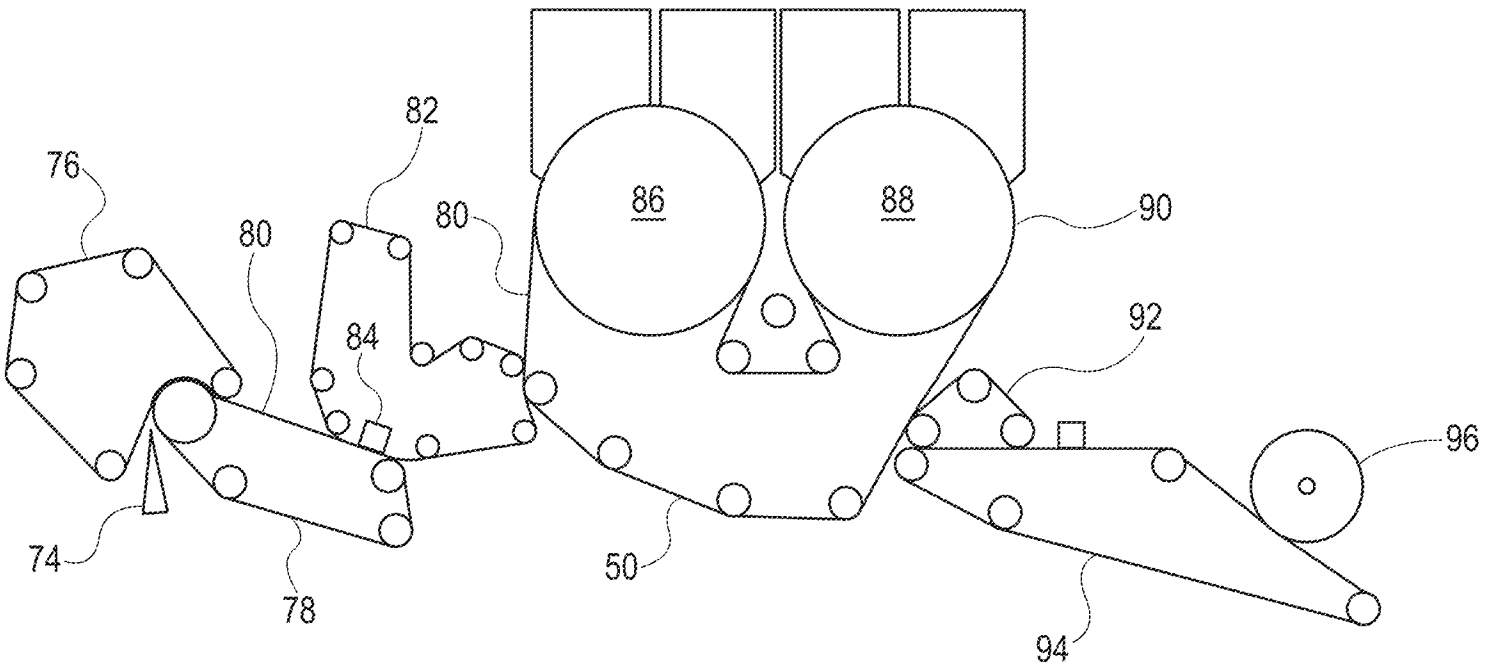
FIG. 10 is a schematic representation of an example of an uncreped through-air-drying papermaking process for making a sanitary tissue product according to the present invention.

Another example of a suitable papermaking process for making the sanitary tissue products of the present invention is illustrated in FIG. 10. FIG. 10 illustrates an uncreped through-air-drying process. In this example, a multi-layered headbox 74 deposits an aqueous suspension of papermaking fibers between forming wires 76 and 78 to form an embryonic fibrous structure 80. The embryonic fibrous structure 80 is transferred to a slower moving transfer fabric 82 with the aid of at least one vacuum box 84. The level of vacuum used for the fibrous structure transfers can be from about 3 to about 15 inches of mercury (76 to about 381 millimeters of mercury). The vacuum box 84 (negative pressure) can be supplemented or replaced by the use of positive pressure from the opposite side of the embryonic fibrous structure 80 to blow the embryonic fibrous structure 80 onto the next fabric in addition to or as a replacement for sucking it onto the next fabric with vacuum. Also, a vacuum roll or rolls can be used to replace the vacuum box(es) 84.

The embryonic fibrous structure 80 is then transferred to a molding member 10 of the present invention, such as a through-air-drying fabric, and passed over through-air-dryers 86 and 88 to dry the embryonic fibrous structure 80 to form a 3D patterned fibrous structure 90. While supported by the molding member 10, the 3D patterned fibrous structure 90 is finally dried to a consistency of about 94% percent or greater. After drying, the 3D patterned fibrous structure 90 is transferred from the molding member 10 to fabric 92 and thereafter briefly sandwiched between fabrics 92 and 94. The dried 3D patterned fibrous structure 90 remains with fabric 94 until it is wound up at the reel 96 ("parent roll") as a finished fibrous structure. Thereafter, the finished 3D patterned fibrous structure 90 can be unwound, calendered and converted into the sanitary tissue product of the present invention, such as a roll of bath tissue, in any suitable manner.

Figure 11:
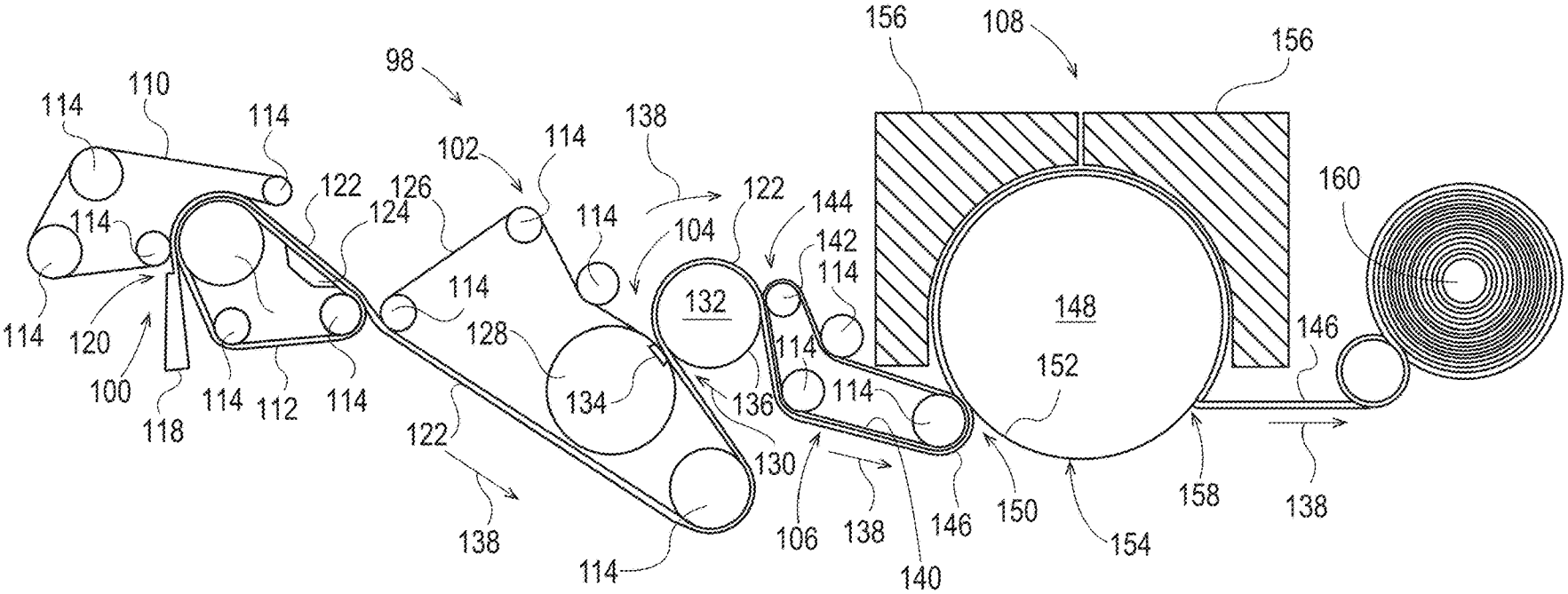
FIG. 11 is a schematic representation of an example of fabric creped papermaking process for making a sanitary tissue product according to the present invention.

Yet another example of a suitable papermaking process for making the sanitary tissue products of the present invention is illustrated in FIG. 11. FIG. 11 illustrates a papermaking machine 98 having a conventional twin wire forming section 100, a felt run section 102, a shoe press section 104, a molding member section 106, in this case a creping fabric section, and a Yankee dryer section 108 suitable for practicing the present invention. Forming section 100 includes a pair of forming fabrics 110 and 112 supported by a plurality of rolls 114 and a forming roll 116. A headbox 118 provides papermaking furnish to a nip 120 between forming roll 116 and roll 114 and the fabrics 110 and 112. The furnish forms an embryonic fibrous structure 122 which is dewatered on the fabrics 110 and 112 with the assistance of vacuum, for example, by way of vacuum box 124.

The embryonic fibrous structure 122 is advanced to a papermaking felt 126 which is supported by a plurality of rolls 114 and the felt 126 is in contact with a shoe press roll 128. The embryonic fibrous structure 122 is of low consistency as it is transferred to the felt 126. Transfer may be assisted by vacuum; such as by a vacuum roll if so desired or a pickup or vacuum shoe as is known in the art. As the embryonic fibrous structure 122 reaches the shoe press roll 128 it may have a consistency of 10-25% as it enters the shoe press nip 130 between shoe press roll 128 and transfer roll 132. Transfer roll 132 may be a heated roll if so desired. Instead of a shoe press roll 128, it could be a conventional suction pressure roll. If a shoe press roll 128 is employed it is desirable that roll 114 immediately prior to the shoe press roll 128 is a vacuum roll effective to remove water from the felt 126 prior to the felt 126 entering the shoe press nip 130 since water from the furnish will be pressed into the felt 126 in the shoe press nip 130. In any case, using a vacuum roll at the roll 114 is typically desirable to ensure the embryonic fibrous structure 122 remains in contact with the felt 126 during the direction change as one of skill in the art will appreciate from the diagram.

The embryonic fibrous structure 122 is wet-pressed on the felt 126 in the shoe press nip 130 with the assistance of pressure shoe 134. The embryonic fibrous structure 122 is thus compactively dewatered at the shoe press nip 130, typically by increasing the consistency by 15 or more points at this stage of the process. The configuration shown at shoe press nip 130 is generally termed a shoe press; in connection with the present invention transfer roll 132 is operative as a transfer cylinder which operates to convey embryonic fibrous structure 122 at high speed, typically 1000 feet/minute (fpm) to 6000 fpm to the patterned molding member section 106 of the present invention, for example a creping fabric section.

Transfer roll 132 has a smooth transfer roll surface 136 which may be provided with adhesive and/or release agents if needed. Embryonic fibrous structure 122 is adhered to transfer roll surface 136 which is rotating at a high angular velocity as the embryonic fibrous structure 122 continues to advance in the machine-direction indicated by arrows 138. On the transfer roll 132, embryonic fibrous structure 122 has a generally random apparent distribution of fiber.

Embryonic fibrous structure 122 enters shoe press nip 130 typically at consistencies of 10-25% and is dewatered and dried to consistencies of from about 25 to about 70% by the time it is transferred to the molding member 140 according to the present invention, which in this case is a patterned creping fabric, as shown in the diagram.

Molding member 140 is supported on a plurality of rolls 114 and a press nip roll 142 and forms a molding member nip 144, for example fabric crepe nip, with transfer roll 132 as shown.

The molding member 140 defines a creping nip over the distance in which molding member 140 is adapted to contact transfer roll 132; that is, applies significant pressure to the embryonic fibrous structure 122 against the transfer roll 132. To this end, backing (or creping) press nip roll 142 may be provided with a soft deformable surface which will increase the length of the creping nip and increase the fabric creping angle between the molding member 140 and the embryonic fibrous structure 122 and the point of contact or a shoe press roll could be used as press nip roll 142 to increase effective contact with the embryonic fibrous structure 122 in high impact molding member nip 144 where embryonic fibrous structure 122 is transferred to molding member 140 and advanced in the machine-direction 138. By using different equipment at the molding member nip 144, it is possible to adjust the fabric creping angle or the takeaway angle from the molding member nip 144. Thus, it is possible to influence the nature and amount of redistribution of fiber, delamination/debonding which may occur at molding member nip 144 by adjusting these nip parameters. In some embodiments it may by desirable to restructure the z-direction interfiber characteristics while in other cases it may be desired to influence properties only in the plane of the fibrous structure. The molding member nip parameters can influence the distribution of fiber in the fibrous structure in a variety of directions, including inducing changes in the z-direction as well as the MD and CD. In any case, the transfer from the transfer roll to the molding member is high impact in that the fabric is traveling slower than the fibrous structure and a significant velocity change occurs. Typically, the fibrous structure is creped anywhere from 10-60% and even higher during transfer from the transfer roll to the molding member.

Molding member nip 144 generally extends over a molding member nip distance of anywhere from about ⅛" to about 2", typically ½" to 2". For a molding member 140, for example creping fabric, with 32 CD strands per inch, embryonic fibrous structure 122 thus will encounter anywhere from about 4 to 64 weft filaments in the molding member nip 144.

The nip pressure in molding member nip 144, that is, the loading between roll 142 and transfer roll 132 is suitably 20-100 pounds per linear inch (PLI).

After passing through the molding member nip 144, and for example fabric creping the embryonic fibrous structure 122, a 3D patterned fibrous structure 146 continues to advance along MD 138 where it is wet-pressed onto Yankee cylinder (dryer) 148 in transfer nip 150. Transfer at nip 150 occurs at a 3D patterned fibrous structure 146 consistency of generally from about 25 to about 70%. At these consistencies, it is difficult to adhere the 3D patterned fibrous structure 146 to the Yankee cylinder surface 152 firmly enough to remove the 3D patterned fibrous structure 146 from the molding member 140 thoroughly. This aspect of the process is important, particularly when it is desired to use a high velocity drying hood as well as maintain high impact creping conditions.

In this connection, it is noted that conventional TAD processes do not employ high velocity hoods since sufficient adhesion to the Yankee dryer is not achieved.

It has been found in accordance with the present invention that the use of particular adhesives cooperate with a moderately moist fibrous structure (25-70% consistency) to adhere it to the Yankee dryer sufficiently to allow for high velocity operation of the system and high jet velocity impingement air drying. In this connection, a poly(vinyl alcohol)/polyamide adhesive composition as noted above is applied at 154 as needed.

The 3D patterned fibrous structure is dried on Yankee cylinder 148 which is a heated cylinder and by high jet velocity impingement air in Yankee hood 156. As the Yankee cylinder 148 rotates, 3D patterned fibrous structure 146 is creped from the Yankee cylinder 148 by creping doctor blade 158 and wound on a take-up roll 160. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes affected by the use of the undulatory blade tend to correlate with improved softness perception of the tissue products.

When a wet-crepe process is employed, an impingement air dryer, a through-air dryer, or a plurality of can dryers can be used instead of a Yankee. Impingement air dryers are disclosed in the following patents and applications, the disclosure of which is incorporated herein by reference: U.S. Pat. No. 5,865,955 of Ilvespaaet et al. U.S. Pat. No. 5,968,590 of Ahonen et al. U.S. Pat. No. 6,001,421 of Ahonen et al. U.S. Pat. No. 6,119,362 of Sundqvist et al. U.S. patent application Ser. No. 09/733,172, entitled Wet Crepe, Impingement-Air Dry Process for Making Absorbent Sheet, now U.S. Pat. No. 6,432,267. A throughdrying unit as is well known in the art and described in U.S. Pat. No. 3,432,936 to Cole et al., the disclosure of which is incorporated herein by reference as is U.S. Pat. No. 5,851,353 which discloses a can-drying system.

Figure 12:
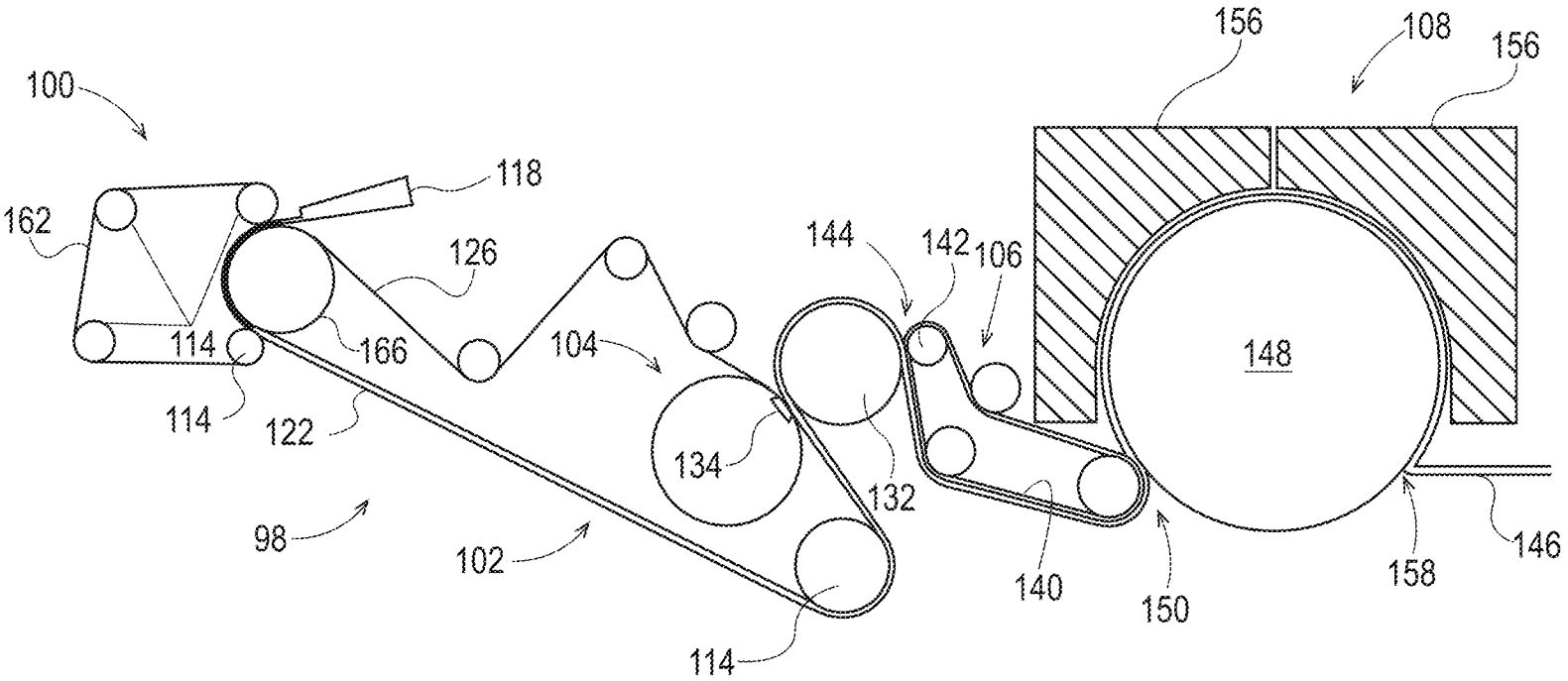
FIG. 12 is a schematic representation of another example of a fabric creped papermaking process for making a sanitary tissue product according to the present invention.

There is shown in FIG. 12 a papermaking machine 98, similar to FIG. 11, for use in connection with the present invention. Papermaking machine 98 is a three fabric loop machine having a forming section 100 generally referred to in the art as a crescent former. Forming section 100 includes a forming wire 162 supported by a plurality of rolls such as rolls 114. The forming section 100 also includes a forming roll 166 which supports paper making felt 126 such that embryonic fibrous structure 122 is formed directly on the felt 126. Felt run 102 extends to a shoe press section 104 wherein the moist embryonic fibrous structure 122 is deposited on a transfer roll 132 (also referred to sometimes as a backing roll) as described above. Thereafter, embryonic fibrous structure 122 is creped onto molding member 140, such as a crepe fabric, in molding member nip 144 before being deposited on Yankee dryer 148 in another press nip 150. The papermaking machine 98 may include a vacuum turning roll, in some embodiments; however, the three loop system may be configured in a variety of ways wherein a turning roll is not necessary. This feature is particularly important in connection with the rebuild of a papermachine inasmuch as the expense of relocating associated equipment i.e. pulping or fiber processing equipment and/or the large and expensive drying equipment such as the Yankee dryer or plurality of can dryers would make a rebuild prohibitively expensive unless the improvements could be configured to be compatible with the existing facility.

Figure 13:
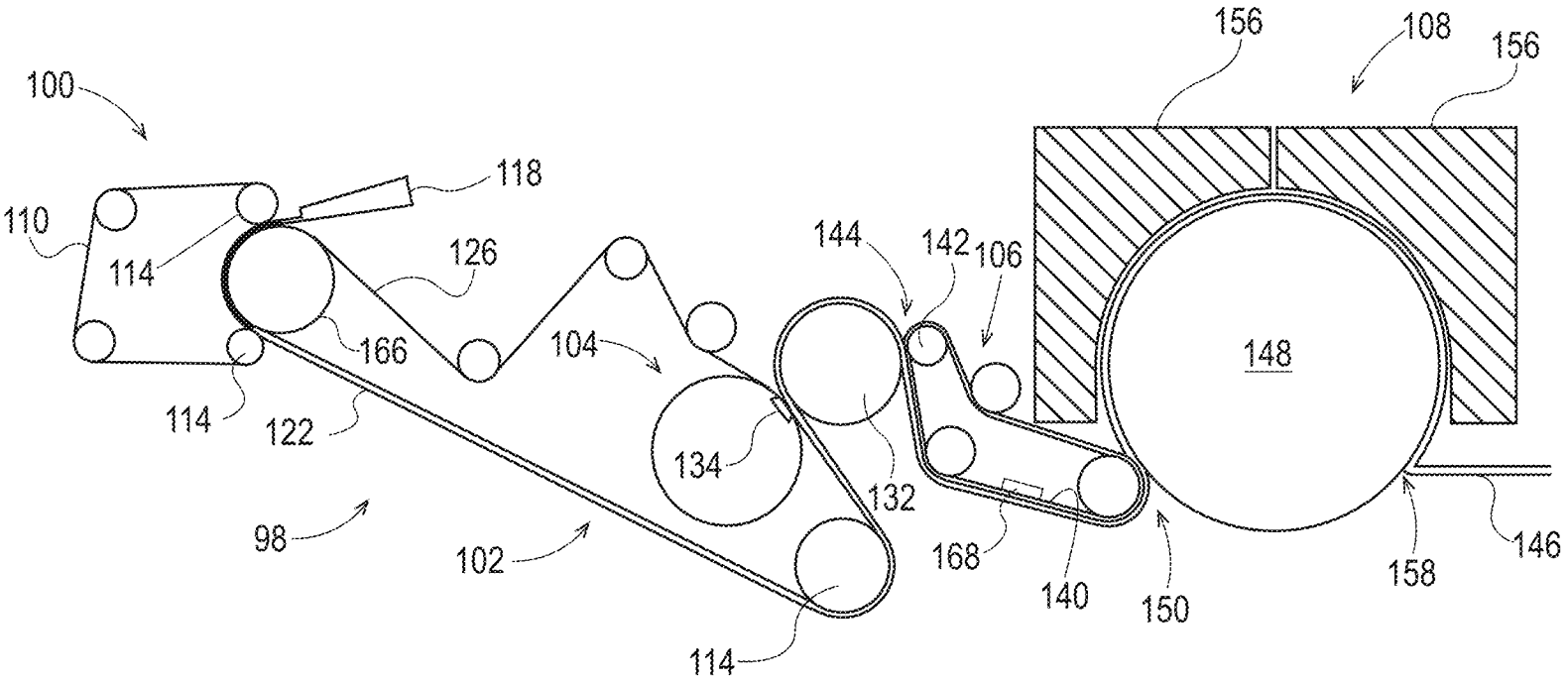
FIG. 13 is a schematic representation of an example of belt creped papermaking process for making a sanitary tissue product according to the present invention.

FIG. 13 shows another example of a suitable papermaking process to make the sanitary tissue products of the present invention. FIG. 13 illustrates a papermaking machine 98 for use in connection with the present invention. Papermaking machine 98 is a three fabric loop machine having a forming section 100, generally referred to in the art as a crescent former. Forming section 100 includes headbox 118 depositing a furnish on forming wire 110 supported by a plurality of rolls 114. The forming section 100 also includes a forming roll 166, which supports papermaking felt 126, such that embryonic fibrous structure 122 is formed directly on felt 126. Felt run 102 extends to a shoe press section 104 wherein the moist embryonic fibrous structure 122 is deposited on a transfer roll 132 and wet-pressed concurrently with the transfer. Thereafter, embryonic fibrous structure 122 is transferred to the molding member section 106, by being transferred to and/or creped onto molding member 140 of the present invention in molding member nip 144, for example belt crepe nip, before being optionally vacuum drawn by suction box 168 and then deposited on Yankee dryer 148 in another press nip 150 using a creping adhesive, as noted above. Transfer to a Yankee dryer from the creping belt differs from conventional transfers in a conventional wet press (CWP) from a felt to a Yankee. In a CWP process, pressures in the transfer nip may be 500 PLI (87.6 kN/meter) or so, and the pressured contact area between the Yankee surface and the fibrous structure is close to or at 100%. The press roll may be a suction roll which may have a P&J hardness of 25-30. On the other hand, a belt crepe process of the present invention typically involves transfer to a Yankee with 4-40% pressured contact area between the fibrous structure and the Yankee surface at a pressure of 250-350 PLI (43.8-61.3 kN/meter). No suction is applied in the transfer nip, and a softer pressure roll is used, P&J hardness 35-45. The papermaking machine may include a suction roll, in some embodiments; however, the three loop system may be configured in a variety of ways wherein a turning roll is not necessary. This feature is particularly important in connection with the rebuild of a papermachine inasmuch as the expense of relocating associated equipment, i.e., the headbox, pulping or fiber processing equipment and/or the large and expensive drying equipment, such as the Yankee dryer or plurality of can dryers, would make a rebuild prohibitively expensive, unless the improvements could be configured to be compatible with the existing facility.

Non-Limiting Examples of Methods for Making Sanitary Tissue Products

Example 1—Through-Air-Drying Belt

The following Example illustrates a non-limiting example for a preparation of a sanitary tissue product comprising a fibrous structure according to the present invention on a pilot-scale Fourdrinier fibrous structure making (papermaking) machine.

An aqueous slurry of *eucalyptus* (Fibria Brazilian bleached hardwood kraft pulp) pulp fibers is prepared at about 3% fiber by weight using a conventional repulper, then transferred to a hardwood fiber stock chest. The *eucalyptus* fiber slurry of the hardwood stock chest is pumped through a stock pipe to a hardwood fan pump where the slurry consistency is reduced from about 3% by fiber weight to about 0.15% by fiber weight. The 0.15% *eucalyptus* slurry is then pumped and distributed in the top and bottom chambers of a multi-layered, three-chambered headbox of a Fourdrinier wet-laid papermaking machine.

Additionally, an aqueous slurry of *eucalyptus* (Fibria Brazilian bleached hardwood kraft pulp) pulp fibers is prepared at about 1.5% fiber by weight using a conventional repulper, then transferred to a hardwood fiber stock chest. The *eucalyptus* fiber slurry of the hardwood stock chest is pumped through a stock pipe and mixed with the aqueous slurry of Northern Softwood Kraft (NSK), described in the next paragraph, to a fan pump where the slurry consistency is reduced from about 1.5% by fiber weight to about 0.15% by fiber weight. The 0.15% *eucalyptus*/NSK slurry is then pumped and distributed in the center chamber of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then mixed with the 1.5% aqueous slurry of *Eucalyptus* fibers (described in the preceding paragraph) and directed to a fan pump where the NSK slurry consistency is reduced from about 3% by fiber weight to about 0.15% by fiber weight. The 0.15% *Eucalyptus*/NSK slurry is then directed and distributed to the center chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The *eucalyptus* fiber slurry of 0.15% consistency is directed to the top headbox chamber and bottom headbox chamber. The NSK/*Eucalyptus* fiber slurry is directed to the center headbox chamber. All three fiber layers are delivered simultaneously in superposed relation onto the Fourdrinier wire to form thereon a three-layer embryonic fibrous structure (web), of which about 40% of the top side is made up of the *eucalyptus* fibers, about 15% is made of the *eucalyptus* fibers on the bottom side, about 40% is made up of the NSK fibers in the center, and about 5% is made up of the *eucalyptus* fiber in the center. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

The embryonic wet fibrous structure is transferred from the Fourdrinier wire, at a fiber consistency of about 18-22% at the point of transfer, to a 3D patterned, discrete knuckle, through-air-drying belt (patterned molding member) as shown in FIGS. 6A and 6B. The speed of the 3D patterned through-air-drying belt is 800 feet per minute (fpm), which is the same speed of the Fourdrinier wire. The 3D patterned through-air-drying belt is designed to yield a fibrous structure as shown in FIG. 6C comprising a pattern of discrete high density knuckle regions oriented approximately 75° relative to the CD. Each discrete high density knuckle region oriented approximately 75° relative to the CD is separated by a low density continuous pillow region oriented approximately 75° relative to the CD. This 3D patterned through-air-drying belt is formed by casting a layer of an impervious resin surface of discrete knuckles onto a fiber mesh supporting fabric similar to that shown in Prior Art FIG. 1B. The supporting fabric is a 98×52 filament, dual layer fine mesh. The thickness of the resin cast is about 12.5 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 78% polyvinyl alcohol (PVA 88-44), about 22% UNICREPE® 457T20. UNICREPE® 457T20 is commercially available from GP Chemicals. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 640 fpm.

Two parent rolls of the fibrous structure are then converted into a sanitary tissue product by loading the roll of fibrous structure into an unwind stand. The two parent rolls are converted with the low density pillow side out. The line speed is 550 ft/min. One parent roll of the fibrous structure is unwound and transported to an emboss stand where the fibrous structure is strained to form the emboss pattern in the fibrous structure via a 0.56" Pressure Roll Nip and then combined with the fibrous structure from the other parent roll to make a multi-ply (2-ply) sanitary tissue product. Approximately 0.75% of a proprietary quaternary amine softener is added to the top side only of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the properties shown in Table 1 above.

Example 2—Through-Air-Drying Belt

The following Example illustrates a non-limiting example for a preparation of a sanitary tissue product comprising a fibrous structure according to the present invention on a pilot-scale Fourdrinier fibrous structure making (papermaking) machine.

An aqueous slurry of *eucalyptus* (Fibria Brazilian bleached hardwood kraft pulp) pulp fibers is prepared at about 3% fiber by weight using a conventional repulper, then transferred to a hardwood fiber stock chest. The *eucalyptus* fiber slurry of the hardwood stock chest is pumped through a stock pipe to a hardwood fan pump where the slurry consistency is reduced from about 3% by fiber weight to about 0.15% by fiber weight. The 0.15% *eucalyptus* slurry is then pumped and distributed in the top, center, and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then directed to a fan pump where the NSK slurry consistency is reduced from about 3% by fiber weight to about 0.15% by fiber weight. The 0.15% NSK slurry is then directed and distributed to the center and bottom chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.25% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The *eucalyptus* fiber slurry of 0.15% consistency is directed to the top headbox chamber, center headbox chamber, and bottom headbox chamber. The NSK fiber slurry is directed to the center headbox chamber and bottom headbox chamber. All three fiber layers are delivered simultaneously in superposed relation onto the Fourdrinier wire to form thereon a three-layer embryonic fibrous structure (web), of which about 50% of the top side is made up of the *eucalyptus* fibers, about 5.5% is made of the *eucalyptus* fibers in the center, about 5.5% is made up of the *eucalyptus* fibers on the bottom side, about 19.5% is made up of the NSK fibers in the center, and about 19.5% is made up of the NSK fibers on the bottom side. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 825 feet per minute (fpm).

The embryonic wet fibrous structure is transferred from the Fourdrinier wire, at a fiber consistency of about 15-19% at the point of transfer, to a 3D patterned, semi-continuous knuckle, through-air-drying belt (patterned molding member) as shown in FIGS. 7A and 7B. The speed of the 3D patterned through-air-drying belt is 800 feet per minute (fpm), which is about 3% slower speed compared to the Fourdrinier wire. The 3D patterned through-air-drying belt is designed to yield a fibrous structure as shown in FIGS. 7C and 7D comprising a pattern of semi-continuous high density knuckle regions oriented predominantly in the machine direction. Each semi-continuous high density knuckle region oriented predominantly in the machine direction is separated by a low density continuous pillow region oriented predominantly in the machine direction. This 3D patterned through-air-drying belt is formed by casting a layer of an impervious resin surface of semi-continuous knuckles onto a fiber mesh supporting fabric similar to that shown in Prior Art FIG. 1B. The supporting fabric is a 98×52 filament, dual layer fine mesh. The thickness of the resin cast is about 12 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 78% polyvinyl alcohol (PVA 88-44), about 22% UNICREPE® 457T20. UNICREPE® 457T20 is commercially available from GP Chemicals. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade. The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 629 fpm.

Two parent rolls of the fibrous structure are then converted into a sanitary tissue product by loading the roll of fibrous structure into an unwind stand. The two parent rolls are converted with the low density pillow side out. The line speed is 560 ft/min. One parent roll of the fibrous structure is unwound and transported to an emboss stand where the fibrous structure is strained to form the emboss pattern in the fibrous structure via a 0.56" Pressure Roll Nip and then combined with the fibrous structure from the other parent roll to make a multi-ply (2-ply) sanitary tissue product. Approximately 0.75% of a proprietary quaternary amine softener is added to the top side only of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the properties shown in Table 1 above.

Example 3—Through-Air-Drying Belt

The following Example illustrates a non-limiting example for a preparation of a sanitary tissue product comprising a fibrous structure according to the present invention on a pilot-scale Fourdrinier fibrous structure making (papermaking) machine.

An aqueous slurry of *eucalyptus* (Fibria Brazilian bleached hardwood kraft pulp) pulp fibers is prepared at about 3% fiber by weight using a conventional repulper, then transferred to a hardwood fiber stock chest. The *eucalyptus* fiber slurry of the hardwood stock chest is pumped through a stock pipe to a hardwood fan pump where the slurry consistency is reduced from about 3% by fiber weight to about 0.15% by fiber weight. The 0.15% *eucalyptus* slurry is then pumped and distributed in the top and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then directed to a fan pump where the NSK slurry consistency is reduced from about 3% by fiber weight to about 0.15% by fiber weight. The 0.15% NSK slurry is then directed and distributed to the center chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.17% temporary wet strengthening additive based on the dry weight of the NSK fibers and is added to the *eucalyptus* fiber stock pipe at a rate sufficient to deliver 0.1% temporary wet strengthening additive based on the dry weight of the *Eucalyptus* fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The *eucalyptus* fiber slurry of 0.15% consistency is directed to the top headbox chamber and bottom headbox chamber. The NSK fiber slurry is directed to the center headbox chamber. All three fiber layers are delivered simultaneously in superposed relation onto the Fourdrinier wire to form thereon a three-layer embryonic fibrous structure (web), of which about 35% of the top side is made up of the *eucalyptus* fibers, about 19% is made of the *eucalyptus* fibers on the bottom side, and about 46% is made up of the NSK fibers in the center. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

The embryonic wet fibrous structure is transferred from the Fourdrinier wire, at a fiber consistency of about 18-22% at the point of transfer, to a 3D patterned, discrete knuckle, through-air-drying belt (patterned molding member) as shown in FIGS. 7A and 7B. The speed of the 3D patterned through-air-drying belt is 800 feet per minute (fpm), which is the same speed of the Fourdrinier wire. The 3D patterned through-air-drying belt is designed to yield a fibrous structure as shown in FIGS. 7C and 7D comprising a pattern of discrete high density knuckle regions oriented approximately 60° relative to CD. Each discrete high density knuckle region oriented approximately 60° relative to CD is separated by a low density continuous pillow region oriented approximately 60° relative to CD. This 3D patterned through-air-drying belt is formed by casting a layer of an impervious resin surface of discrete knuckles onto a fiber mesh supporting fabric similar to that shown in Prior Art FIG. 1B. The supporting fabric is a 98×52 filament, dual layer fine mesh. The thickness of the resin cast is about 11.5 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 78% polyvinyl alcohol (PVA 88-44), about 22% UNICREPE® 457T20. UNICREPE® 457T20 is commercially available from GP Chemicals. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 647 fpm.

Two parent rolls of the fibrous structure are then converted into a sanitary tissue product by loading the roll of fibrous structure into an unwind stand. The two parent rolls are converted with the low density pillow side out. The line speed is 750 ft/min. One parent roll of the fibrous structure is unwound and transported to an emboss stand where the fibrous structure is strained to form the emboss pattern in the fibrous structure via a 0.51" Pressure Roll Nip and then combined with the fibrous structure from the other parent roll to make a multi-ply (2-ply) sanitary tissue product. Approximately 0.5% of a proprietary quaternary amine softener is added to the top side only of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the properties shown in Table 1 above.

Comparative Example 1 (Comparative to Example 2)

The following Example illustrates a non-limiting example for a preparation of a sanitary tissue product comprising a semi-continuous knuckle, wire side out (WSO), 85° knuckle orientation relative to CD fibrous structure on a pilot-scale Fourdrinier fibrous structure making (papermaking) machine.

An aqueous slurry of *eucalyptus* (Fibria Brazilian bleached hardwood kraft pulp) pulp fibers is prepared at about 3% fiber by weight using a conventional repulper, then transferred to a hardwood fiber stock chest. The *eucalyptus* fiber slurry of the hardwood stock chest is pumped through a stock pipe to a hardwood fan pump where the slurry consistency is reduced from about 3% by fiber weight to about 0.15% by fiber weight. The 0.15% *eucalyptus* slurry is then pumped and distributed in the top, center, and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then mixed with the 1.5% aqueous slurry of *Eucalyptus* fibers (described in the preceding paragraph) and directed to a fan pump where the NSK slurry consistency is reduced from about 3% by fiber weight to about 0.15% by fiber weight. The 0.15% NSK slurry is then directed and distributed to the top and center chambers of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.17% temporary wet strengthening additive based on the dry weight of the NSK fibers. The absorption of the temporary wet strengthening additive is enhanced by passing the treated slurry through an in-line mixer.

In order to impart temporary wet strength to the finished fibrous structure, a 1% dispersion of temporary wet strengthening additive (e.g., Fennorez® 91 commercially available from Kemira) is prepared and is added to the Euc fiber stock pipe at a rate sufficient to deliver 0.14% temporary wet strengthening additive based on the dry weight of the Euc fibers in the bottom chamber of the headbox. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The *eucalyptus* fiber slurry of 0.15% consistency is directed to the top headbox chamber, center headbox chamber, and bottom headbox chamber. The NSK fiber slurry is directed to the center and top headbox chambers. All three fiber layers are delivered simultaneously in superposed relation onto the Fourdrinier wire to form thereon a three-layer embryonic fibrous structure (web), of which about 35% of the sheet is made up of the *eucalyptus* fibers in the bottom headbox chamber, about 21.5% is made of the NSK fibers in the center layer, about 11% is made up of the Euc fibers in the center layer, about 21.5% is made up of the NSK fibers in the top layer, and about 11% is made up of the Euc fibers in the top layer. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

The embryonic wet fibrous structure is transferred from the Fourdrinier wire, at a fiber consistency of about 14-25% at the point of transfer, to a 3D patterned, discrete knuckle, through-air-drying belt (patterned molding member) as shown in FIGS. 8A and 8B. The speed of the 3D patterned through-air-drying belt is 800 feet per minute (fpm), which is the same speed of the Fourdrinier wire. The 3D patterned through-air-drying belt is designed to yield a fibrous structure as shown in FIGS. 8C and 8D comprising a pattern of semi-continuous high density knuckle regions oriented approximately 85° relative to CD. Each discrete high density knuckle region oriented approximately 85° relative to CD is separated by a low density semi-continuous pillow region oriented approximately 85° relative to CD. This 3D patterned through-air-drying belt is formed by casting a layer of an impervious resin surface of discrete knuckles onto a fiber mesh supporting fabric similar to that shown in Prior Art FIG. 1B. The supporting fabric is a 98×52 filament, dual layer fine mesh. The thickness of the resin cast is about 12.0 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-70% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 78% polyvinyl alcohol (PVA 88-44), about 22% UNICREPE® 457T20. UNICREPE® 457T20 is commercially available from GP Chemicals. The creping adhesive is delivered to the Yankee surface at a rate of about 0.10-0.20% adhesive solids based on the dry weight of the fibrous structure. The fiber consistency is increased to about 96-98% before the fibrous structure is dry-creped from the Yankee with a doctor blade. The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 632 fpm.

Two parent rolls of the fibrous structure are then converted into a sanitary tissue product by loading the roll of fibrous structure into an unwind stand. The two parent rolls are converted with the high density knuckle side out, which is the wire side out (WSO). The line speed is 550-600 ft/min. One parent roll of the fibrous structure is unwound and transported to an emboss stand where the fibrous structure is strained to form the emboss pattern in the fibrous structure via a 0.56" Pressure Roll Nip and then combined with the fibrous structure from the other parent roll to make a multi-ply (2-ply) sanitary tissue product. Approximately 0.25% of a proprietary quaternary amine softener is added to the top side only of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the properties shown in Table 1 above.

Comparative Example 2

The following Example illustrates a non-limiting example for a preparation of a sanitary tissue product comprising a continuous knuckle, fabric side out (FSO), various angle knuckle relative to CD fibrous structure on a full-scale Fourdrinier fibrous structure making (papermaking) machine.

An aqueous slurry of *eucalyptus* (Fibria Brazilian bleached hardwood kraft pulp) pulp fibers is prepared at about 3-6% fiber by weight using a conventional repulper, then transferred to a hardwood fiber stock chest. The *eucalyptus* fiber slurry of the hardwood stock chest is pumped through a stock pipe to an additional Hardwood stock check and then to a hardwood fan pump where the slurry consistency is reduced from about 3% by fiber weight to about 0.15% by fiber weight. The 0.15% *eucalyptus* slurry is then pumped and distributed in the Fabric-side chamber and Wire-Side chamber of a multi-layered, three-chambered headbox of a Fourdrinier wet-laid papermaking machine.

Additionally, an aqueous slurry of NSK (Northern Softwood Kraft) pulp fibers is prepared at about 3-6% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is directed to a Mix Tank, where it is mixed with a Broke stream (described in the paragraph below). The refined NSK fiber slurry is directed to a fan pump where the NSK slurry consistency is reduced from about 3% by fiber weight to about 0.15% by fiber weight. The 0.15% NSK slurry is then directed and distributed to the center chamber of a multi-layered, three-chambered headbox of a Fourdrinier wet-laid papermaking machine.

Additionally, an aqueous slurry of a mixture of *Eucalyptus* and NSK fibers that have been reprocessed from scrap Charmin is prepared at about 3-6% fiber by weight using a conventional repulper, then transferred to a Broke storage chest. The Broke fiber slurry is then directed to a Mix Tank where it is mixed with the refined NSK referenced in the paragraph above. The Broke fiber slurry is directed to a fan pump where the Broke slurry consistency is reduced from about 3% by fiber weight to about 0.15% by fiber weight. The 0.15% Broke slurry is then directed and distributed to the center chamber of a multi-layered three-chambered headbox of a Fourdrinier wet-laid papermaking machine.

In order to impart temporary wet strength to the finished fibrous structure, a 1% dispersion of temporary wet strengthening additive (e.g., Parez® 750C commercially available from Kemira) is prepared and is added to the combined NSK/Broke fiber stock pipe coming out of the Mix Tank referenced in the preceding two paragraphs at a rate sufficient to deliver 0.8%-2.5 temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The *eucalyptus* fiber slurry of 0.15% consistency is directed to the top headbox chamber and bottom headbox chamber. The NSK fiber and Broke fiber slurry is directed to the center headbox chamber. All three fiber layers are delivered simultaneously in superposed relation onto the Fourdrinier wire to form thereon a three-layer embryonic fibrous structure (web), of which about 20-40% of the sheet is made up of the *eucalyptus* fibers in the fabric-layer headbox chamber, about 20-40% is made of the NSK fibers in the center layer, and about 20-40% is made up of the Euc fibers in the wire layer. Dewatering occurs through the Fourdrinier wire and is assisted by a deflector and wire table vacuum boxes. The Fourdrinier wire is a 84M (84 by 76 5A, Albany International). The speed of the Fourdrinier wire is about 2800-4000 feet per minute (fpm).

Figure 14:
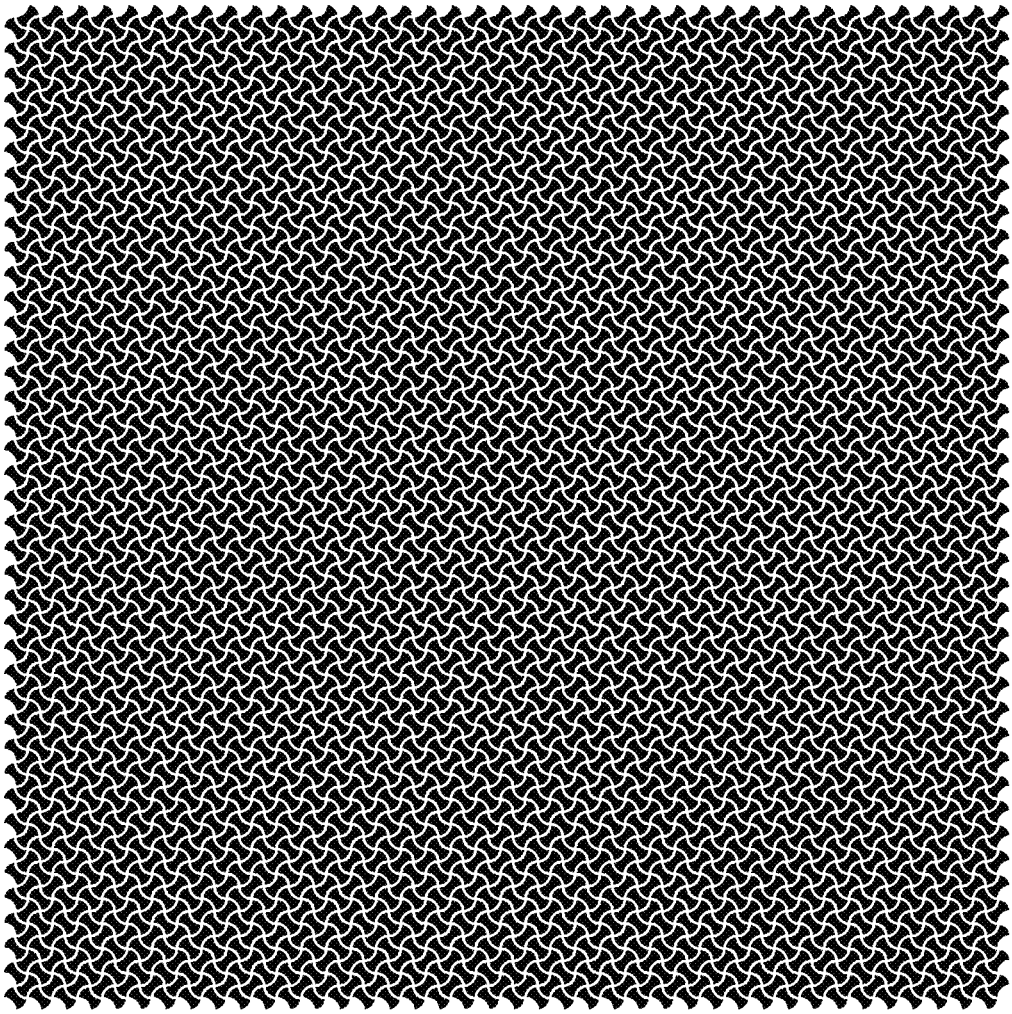
Fig. 14 PRIOR ART
FIG. 14 is a schematic representation of an example of a prior art molding member.

The embryonic wet fibrous structure is transferred from the Fourdrinier wire, at a fiber consistency of about 14-25% at the point of transfer, to a 3D patterned, discrete knuckle, through-air-drying belt (patterned molding member) as shown in FIG. 14. The speed of the 3D patterned through-air-drying belt is 2800-4000 feet per minute (fpm), which is the same speed of the Fourdrinier wire. The 3D patterned through-air-drying belt is designed to yield a fibrous structure comprising a pattern of continuous high density knuckle regions that vary in their angle relative to the cross direction. Each continuous high density knuckle region that vary in their angle relative to the cross direction is separated by a low density discrete pillow region oriented that vary in their angle relative to the cross direction. This 3D patterned through-air-drying belt is formed by casting a layer of an impervious resin surface of discrete knuckles onto a fiber mesh supporting fabric similar to that shown in Prior Art FIG. 1B. The supporting fabric is a 98×52 filament, dual layer fine mesh. The thickness of the resin cast is about 12.0 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-70% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 90% polyvinyl alcohol (PVA 88-44), about 10% Crepertrol® 6115. Crepetrol® 6115 is commercially available from Hercules Inc. The creping adhesive is delivered to the Yankee surface at a rate of about 0.10-0.20% adhesive solids based on the dry weight of the fibrous structure. The fiber consistency is increased to about 94-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 2800-4000 fpm. Approximately 1.0% of a proprietary quaternary amine softener is sprayed onto the sheet, therefore being added to both sides of a 2 ply sheet. The fibrous structure is wound in a roll (parent roll) using a surface driven reel drum having a surface speed of about 2200-3400 fpm.

Two parent rolls of the fibrous structure are then converted into a sanitary tissue product by loading the roll of fibrous structure into an unwind stand. The two parent rolls are converted with the low density pillow side out. The line speed is 750-1500 ft/min. Both parent roll of the fibrous structure are unwound and transported to a combiner where the fibrous structure is combined with a hot-melt adhesive to make a multi-ply (2-ply) sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the properties shown in Table 1 above.

Comparative Example 3 (Comparative to Examples 1 and 3)

The following Example illustrates a non-limiting example for a preparation of a sanitary tissue product comprising a fibrous structure according to the present invention on a pilot-scale Fourdrinier fibrous structure making (papermaking) machine.

An aqueous slurry of *eucalyptus* (Fibria Brazilian bleached hardwood kraft pulp) pulp fibers is prepared at about 3% fiber by weight using a conventional repulper, then transferred to the hardwood fiber stock chest. The *eucalyptus* fiber slurry of the hardwood stock chest is pumped through a stock pipe to a hardwood fan pump where the slurry consistency is reduced from about 3% by fiber weight to about 0.15% by fiber weight. The 0.15% *eucalyptus* slurry is then pumped and equally distributed in the top and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then directed to the NSK fan pump where the NSK slurry consistency is reduced from about 3% by fiber weight to about 0.15% by fiber weight. The 0.15% *eucalyptus* slurry is then directed and distributed to the center chamber of a multi-layered, three-chambered headbox of a Fourdrinier wet-laid papermaking machine.

The wet-laid papermaking machine has a layered headbox having a top chamber, a center chamber, and a bottom chamber where the chambers feed directly onto the forming wire (Fourdrinier wire). The *eucalyptus* fiber slurry of 0.15% consistency is directed to the top headbox chamber and bottom headbox chamber. The NSK fiber slurry is directed to the center headbox chamber. All three fiber layers are delivered simultaneously in superposed relation onto the Fourdrinier wire to form thereon a three-layer embryonic fibrous structure (web), of which about 38% of the top side is made up of the *eucalyptus* fibers, about 38% is made of the *eucalyptus* fibers on the bottom side and about 24% is made up of the NSK fibers in the center. Dewatering occurs through the Fourdrinier wire and is assisted by a deflector and wire table vacuum boxes. The Fourdrinier wire is an 84M (84 by 76 5A, Albany International). The speed of the Fourdrinier wire is about 750 feet per minute (fpm).

The embryonic wet fibrous structure is transferred from the Fourdrinier wire, at a fiber consistency of about 15% at the point of transfer, to a 3D patterned through-air-drying belt (patterned molding member) as shown in Prior Art FIGS. 1A and 1B. The speed of the 3D patterned through-air-drying belt is the same as the speed of the Fourdrinier wire. The 3D patterned through-air-drying belt is designed to yield a fibrous structure as shown in Prior Art FIG. 2 comprising a pattern of discrete high density knuckle regions oriented at an angle of about 45° with respect to the CD and dispersed throughout a continuous low density pillow region. This 3D patterned through-air-drying belt is formed by casting an impervious resin surface onto a fiber mesh supporting fabric shown in FIG. 1B. The supporting fabric is a 98×52 filament, dual layer fine mesh. The thickness of the resin cast is about 11 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 53% by weight. After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-50), about 20% CREPETROL® 457T20. CREPETROL® 457T20 is commercially available from Hercules Incorporated of Wilmington, DE The creping adhesive is delivered to the Yankee surface at a rate of about 0.15% adhesive solids based on the dry weight of the fibrous structure. The fiber consistency is increased to about 97% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 757 fpm.

Two parent rolls of the fibrous structure are then converted into a sanitary tissue product by loading the roll of fibrous structure into an unwind stand. The line speed is 400 ft/min. One parent roll of the fibrous structure is unwound and transported to an emboss stand where the fibrous structure is strained to form the emboss pattern in the fibrous structure and then combined with the fibrous structure from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the properties shown in Table 1 above.

Comparative Example 4 (Comparative to Examples 1 and 3)

The following Example illustrates a non-limiting example for a preparation of a sanitary tissue product comprising a discrete knuckle, fabric side out (FSO), 45° knuckle relative to CD fibrous structure on a pilot-scale Fourdrinier fibrous structure making (papermaking) machine.

An aqueous slurry of *eucalyptus* (Fibria Brazilian bleached hardwood kraft pulp) pulp fibers is prepared at about 3% fiber by weight using a conventional repulper, then transferred to a hardwood fiber stock chest. The *eucalyptus* fiber slurry of the hardwood stock chest is pumped through a stock pipe to a hardwood fan pump where the slurry consistency is reduced from about 3% by fiber weight to about 0.15% by fiber weight. The 0.15% *eucalyptus* slurry is then pumped and distributed in the top and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is directed to a fan pump where the NSK slurry consistency is reduced from about 3% by fiber weight to about 0.15% by fiber weight. The 0.15% NSK slurry is then directed and distributed to the center chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.17% temporary wet strengthening additive based on the dry weight of the NSK fibers. The absorption of the temporary wet strengthening additive is enhanced by passing the treated slurry through an in-line mixer.

In order to impart temporary wet strength to the finished fibrous structure, a 1% dispersion of temporary wet strengthening additive (e.g., Fennorez® 91 commercially available from Kemira) is prepared and is added to the Euc fiber stock pipe at a rate sufficient to deliver 0.14% temporary wet strengthening additive based on the dry weight of the Euc fibers in the bottom chamber of the headbox. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The *eucalyptus* fiber slurry of 0.15% consistency is directed to the top headbox chamber and bottom headbox chamber. The NSK fiber slurry is directed to the center headbox chamber. All three fiber layers are delivered simultaneously in superposed relation onto the Fourdrinier wire to form thereon a three-layer embryonic fibrous structure (web), of which about 36.5% of the sheet is made up of the *eucalyptus* fibers in the top headbox chamber, about 47% is made of the NSK fibers in the center layer, and about 16.5% is made up of the Euc fibers in the top layer. Dewatering occurs through the Fourdrinier wire and is assisted by a deflector and wire table vacuum boxes. The Fourdrinier wire is a Legent 866A Dual Layer (0.11 mm×0.18 mm, Asten Johnson). The speed of the Fourdrinier wire is about 800 feet per minute (fpm).

Figure 15:
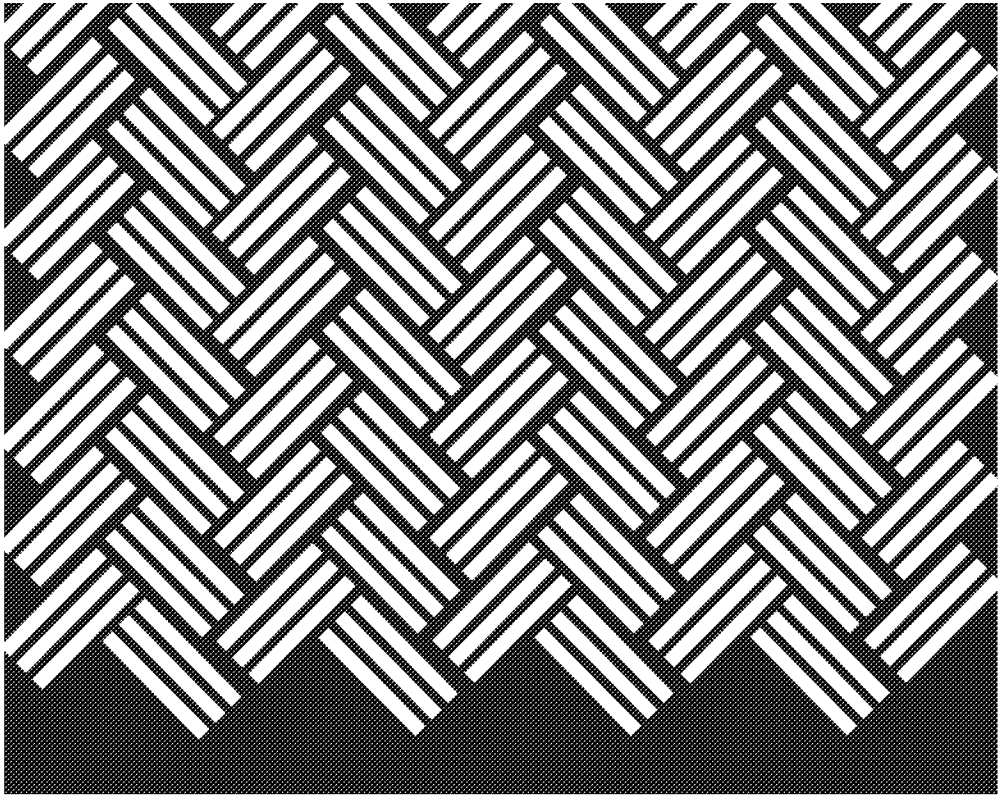
Fig. 15 PRIOR ART
FIG. 15 is a schematic representation of an example of another prior art molding member.

The embryonic wet fibrous structure is transferred from the Fourdrinier wire, at a fiber consistency of about 14-25% at the point of transfer, to a 3D patterned, discrete knuckle, through-air-drying belt (patterned molding member) as shown in FIG. 15. The speed of the 3D patterned through-air-drying belt is 800 feet per minute (fpm), which is the same speed of the Fourdrinier wire. The 3D patterned through-air-drying belt is designed to yield a fibrous structure comprising a pattern of discrete high density knuckle regions oriented approximately 45° relative to CD. Each discrete high density knuckle region oriented approximately 45° relative to CD is separated by a low density continuous pillow region oriented approximately 45° relative to CD. This 3D patterned through-air-drying belt is formed by casting a layer of an impervious resin surface of discrete knuckles onto a fiber mesh supporting fabric similar to that shown in Prior Art FIG. 1B. The supporting fabric is a 98×52 filament, dual layer fine mesh. The thickness of the resin cast is about 12.0 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-70% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 78% polyvinyl alcohol (PVA 88-44), about 22% UNICREPE® 457T20. UNICREPE® 457T20 is commercially available from GP Chemicals. The creping adhesive is delivered to the Yankee surface at a rate of about 0.10-0.20% adhesive solids based on the dry weight of the fibrous structure. The fiber consistency is increased to about 94-98% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 639 fpm.

Two parent rolls of the fibrous structure are then converted into a sanitary tissue product by loading the roll of fibrous structure into an unwind stand. The two parent rolls are converted with the low density pillow side out. The line speed is 750-800 ft/min. One parent roll of the fibrous structure is unwound and transported to an emboss stand where the fibrous structure is strained to form the emboss pattern in the fibrous structure via a 0.50" Pressure Roll Nip and then combined with the fibrous structure from the other parent roll to make a multi-ply (2-ply) sanitary tissue product. Approximately 0.5% of a proprietary quaternary amine softener is added to the top side only of the multi-ply sanitary tissue product. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the properties shown in Table 1 above.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No. of squares in stack)]

For example,

Basis Weight (lbs/3000 $ft^2$)=[[Mass of stack (g)/453.6 (g/lbs)]/[12.25 ($in^2$)/144 ($in^2/ft^2$)×12]]×3000 or,

Basis Weight ($g/m^2$)=Mass of stack (g)/[79.032 ($cm^2$)/10,000 ($cm^2/m^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Caliper Test Method

Caliper of a fibrous structure and/or sanitary tissue product is measured using a ProGage Thickness Tester (Thwing-Albert Instrument Company, West Berlin, NJ) with a pressure foot diameter of 2.00 inches (area of 3.14 $in^2$) at a pressure of 95 $g/in^2$. Four (4) samples are prepared by cutting of a usable unit such that each cut sample is at least 2.5 inches per side, avoiding creases, folds, and obvious defects. An individual specimen is placed on the anvil with the specimen centered underneath the pressure foot. The foot is lowered at 0.03 in/sec to an applied pressure of 95 $g/in^2$. The reading is taken after 3 sec dwell time, and the foot is raised. The measure is repeated in like fashion for the remaining 3 specimens. The caliper is calculated as the average caliper of the four specimens and is reported in mils (0.001 in) to the nearest 0.1 mils.

Density Test Method

The density of a fibrous structure and/or sanitary tissue product is calculated as the quotient of the Basis Weight of a fibrous structure or sanitary tissue product expressed in lbs/3000 ft2 divided by the Caliper (at 95 $g/in^2$) of the fibrous structure or sanitary tissue product expressed in mils. The final Density value is calculated in lbs/ft3 and/or g/cm3, by using the appropriate converting factors.

Stack Compressibility and Resilient Bulk Test Method

Stack thickness (measured in mils, 0.001 inch) is measured as a function of confining pressure ($g/in^2$) using a Thwing-Albert (14 W. Collings Ave., West Berlin, NJ) Vantage Compression/Softness Tester (model 1750-2005 or similar) or equivalent instrument, equipped with a 2500 g load cell (force accuracy is +/−0.25% when measuring value is between 10%-100% of load cell capacity, and 0.025% when measuring value is less than 10% of load cell capacity), a 1.128 inch diameter steel pressure foot (one square inch cross sectional area) which is aligned parallel to the steel anvil (2.5 inch diameter). The pressure foot and anvil surfaces must be clean and dust free, particularly when performing the steel-to-steel test. Thwing-Albert software (MAP) controls the motion and data acquisition of the instrument.

The instrument and software is set-up to acquire crosshead position and force data at a rate of 50 points/sec. The crosshead speed (which moves the pressure foot) for testing samples is set to 0.20 inches/min (the steel-to-steel test speed is set to 0.05 inches/min). Crosshead position and force data are recorded between the load cell range of approximately 5 and 1500 grams during compression. The crosshead is programmed to stop immediately after surpassing 1500 grams, record the thickness at this pressure (termed $T_{max}$), and immediately reverse direction at the same speed as performed in compression. Data is collected during this decompression portion of the test (also termed recovery) between approximately 1500 and 5 grams. Since the foot area is one square inch, the force data recorded corresponds to pressure in units of $g/in^2$. The MAP software is programmed to the select 15 crosshead position values (for both compression and recovery) at specific pressure trap points of 10, 25, 50, 75, 100, 125, 150, 200, 300, 400, 500, 600, 750, 1000, and 1250 $g/in^2$ (i.e., recording the crosshead position of very next acquired data point after the each pressure point trap is surpassed). In addition to these 30 collected trap points, $T_{max}$ is also recorded, which is the thickness at the maximum pressure applied during the test (approximately 1500 $g/in^2$).

Since the overall test system, including the load cell, is not perfectly rigid, a steel-to-steel test is performed (i.e., nothing in between the pressure foot and anvil) at least twice for each batch of testing, to obtain an average set of steel-to-steel crosshead positions at each of the 31 trap points described above. This steel-to-steel crosshead position data is subtracted from the corresponding crosshead position data at each trap point for each tested stacked sample, thereby resulting in the stack thickness (mils) at each pressure trap point during the compression, maximum pressure, and recovery portions of the test.

Stack*T*(trap)=StackCP(trap)−SteelCP(trap)

Where:

trap=trap point pressure at either compression, recovery, or max

StackT=Thickness of Stack (at trap pressure)

StackCP=Crosshead position of Stack in test (at trap pressure)

SteelCP=Crosshead position of steel-to-steel test (at trap pressure)

A stack of five (5) usable units thick is prepared for testing as follows. The minimum usable unit size is 2.5 inch by 2.5 inch; however a larger sheet size is preferable for testing, since it allows for easier handling without touching the central region where compression testing takes place. For typical perforated rolled bath tissue, this consists of removing five (5) sets of 3 connected usable units. In this case, testing is performed on the middle usable unit, and the outer 2 usable units are used for handling while removing from the roll and stacking. For other product formats, it is advisable, when possible, to create a test sheet size (each one usable unit thick) that is large enough such that the inner testing region of the created 5 usable unit thick stack is never physically touched, stretched, or strained, but with dimensions that do not exceed 14 inches by 6 inches.

The 5 sheets (one usable unit thick each) of the same approximate dimensions, are placed one on top the other, with their MD aligned in the same direction, their outer face all pointing in the same direction, and their edges aligned+/−3 mm of each other. The central portion of the stack, where compression testing will take place, is never to be physically touched, stretched, and/or strained (this includes never to 'smooth out' the surface with a hand or other apparatus prior to testing).

The 5 sheet stack is placed on the anvil, positioning it such that the pressure foot will contact the central region of the stack (for the first compression test) in a physically untouched spot, leaving space for a subsequent (second) compression test, also in the central region of the stack, but separated by ¼ inch or more from the first compression test, such that both tests are in untouched, and separated spots in the central region of the stack. From these two tests, an average crosshead position of the stack at each trap pressure (i.e., StackCP(trap)) is calculated for compression, maximum pressure, and recovery portions of the tests. Then, using the average steel-to-steel crosshead trap points (i.e., SteelCP(trap)), the average stack thickness at each trap (i.e., StackT(trap) is calculated (mils).

Stack Compressibility is defined here as the absolute value of the linear slope of the stack thickness (mils) as a function of the log(10) of the confining pressure (grams/in$^2$), by using the 15 compression trap points discussed previously (i.e., compression from 10 to 1250 g/in$^2$), in a least squares regression. The units for Stack Compressibility are mils/(log(g/in$^2$)), and is reported to the nearest 0.1 mils/(log (g/in$^2$)).

Resilient Bulk is calculated from the stack weight per unit area and the sum of 8 StackT(trap) thickness values from the maximum pressure and recovery portion of the tests: i.e., at maximum pressure ($T_{max}$) and recovery trap points at R1250, R1000, R750, R500, R300, R100, and R10 g/in$^2$ (a prefix of "R" denotes these traps come from recovery portion of the test). Stack weight per unit area is measured from the same region of the stack contacted by the compression foot, after the compression testing is complete, by cutting a 3.50 inch square (typically) with a precision die cutter, and weighing on a calibrated 3-place balance, to the nearest 0.001 gram. The weight of the precisely cut stack, along with the StackT(trap) data at each required trap pressure (each point being an average from the two compression/recovery tests discussed previously), are used in the following equation to calculate Resilient Bulk, reported in units of cm$^3$/g, to the nearest 0.1 cm$^3$/g.

$$\text{Resilient Bulk} = \frac{\text{SUM}(\text{Stack}T(T_{max}, R1250, R1000, R750, R500, R300, R100, R10)) * 0.00254}{M/A}$$

Where:

StackT=Thickness of Stack (at trap pressures of $T_{max}$ and recovery pressures listed above), (mils)

M=weight of precisely cut stack, (grams)

A=area of the precisely cut stack, (cm$^2$)

Plate Stiffness Test Method

As used herein, the "Plate Stiffness" test is a measure of stiffness of a flat sample as it is deformed downward into a hole beneath the sample. For the test, the sample is modeled as an infinite plate with thickness "t" that resides on a flat surface where it is centered over a hole with radius "R". A central force "F" applied to the tissue directly over the center of the hole deflects the tissue down into the hole by a distance "w". For a linear elastic material the deflection can be predicted by:

$$w = \frac{3F}{4\pi E t^3}(1 - v)(3 + v)R^2$$

where "E" is the effective linear elastic modulus, "v" is the Poisson's ratio, "R" is the radius of the hole, and "t" is the thickness of the tissue, taken as the caliper in millimeters measured on a stack of 5 tissues under a load of about 0.29 psi. Taking Poisson's ratio as 0.1 (the solution is not highly sensitive to this parameter, so the inaccuracy due to the assumed value is likely to be minor), the previous equation can be rewritten for "w" to estimate the effective modulus as a function of the flexibility test results:

$$E \approx \frac{3R^2}{4t^3}\frac{F}{w}$$

The test results are carried out using an MTS Alliance RT/1, Insight Renew, or similar model testing machine (MTS Systems Corp., Eden Prairie, Minn.), with a 50 newton load cell, and data acquisition rate of at least 25 force points per second. As a stack of five tissue sheets (created without any bending, pressing, or straining) at least 2.5-inches by 2.5 inches, but no more than 5.0 inches by 5.0 inches, oriented in the same direction, sits centered over a hole of radius 15.75 mm on a support plate, a blunt probe of 3.15 mm radius descends at a speed of 20 mm/min. For typical perforated rolled bath tissue, sample preparation consists of removing five (5) connected usable units, and carefully forming a 5 sheet stack, accordion style, by bending only at the perforation lines. When the probe tip descends to 1 mm below the plane of the support plate, the test is terminated. The maximum slope (using least squares regression) in grams of force/mm over any 0.5 mm span during the test is recorded (this maximum slope generally occurs at the end of the stroke). The load cell monitors the applied force and the position of the probe tip relative to the plane of the support plate is also monitored. The peak load is recorded, and "E" is estimated using the above equation.

The Plate Stiffness "S" per unit width can then be calculated as:

$$S = \frac{Et^3}{12}$$

and is expressed in units of Newtons*millimeters. The Testworks program uses the following formula to calculate stiffness (or can be calculated manually from the raw data output):

$$S = \left(\frac{F}{w}\right)\left[\frac{(3+v)R^2}{16\pi}\right]$$

wherein "F/w" is max slope (force divided by deflection), "v" is Poisson's ratio taken as 0.1, and "R" is the ring radius.

The same sample stack (as used above) is then flipped upside down and retested in the same manner as previously described. This test is run three more times (with different sample stacks). Thus, eight S values are calculated from four 5-sheet stacks of the same sample. The numerical average of these eight S values is reported as Plate Stiffness for the sample.

Slip Stick Coefficient of Friction Test Method

Background

Friction is the force resisting the relative motion of solid surfaces, fluid layers, and material elements sliding against each other. Of particular interest here, 'dry' friction resists relative lateral motion of two solid surfaces in contact. Dry friction is subdivided into static friction between non-moving surfaces, and kinetic friction between moving surfaces. "Slip Stick", as applied here, is the term used to describe the dynamic variation in kinetic friction.

Friction is not itself a fundamental force but arises from fundamental electromagnetic forces between the charged particles constituting the two contacting surfaces. Textured surfaces also involve mechanical interactions, as is the case when sandpaper drags against a fibrous substrate. The complexity of these interactions makes the calculation of friction from first principles impossible and necessitates the use of empirical methods for analysis and the development of theory. As such, a specific sled material and test method was identified, and has shown correlation to human perception of surface feel.

This Slip Stick Coefficient of Friction Test Method measures the interaction of a diamond file (120-140 grit) against a surface of a test sample, in this case a fibrous structure and/or sanitary tissue product, at a pressure of about 32 g/in$^2$ as shown in FIGS. 13-15. The friction measurements are highly dependent on the exactness of the sled material surface properties, and since each sled has no 'standard' reference, sled-to-sled surface property variation is accounted for by testing a test sample with multiple sleds, according to the equipment and procedure described below.

Equipment and Set-Up

A Thwing-Albert (14 W. Collings Ave., West Berlin, NJ) friction/peel test instrument (model 225-1) or equivalent if no longer available, is used, equipped with data acquisition software and a calibrated 2000 gram load cell that moves horizontally across the platform. Attached to the load cell is a small metal fitting (defined here as the "load cell arm") which has a small hole near its end, such that a sled string can be attached (for this method, however, no string will be used). Into this load cell arm hole, insert a cap screw (¾ inch #8-32) by partially screwing it into the opening, so that it is rigid (not loose) and pointing vertically, perpendicular to the load cell arm.

After turning instrument on, set instrument test speed to 2 inches/min, test time to 10 seconds, and wait at least 5 minutes for instrument to warm up before re-zeroing the load cell (with nothing touching it) and testing. Force data from the load cell is acquired at a rate of 52 points per second, reported to the nearest 0.1 gram force. Press the 'Return' button to move crosshead 201 to its home position.

A smooth surfaced metal test platform 200, with dimensions of 5 inches by 4 inches by ¾ inch thick, is placed on top of the test instrument platen surface, on the left hand side of the load cell 203, with one of its 4 inch by ¾ inch sides facing towards the load cell 203, positioned 1.125 inches d from the left most tip of the load cell arm 202 as shown in FIGS. 13 and 15.

Sixteen test sleds 204 are required to perform this test (32 different sled surface faces). Each is made using a dual sided, wide faced diamond file 206 (25 mm×25 mm, 120/140 grit, 1.2 mm thick, McMaster-Carr part number 8142A14) with 2 flat metal washers 208 (approximately 11/16th inch outer diameter and about 11/32nd inch inner diameter). The combined weight of the diamond file 206 and 2 washers 208 is 11.7 grams+/−0.2 grams (choose different washers until weight is within this range). Using a metal bonding adhesive (Loctite 430, or similar), adhere the 2 washers 208 to the c-shaped end 210 of the diamond file 206 (one each on either face), aligned and positioned such that the opening 212 is large enough for the cap screw 214 to easily fit into, and to make the total length of sled 204 to approximately 3 inches long. Clean sled 204 by dipping it, diamond face end 216 only, into an acetone bath, while at the same time gently brushing with soft bristled toothbrush 3-6 times on both sides of the diamond file 206. Remove from acetone and pat dry each side with Kimwipe tissue (do not rub tissue on diamond surface, since this could break tissue pieces onto sled surface). Wait at least 15 minutes before using sled 204 in a test. Label each side of the sled 204 (on the arm or washer, not on the diamond face) with a unique identifier (i.e., the first sled is labeled "1a" on one side, and "1b" on its other side). When all 16 sleds 204 are created and labeled, there are then 32 different diamond face surfaces for available for testing, labeled 1a and 1b through 16a and 16b. These sleds 204 must be treated as fragile (particularly the diamond surfaces) and handled carefully; thus, they are stored in a slide box holder, or similar protective container.

Sample Prep

If sample to be tested is bath tissue, in perforated roll form, then gently remove 8 sets of 2 connected sheets from the roll, touching only the corners (not the regions where the test sled will contact). Use scissors or other sample cutter if needed. If sample is in another form, cut 8 sets of sample approximately 8 inches long in the MD, by approximately 4 inches long in the CD, one usable unit thick each. Make note and/or a mark that differentiates both face sides of each sample (e.g., fabric side or wire side, top or bottom, etc.). When sample prep is complete, there are 8 sheets prepared with appropriate marking that differentiates one side from the other. These will be referred to hereinafter as: sheets #1 through #8, each with a top side and a bottom side.

Test Operation

Press the 'Return' button to ensure crosshead 201 is in its home position.

Without touching test area of sample, place sheet #1 218 on test platform 200, top side facing up, aligning one of the sheet's CD edges (i.e. edge that is parallel to the CD) along the platform 218 edge closest to the load cell 202 (+/−1 mm). This first test (pull), of 32 total, will be in the MD direction on the top side of the sheet 218. Place a brass bar weight or equivalent 220 (1 inch diameter, 3.75 inches long) on the sheet 218, near its center, aligned perpendicular to the sled pull direction, to prevent sheet 218 from moving during the test. Place test sled "1a" 204 over cap screw head 214 (i.e., sled washer opening 212 over cap screw head 214, and sled side 1a is facing down) such that the diamond file 206 surface is laying flat and parallel on the sheet 218 surface and the cap screw 214 is touching the inside edge of the washers 208.

Gently place a cylindrically shaped brass 20 gram (+/−0.01 grams) weight 222 on top of the sled 204, with its edge aligned and centered with the sled's back end. Initiate the sled movement m and data acquisition by pressing the 'Test' button on the instrument. The test set up is shown in FIG. 15. The computer collects the force (grams) data and, after approximately 10 seconds of test time, this first of 32 test pulls of the overall test is complete.

If the test pull was set-up correctly, the diamond file 206 face (25 mm by 25 mm square) stays in contact with the sheet 218 during the entire 10 second test time (i.e., does not overhang over the sheet 218 or test platform 200 edge). Also, if at any time during the test the sheet 218 moves, the test is invalid, and must be rerun on another untouched portion of the sheet 218, using a heavier brass bar weight or equivalent 220 to hold sheet 218 down. If the sheet 218 rips or tears, rerun the test on another untouched portion of the sheet 218 (or create a new sheet 218 from the sample). If it rips again, then replace the sled 204 with a different one (giving it the same sled name as the one it replaced). These statements apply to all 32 test pulls.

For the second of 32 test pulls (also an MD pull, but in the opposite direction on the sheet), first remove the 20 gram weight 222, the sled 204, and the brass bar weight or equivalent 220 from the sheet 218. Press the 'Return' button on the instrument to reset the crosshead 201 to its home position. Rotate the sheet 218 180° (with top side still facing up), and replace the brass bar weight or equivalent 220 onto the sheet 218 (in the same position described previously). Place test sled "1b" 204 over the cap screw head 214 (i.e., sled washer opening 212 over cap screw head 214, and sled side 1b is facing down) and the 20 gram weight 222 on the sled 204, in the same manner as described previously. Press the 'Test' button to collect the data for the second test pull.

The third test pull will be in the CD direction. After removing the sled 204, weights 220, 222, and returning the crosshead 201, the sheet 218 is rotated 90° from its previous position (with top side still facing up), and positioned so that its MD edge is aligned with the test platform 200 edge (+/−1 mm). Position the sheet 218 such that the sled 204 will not touch any perforation, if present, or touch the area where the brass bar weight or equivalent 220 rested in previous test pulls. Place the brass bar weight or equivalent 220 onto the sheet 218 near its center, aligned perpendicular to the sled pull direction m. Place test sled "2a" 204 over the cap screw head 214 (i.e., sled washer opening 212 over cap screw head 214, and sled side 2a is facing down) and the 20 gram weight 222 on the sled 204, in the same manner as described previously. Press the 'Test' button to collect the data for the third test pull.

The fourth test pull will also be in the CD, but in the opposite direction and on the opposite half section of the sheet 218. After removing the sled 204, weights 220, 222, and returning the crosshead 201, the sheet 218 is rotated 180° from its previous position (with top side still facing up), and positioned so that its MD edge is again aligned with the test platform 200 edge (+/−1 mm). Position the sheet 218 such that the sled 204 will not touch any perforation, if present, or touch the area where the brass bar weight or equivalent 220 rested in previous test pulls. Place the brass bar weight or equivalent 220 onto the sheet 218 near its center, aligned perpendicular to the sled pull direction m. Place test sled "2b" 204 over the cap screw head 214 (i.e., sled washer opening 212 over cap screw head 214, and sled side 2b is facing down) and the 20 gram weight 222 on the sled 204, in the same manner as described previously. Press the 'Test' button to collect the data for the fourth test pull.

After the fourth test pull is complete, remove the sled 204, weights 220, 222, and return the crosshead 201 to the home position. Sheet #1 218 is discarded.

Test pulls 5-8 are performed in the same manner as 1-4, except that sheet #2 218 has its bottom side now facing upward, and sleds 3a, 3b, 4a, and 4b are used.

Test pulls 9-12 are performed in the same manner as 1-4, except that sheet #3 218 has its top side facing upward, and sleds 5a, 5b, 6a, and 6b are used.

Test pulls 13-16 are performed in the same manner as 1-4, except that sheet #4 218 has its bottom side facing upward, and sleds 7a, 7b, 8a, and 8b are used.

Test pulls 17-20 are performed in the same manner as 1-4, except that sheet #5 218 has its top side facing upward, and sleds 9a, 9b, 10a, and 10b are used.

Test pulls 21-24 are performed in the same manner as 1-4, except that sheet #6 218 has its bottom side facing upward, and sleds 11a, 11b, 12a, and 12b are used.

Test pulls 25-28 are performed in the same manner as 1-4, except that sheet #7 218 has its top side facing upward, and sleds 13a, 13b, 14a, and 14b are used.

Test pulls 29-32 are performed in the same manner as 1-4, except that sheet #8 218 has its bottom side facing upward, and sleds 15a, 15b, 16a, and 16b are used.

Calculations and Results

The collected force data (grams) is used to calculate Slip Stick COF for each of the 32 test pulls, and subsequently the overall average Slip Stick COF for the sample being tested. In order to calculate Slip Stick COF for each test pull, the following calculations are made. First, the standard deviation is calculated for the force data centered on 131st data point (which is 2.5 seconds after the start of the test)+/−26 data points (i.e., the 53 data points that cover the range from 2.0 to 3.0 seconds). This standard deviation calculation is repeated for each subsequent data point, and stopped after the 493rd point (about 9.5 sec). The numerical average of these 363 standard deviation values is then divided by the sled weight (31.7 g) and multiplied by 10,000 to generate the Slip Stick COF*10,000 for each test pull. This calculation is repeated for all 32 test pulls. The numerical average of these 32 Slip Stick COF*10,000 values is the reported value of the Slip Stick COF*10,000 for the sample. For simplicity, it is referred to as just Slip Stick COF, or more simply as Slip Stick, without units (dimensionless), and is reported to the nearest 1.0.

Outliers and Noise

It is not uncommon, with this described method, to observe about one out of the 32 test pulls to exhibit force data with a harmonic wave of vibrations superimposed upon it. For whatever reason, the pulled sled periodically gets into a relatively high frequency, oscillating 'shaking' mode, which can be seen in graphed force vs. time. The sine wave-like noise was found to have a frequency of about 10 sec-1 and amplitude in the 3-5 grams force range. This adds a bias to the true Slip Stick result for that test; thus, it is appropriate for this test pull be treated as an outlier, the data removed, and replaced with a new test of that same scenario (e.g., CD top face) and sled number (e.g. 3a).

To get an estimate of the overall measurement noise, 'blanks' were run on the test instrument without any touching the load cell (i.e., no sled). The average force from these tests is zero grams, but the calculated Slip Stick COF was 66. Thus, it is speculated that, for this instrument measurement system, this value represents that absolute lower limit for Slip Stick COF.

Tear Test Method

The Tear Strength Test Method is run according to TAPPI T414 om-12 "Internal tearing resistance of paper (Elmendorf-type method)" with the following specifications and/or distinctions: Testing is performed on a Thwing-Albert Model 60-100 (available from Thwing-Albert Instrument Company, Philadelphia, USA) Elmendorf type tearing tester, or appropriate equivalent. Testing is performed on ten (10) replicate test specimens in both the Machine Direction (MD) and Cross Direction (CD). For testing of a finished product, eight usable units (also termed sheets) are removed, cut to size, and appropriately stacked together to form the test specimen regardless of the number of plies. The usable units are selected to avoid defects, perforations, creases or folds. When eight usable units are tested, the equation for calculation of average tearing force in section 8.6.1 is modified to have the "number of plies" value replaced with "number of usable units", which would be eight (8) regardless of the number of plies. In addition to the calculation of the average tearing force in both the MD and CD, calculate the Geometric Mean (GM) Tear Value, in units of grams force (gf), according to the following equation:

$$GM \text{ Tear Value } (gf) = \sqrt[2]{MD \text{ Average Tearing Force } (gf) \times CD \text{ Average Tearing Force } (gf)}$$

Dry Tensile Test Method: Elongation, Tensile Strength, TEA and Modulus a. Unlotioned Bath Tissue (Toilet Tissue)

If the fibrous structure sample is an unlotioned bath tissue (toilet tissue), then Elongation, Tensile Strength, TEA and Tangent Modulus are measured on a constant rate of extension tensile tester with computer interface (a suitable instrument is the EJA Vantage from the Thwing-Albert Instrument Co. Wet Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Twenty usable units of fibrous structures are divided into four stacks of five usable units each. The usable units in each stack are consistently oriented with respect to machine direction (MD) and cross direction (CD). Two of the stacks are designated for testing in the MD and two for CD. Using a one inch precision cutter (Thwing Albert) take a CD stack and cut two, 1.00 in±0.01 in wide by at least 3.0 in long strips from each CD stack (long dimension in CD). Each strip is five usable unit layers thick and will be treated as a unitary specimen for testing. In like fashion cut the remaining CD stack and the two MD stacks (long dimension in MD) to give a total of 8 specimens (five layers each), four CD and four MD.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 2.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens. Program the software to calculate the following from the constructed force (g) verses extension (in) curve:

Tensile Strength is the maximum peak force (g) divided by the product of the specimen width (1 in) and the number of usable units in the specimen (5), and then reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in), specimen width (in), and number of usable units in the specimen (5). This is reported as $g*in/in^2$ to the nearest 1 $g*in/in^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 190.5 g (38.1 g×5 layers) force and the 5 data points immediately preceding and the 5 data points immediately following it. This slope is then divided by the product of the specimen width (2.54 cm) and the number of usable units in the specimen (5), and then reported to the nearest 1 g/cm.

The Tensile Strength (g/in), Elongation (%), TEA ($g*in/in^2$) and Tangent Modulus (g/cm) are calculated for the four CD specimens and the four MD specimens. Calculate an average for each parameter separately for the CD and MD specimens.

Calculations:

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA ($g*in/in^2$)×CD TEA ($g*in/in^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA ($g*in/in^2$)+CD TEA ($g*in/in^2$)

Total Modulus=MD Modulus (g/cm)+CD Modulus (g/cm)

Tensile Ratio=MD Tensile Strength (g/in)/CD Tensile Strength (g/in)

b. Towel

If the fibrous structure sample is a towel, such as a paper towel, Elongation, Tensile Strength, TEA and Tangent Modulus are measured on a constant rate of extension tensile tester with computer interface (a suitable instrument is the EJA Vantage from the Thwing-Albert Instrument Co. Wet Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Eight usable units of fibrous structures are divided into two stacks of four usable units each. The usable units in each stack are consistently oriented with respect to machine direction (MD) and cross direction (CD). One of the stacks is designated for testing in the MD and the other for CD. Using a one inch precision cutter (Thwing Albert) take a CD stack and cut one, 1.00 in±0.01 in wide by at least 5.0 in long stack of strips (long dimension in CD). In like fashion cut the remaining stack in the MD (strip long dimension in MD), to give a total of 8 specimens, four CD and four MD strips. Each strip to be tested is one usable unit thick, and will be treated as a unitary specimen for testing.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 4.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the specimen width (1 in), and reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in) and specimen width (in). This is reported as $g*in/in^2$ to the nearest 1 $g*in/in^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 38.1 g force and the 5 data points immediately preceding and the 5 data points immediately following it. This slope is then divided by the specimen width (2.54 cm), and then reported to the nearest 1 g/cm.

The Tensile Strength (g/in), Elongation (%), TEA ($g*in/in^2$) and Tangent Modulus (g/cm) are calculated for the four CD specimens and the four MD specimens. Calculate an average for each parameter separately for the CD and MD specimens.

Calculations:

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA ($g*in/in^2$)×CD TEA ($g*in/in^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA ($g*in/in^2$)+CD TEA ($g*in/in^2$)

Total Modulus=MD Modulus (g/cm)+CD Modulus (g/cm)

Tensile Ratio=MD Tensile Strength (g/in)/CD Tensile Strength (g/in)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A creped sanitary tissue product comprising a through-air-dried fibrous structure comprising a plurality of pulp fibers, wherein the creped sanitary tissue product is void of regenerated cellulose fibers, wherein the creped sanitary tissue product is void of permanent wet strength, wherein the creped sanitary tissue product exhibits a GM Tear Value as measured according to the Tear Strength Test Method and a GM Tensile Value as measured according to the Dry Tensile Test Method such that the creped sanitary tissue product falls above a line having the following equation: $y=0.0328x+12.794$ graphed on a plot of GM Tear Value (y-axis) to GM Tensile Value (x-axis); wherein the GM Tear Value is greater than 22 g and the GM Tensile Value is less than 310 g/in; and wherein creped sanitary tissue product has a sum of MD and CD dry tensile strength of from about 196 g/cm to about 394 g/cm.

2. The sanitary tissue product according to claim 1 wherein the pulp fibers comprise wood pulp fibers.

3. The sanitary tissue product according to claim 1 wherein the pulp fibers comprise non-wood pulp fibers.

4. The sanitary tissue product according to claim 1 wherein the creped sanitary tissue product comprises an embossed fibrous structure ply.

5. The sanitary tissue product according to claim 1 wherein the creped sanitary tissue product comprises a 3D patterned fibrous structure ply.

6. A dispersible, creped sanitary tissue product comprising a through-air-dried fibrous structure comprising a plurality of pulp fibers, wherein the dispersible, creped sanitary tissue product is void of regenerated cellulose fibers, wherein the dispersible, creped sanitary tissue product exhibits a GM Tear Value as measured according to the Tear Strength Test Method and a GM Tensile Value as measured according to the Dry Tensile Test Method such that the dispersible, creped sanitary tissue product falls above a line having the following equation: $y=0.0328x+12.794$ graphed on a plot of GM Tear Value (y-axis) to GM Tensile Value (x-axis); wherein the GM Tear Value is greater than 22 g and the GM Tensile Value is less than 310; and wherein creped sanitary tissue product has a sum of MD and CD dry tensile strength of from about 196 g/cm to about 394 g/cm.

7. The sanitary tissue product according to claim 6 wherein the pulp fibers comprise wood pulp fibers.

8. The sanitary tissue product according to claim 6 wherein the pulp fibers comprise non-wood pulp fibers.

9. The sanitary tissue product according to claim 6 wherein the dispersible, creped sanitary tissue product comprises an embossed fibrous structure ply.

10. The sanitary tissue product according to claim 6 wherein the dispersible, creped sanitary tissue product comprises a 3D patterned fibrous structure ply.

11. A creped, multi-ply sanitary tissue product comprising a through-air-dried fibrous structure comprising a plurality of pulp fibers, wherein the creped, multi-ply sanitary tissue product is void of regenerated cellulose fibers, wherein the creped, multi-ply sanitary tissue product exhibits a GM Tensile Value of less than 700 g/in as measured according to the Dry Tensile Test Method and wherein the creped, multi-ply sanitary tissue product exhibits a GM Tear Value as measured according to the Tear Test Method and a GM Tensile Value as measured according to the Dry Tensile Test Method such that the creped, multi-ply sanitary tissue product falls above a line having the following equation: $y=0.0328x+12.794$ graphed on a plot of GM Tear Value (y-axis) to GM Tensile Value (x-axis); wherein the GM Tear Value is greater than 22 g and the GM Tensile Value is less than 310; and wherein creped sanitary tissue product has a sum of MD and CD dry tensile strength of from about 196 g/cm to about 394 g/cm.

12. The sanitary tissue product according to claim 11 wherein the pulp fibers comprise wood pulp fibers.

13. The sanitary tissue product according to claim 11 wherein the pulp fibers comprise non-wood pulp fibers.

14. The sanitary tissue product according to claim 11 wherein the creped, multi-ply sanitary tissue product comprises an embossed fibrous structure ply.

15. The sanitary tissue product according to claim 11 wherein the creped, multi-ply sanitary tissue product comprises a 3D patterned fibrous structure ply.

* * * * *